US012104226B2

(12) United States Patent
Simone et al.

(10) Patent No.: US 12,104,226 B2
(45) Date of Patent: Oct. 1, 2024

(54) BETA ENHANCED TITANIUM ALLOYS AND METHODS OF MANUFACTURING BETA ENHANCED TITANIUM ALLOYS

(71) Applicants: KARSTEN MANUFACTURING CORPORATION, Phoenix, AZ (US); Taiwan Steel Group, Tainan (TW)

(72) Inventors: Matthew W. Simone, Phoenix, AZ (US); Dennis Chan, Tainan (TW); William Hsieh, Tainan (TW); Michael Wu, Tainan (TW); Thomas M Malota, Gilbert, AZ (US); Christina Cheng, Tainan (TW)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 17/748,674

(22) Filed: May 19, 2022

(65) Prior Publication Data

US 2022/0372597 A1 Nov. 24, 2022

Related U.S. Application Data

(60) Provisional application No. 63/190,728, filed on May 19, 2021.

(51) Int. Cl.

| | |
|---|---|
| ***C22C 14/00*** | (2006.01) |
| ***C22C 21/00*** | (2006.01) |
| ***C22C 27/02*** | (2006.01) |
| ***C22C 27/04*** | (2006.01) |

(52) U.S. Cl.

CPC ..... *C22C 14/00* (2013.01); *C22C 21/00* (2013.01); *C22C 27/025* (2013.01); *C22C 27/04* (2013.01)

(58) Field of Classification Search

CPC ..... C22C 14/00; C22C 21/00; C22C 27/025; C22C 27/04

USPC ..... 420/420

See application file for complete search history.

(56) References Cited

U.S. PATENT DOCUMENTS

| | | | |
|---|---|---|---|
| 5,358,686 | A | 10/1994 | Parris |
| 9,458,527 | B2 | 10/2016 | Tetyukhin |
| 9,750,990 | B2 | 5/2017 | Chang |
| 10,000,826 | B2 | 6/2018 | Kosaka |
| 10,119,178 | B2 | 11/2018 | Thomas |
| 10,258,837 | B2 | 4/2019 | Simone |
| 10,870,040 | B2 | 12/2020 | Simone |
| 2009/0074606 | A1 | 3/2009 | Ogawa |
| 2009/0181794 | A1 | 7/2009 | Tsai |
| 2017/0268091 | A1 | 9/2017 | Woodfield |

(Continued)

FOREIGN PATENT DOCUMENTS

| | | |
|---|---|---|
| CN | 101514411 | 8/2009 |
| CN | 103667789 | 9/2016 |

(Continued)

OTHER PUBLICATIONS

NPL: on-line translation of JP2007125242A, May 2007 (Year: 2007).*

(Continued)

*Primary Examiner* — Jie Yang

(57) ABSTRACT

An α-β titanium alloy, comprising aluminum, vanadium, and molybdenum. The α-β titanium alloy comprises between 5.0 wt % and 8.0 wt % aluminum (Al), between 1.0 wt % and 5.5 wt % Vanadium (V), and between 0.75 wt % and 2.5 wt % molybdenum (Mo). The α-β titanium alloy having a density between 4.35 g/cc and 4.50 g/cc.

11 Claims, 7 Drawing Sheets

(56) References Cited

U.S. PATENT DOCUMENTS

| | | | | |
|---|---|---|---|---|
| 2018/0044763 | A1 | 2/2018 | Tamura | |
| 2018/0080098 | A1 | 3/2018 | Simone | |
| 2018/0093142 | A1* | 4/2018 | Simone | A63B 53/0466 |
| 2019/0203328 | A1* | 7/2019 | Simone | A63B 53/0466 |
| 2021/0077868 | A1* | 3/2021 | Simone | A63B 53/0408 |
| 2021/0164074 | A1 | 6/2021 | Mitropolskaya | |
| 2021/0172037 | A1 | 6/2021 | Simone | |
| 2021/0348252 | A1 | 11/2021 | Miyoshi | |
| 2022/0010419 | A1 | 1/2022 | Simone | |
| 2022/0025485 | A1 | 1/2022 | Yolton | |
| 2022/0025487 | A1 | 1/2022 | Alabort Martinez | |
| 2022/0025488 | A1 | 1/2022 | Alabort Martinez | |
| 2022/0127698 | A1 | 4/2022 | Chiba | |

FOREIGN PATENT DOCUMENTS

| | | | | |
|---|---|---|---|---|
| JP | 2606023 | | 3/1993 | |
| JP | 6-108187 | | 4/1994 | |
| JP | 2007125242 | A * | 5/2007 | A63B 53/0466 |
| JP | 4981369 | | 7/2012 | |
| JP | 2020152970 | A * | 9/2020 | |
| RU | 2256713 | | 7/2005 | |
| RU | 2393258 | | 6/2010 | |
| RU | 2724751 | | 6/2020 | |
| WO | 2000037693 | | 6/2000 | |
| WO | 2016134026 | | 8/2016 | |
| WO | 2019026251 | | 2/2019 | |
| WO | 2020101008 | | 5/2020 | |

OTHER PUBLICATIONS

NPL: on-line translation of JP2020152970A, Sep. 2020 (Year: 2020).*

International Search Report and Written Opinion, dated Aug. 11, 2022, from corresponding PCT Application No. PCT/US2022/072448, filed May 19, 2022.

* cited by examiner

BETA ENHANCED TITANIUM ALLOYS AND METHODS OF MANUFACTURING BETA ENHANCED TITANIUM ALLOYS

RELATED APPLICATIONS

This claims the benefit of U.S. Provisional Patent Appl. No. 63/190,728, filed on May 19, 2021, which is incorporated herein by reference.

FIELD OF INVENTION

The present disclosure relates generally to a beta enhanced (BE) α-β titanium alloys and methods of forming and processing titanium alloys. The titanium alloys presented herein can be related to golf equipment, and more particularly, to materials for faceplates and golf club bodies, and methods to manufacture and heat treat.

BACKGROUND

A golf club head's mass properties can significantly affect performance. Increasing discretionary mass can allow for improved mass placement that may alter a club head's characteristics, such as its center of gravity (CG) and moment of inertia (MOI), thereby leading to improvements in factors such as ball speed, launch angle, travel distance. One way to reduce mass of the club head, thereby increasing discretionary mass, is by reducing thickness of the faceplate. The faceplate of a golf club head is unique from the rest of the club head body, as the face is the component which makes direct contact with the golf ball. It can be challenging to provide a thinned face with mechanical properties allowing for the strength and ductility required by a face. The titanium alloys of the present disclosure, which are high in strength and durability, are ideal for golf club faceplates, which undergo dynamic impact loading over the life of the club.

The mechanical properties of titanium (Ti) alloys are dependent on several factors, including the following: the chemical make-up, the mechanical processes applied to the material, and the heat treatment applied to the material. The chemical make-up of material directly affects the mechanical properties of the α-β Ti alloy. The total weight percent of each element in the material can affect the mechanical properties and the total weight percentage of the α-stabilizer and of (β-stabilizer can affect the mechanical properties of the materials. More specifically, the mechanical properties are influenced by the specific elements it contains as well as the ratio between the α stabilizers and the β-stabilizers. The presence of α stabilizers (e.g., aluminum, oxygen, nitrogen, and carbon) in a Ti alloy promote the alloy to exist in the α phase at typical ambient temperatures, while the presence of β stabilizers (e.g., molybdenum, vanadium, silicon, and iron) in a Ti alloy promote the alloy to exist in the β phase at typical ambient temperatures). In α-β alloys, such as the alloy described herein, the two phases exist alongside one another, thereby allowing for a broad range of properties. The solvus temperature of the material is the temperature at which the alpha and beta microstructures all start to transition to all beta microstructures. If the material can be heated to a temperature just below the solvus temperature and rapidly cooled fast enough the microstructures can be frozen in an in-between phase, with stronger mechanical properties, called martensite.

Conventional α-β titanium alloys currently used in the golf industry contain a large amount of α stabilizers, such as aluminum or oxygen. In one example, the α-β Ti alloy, T-9S, described in U.S. patent application Ser. No. 16/670,972, which is incorporated in its entirety herein by reference, comprises a high aluminum content. This is because the presence of aluminum in Ti alloys can promote stability of its α phase at higher temperatures, allowing for higher temperature heat treatment to occur, improving strength and corrosion resistance by reducing stress. However, α stabilizers, in some cases, can create microscopic hardening in the alloy that leads to a reduction in ductility and increase in brittleness. Because of this, alloys having a high α stabilizer content are unable to be rapidly cooled (quenched) following heating because their makeup results in a very brittle structure when rapidly cooled. These alloys having a high α stabilizer content must be slowly cooled in order to avoid brittleness. Rapid cooling can result in improved mechanical properties by promoting desirable recrystallization structures. Further, the ability to rapid cool greatly reduces the manufacturing time and cost. Therefore, there is a need in the art for a high strength α-β titanium alloy that can handle a quicker manufacturing process including rapid cooling and can allow for a thinner face, while maintaining or improving upon levels of strength, ductility, and durability.

Figure 1:
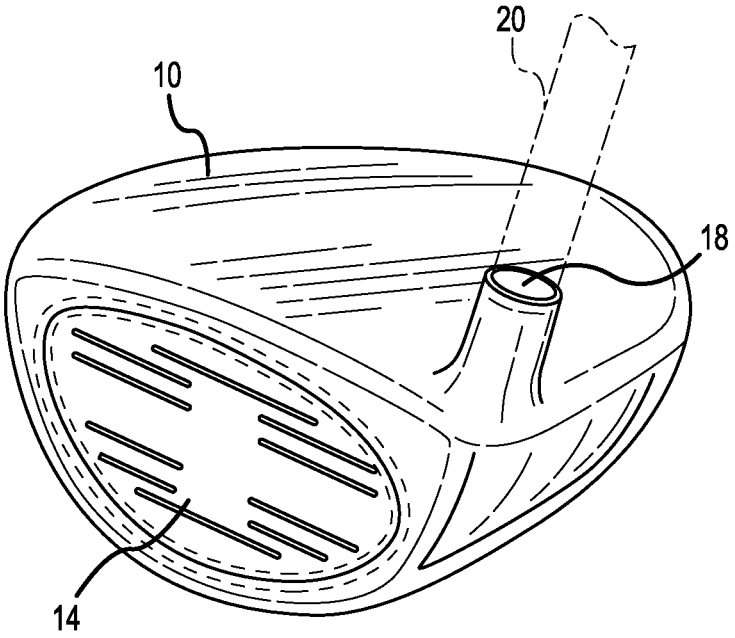
FIG. 1 is a perspective view of a club head and a faceplate, according to a first embodiment.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

Story

In embodiments described below, variations of a Beta enhanced α-β titanium alloy (described herein as "Beta-enhanced α-β Ti alloy" or "BE α-β Ti alloy") have been manufactured that enable a strong weight-to-strength ratio as a result of both chemical composition and a quenching step and allows a 25% thinner faceplate with the same or improved durability as α enhanced α-β titanium alloys. The BE α-β titanium alloy described herein comprises increased levels of certain β stabilizers to increase strength without greatly increasing density, while being capable of withstanding heat treatment processes that include rapid cooling, resulting in a high strength material that has greater ductility than a traditional α-β titanium alloy (such as Ti-9S) with a higher weight percentage of α stabilizers (also referred to herein as an "α enhanced α-β titanium alloy").

The total weight percent of β-stabilizer molybdenum in the α-β Ti alloy may be between 0.50 wt % and 3.50 wt %, and the total weight percent of β-stabilizer vanadium in the α-β Ti alloy may be between 1.0 wt % and 6.0 wt %, the total weight percent of β-stabilizer silicon in the α-β Ti alloy may be between 0.05 wt % and 0.30 wt %, and the total weight percent of β-stabilizer iron in BE α-β Ti alloy may be between 0.0 wt % and 1.5 wt %. The total weight percent of α-stabilizer aluminum in the α-β Ti alloy may be between 4.0 wt % to 9.0 wt %, and the total weight percent of α-stabilizer oxygen in the α-β Ti alloy may be less than or equal to 0.25 wt %. The total weight percent of carbon can be less than or equal to 0.08 wt %. The total weight percent of nitrogen can be less than or equal to 0.05 wt %. The total weight percent of hydrogen can be less than or equal to 0.015 wt %.

The increased levels of certain β stabilizers in the α-β titanium alloy, in the embodiments below, allow for the ability to produce up to a 25% thinner faceplate, while maintaining desirable levels of strength, ductility, and durability. Specifically, increased levels of vanadium and molybdenum, lowers the solvus temperature of the material. The solvus temperature is the temperature at which and alpha and beta crystalline structure start to transition to all beta crystalline structures. However, if one were to heat the material to a temperature just below the solvus temperature and then rapidly cool the material, the crystalline structures can be caught in a transition state between alpha and beta. This halts nucleation or the growth of the crystalline structures in space. This allows the grain structure to remain as small as possible, leading to an all-around stronger material. Further leading to a titanium alloy with ability to be made up to 25% thinner while maintaining at least the same levels of strength, ductility, and durability as an α enhanced α-β titanium alloy. Further, the increased levels of certain β stabilizers in the α-β titanium alloy allow the material to be quenched, ensuring the grain structure remains as small as possible and decreasing the cost and time it takes to produce the material.

The α-β titanium alloy described herein has may applications, as the strength and workability allow for the ability to maintain or improve the level of strength while requiring the use of less material, when compared with currently used α enhanced α-β titanium alloy. The α-β titanium alloy has the ability to be made thinner than traditional α-β titanium alloys while still maintaining the same level of strength, ductility, and durability. Some applications of the α-β titanium alloy described herein can be but are not limited to, golf club faceplates, aero and aero-space applications, and automotive applications.

Definitions

The terms "first," "second," "third," "fourth," and the like in the description and in the claims, if any, are used for distinguishing between similar elements and not necessarily for describing a particular sequential or chronological order. It is to be understood that the terms used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

The terms "couple," "coupled," "couples," "coupling," and the like should be broadly understood and refer to connecting two or more elements or signals, electrically, mechanically and/or otherwise.

The term "face cup," as described herein, is defined as to a component configured to be permanently affixed to an aperture positioned in a front portion the golf club head body.

The term "composition," as described herein, is defined as the kinds and relative count of elements in a material. For alloyed materials, composition describes the weight percent of each alloying element within the material.

The term "α stabilizers" as described herein, is defined as a type of element in a titanium alloy, such as aluminum, oxygen, nitrogen, and carbon. These elements promote the alloy to exist in the α phase at typical ambient temperatures.

The term "β stabilizers" as described herein, is defined as a type of element in a titanium alloy, such as molybdenum, vanadium, iron, and silicon. These elements promote the alloy to exist in the β phase at typical ambient temperatures.

The term "crystal structure," as described herein, describes the material on the atomic scale and refers to the manner in which atoms or ions are spatially arranged. Crystal structure is defined in terms of unit cell geometry.

The term "microstructure," as described herein, describes the structural features of a material, which can be seen using a microscope, such as grain boundaries and grain structures. These features can seldom be seen with the naked eye.

The term "grain structure," as described herein, is defined as a collection of many repeating crystalline structures all oriented in different direction. Features of the grain structure such as grain size, and grain orientation can affect the mechanical properties of the material. The size of the grain can affect the strength of the material, wherein smaller gains are linked to stronger materials.

The term "grain boundaries," as described herein, is defined as the planar defects that occur where two grains meet. Grain boundaries disrupt the motion of dislocations throughout the material, caused by a force applied to the material. The more grain boundaries that are impacted by an external force the less deformation the material will undergo.

The term "tensile strength," as described herein, is defined as the maximum strength under a tensile, or pulling load that a material can absorb without failure. Here, failure is experienced when fracture, snapping, or breakage occurs.

The term "brittleness," as described herein, is defined as the failure by sudden fracture, without plastic deformation. Brittleness is further defined as the absence of ductility.

The "modulus of elasticity," or "Young's Modulus," as described herein, is the ratio of stress to strain and is the slope (E) of the stress-strain curve in the elastic region. The modulus is used to describe a material's stiffness.

The term "yield strength" or "proportional limit," as described herein, is defined as the point on the stress strain curve wherein the material is loaded in tension to the point of permanent, or plastic deformation, such that the deformation remains when the load has been removed.

The term "elongation" or "minimum elongation," as described herein, is a measure of the amount of stretch the material can handle before it starts to permanently deform.

The term "ingot," as described herein, is defined as a mass of metal cast into a shape suitable for further processing and is the starting material for the faceplate.

The term "radial forging," as described herein, is defined as a process involving the use of three or more dies positioned around the material being elongated. The dies may be stationary in their position relative to the material, or the dies may rotate as a unit around the material as it moves through the radial forging machine. Alternatively, the material may be rotated as it is forced through the dies.

The term "billet," as described herein, is defined as a mass of metal that is formed, from an ingot, into a solid length of material in a square profile by radial forging.

The term "cross-rolling," as described herein, is defined as a type of metal forming process wherein the metal is passed through one or more pair of rollers. Once material passes through the rollers once the metal is rotated 90 degrees and passed through the rollers. This process is repeated until the desired reduced thickness is achieved, ensuring a uniform thickness, and enhancing the mechanical properties.

The term "quench," as described herein, is defined as the process of rapidly cooling a metal to obtain certain material properties. The rapid cooling can be achieved by applying a quench media for a predetermined exposure time, and at a predetermined temperature. The quench media can include caustics, oils, molten salt, and gas. The cooling rate and quenching media determine the mechanical properties of the metal directly after quenching.

The term "aging," as described herein, is defined as a form heat treatment, wherein the material is allowed to slowly cool to room temperature, in order to increase strength.

The term "martensite" as described herein, is defined as a very hard and brittle metastable structure created by heating a metal to a very high temperature and then cooling it very quickly. Martensite is a strained atomic arrangement resulting is a material that is typically very high in strength and toughness but very brittle.

The term "transverse" as described herein, defines the direction in which the sample is cut prior to testing. A transverse sample is cut in a direction perpendicular to the rolling direction.

The term "longitudinal" as described herein, defines the direction in which the sample is cut prior to testing. A longitudinal sample is cut in a direction parallel to the rolling direction.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," and "having" and variations thereof herein is meant to encompass the items listed thereafter and equivalents thereof as well as additional items. All weight percent (wt %) numbers described below are a total weight percent.

The general terms used to describe the material properties associated with the disclosed material are provided below. These definitions are regarded as the industry standard and are provided by the professional society of material scientists and material engineers, ASM International.

DETAILED DESCRIPTION

Described herein is a high strength beta (β) enhanced α-β titanium alloy (described herein as "Beta-enhanced α-β Ti alloy" or "BE α-β Ti alloy") with increased levels of β-stabilizers that result in improved workability, an increase in the strength to weight ratio, and a reduction in manufacturing time and cost. The increased presence of β stabilizers allows for the α-β Ti alloy the ability to undergo rapid cooling (i.e., quenching). As discussed below in detail, the ability to quench the material increases strength of the alloy while reducing manufacturing time and preventing unwanted stress concentrations that would ultimately require the high temperature (above solvus temperature) heat treatment to alleviate, as is required by a more traditional, α enhanced α-β Ti alloy, such as Ti-9S.

The present disclosure relates to a material formed from titanium (Ti) alloyed with particular amounts of Aluminum (Al), Vanadium (V), Molybdenum (Mo), Iron (Fe), Silicon (Si), and oxygen (O) to achieve improved mechanical properties. In particular, the α-β Ti alloy may contain β-stabilizers such as molybdenum, iron, silicon, and vanadium. The α-β Ti alloy may contain α stabilizers such as aluminum and oxygen. The α-β Ti alloy may contain α stabilizers such as aluminum and oxygen. The α-β Ti alloy may further include small, and sometimes negligible, amounts of other elements such as carbon, nitrogen, and hydrogen. All numbers described below regarding weight percent are a total weight percent (wt %). The wt % of the β-stabilizers, molybdenum, iron, silicon, and vanadium, is significantly higher, than the wt % of β-stabilizers in more traditional, α enhanced α-β Ti alloys, such as Ti-9S, yielding more desirable mechanical properties. Further, the increased amount of β-stabilizers allows the material to be more versatile in the sense than the mechanical properties can be enhanced by mean of mechanical processes (i.e., cross rolling) or heat treatments. Therefore, the α-β Ti alloy (described herein as "Beta-enhanced α-β Ti alloy" or "BE α-β Ti alloy") may yield a stronger, thinner Ti alloy faceplate 14 with the ability to reduce the mass of the golf club.

The total weight percent of β-stabilizer molybdenum in BE α-β Ti alloy may be between 0.5 wt % and 3.5 wt %, 0.6 wt % and 3.4 wt %, 0.7 wt % and 3.3 wt %, 0.8 wt % and 3.2 wt %, 0.9 wt % and 3.1 wt %, 1.0 wt % and 3.0 wt %, 1.1 wt % and 2.9 wt %, 1.2 wt % and 2.8 wt %, 1.3 wt % and 2.7 wt %, 1.4 wt % and 2.6 wt %, 1.5 wt % and 2.5 wt %, 1.6 wt % and 2.4 wt %, 1.7 wt % and 2.3 wt %, 1.8 wt % and 2.2 wt %, 1.9 wt % and 2.1 wt %, 0.5 wt % and 1.0 wt %, 1.0 wt % and 1.5 wt %, 1.5 wt % and 2.0 wt %, 2.0 wt % and 2.5 wt %, 2.5 wt % and 3.0 wt %, 3.0 wt % and 3.5 wt %, 0.5 wt % and 1.5 wt %, 1.5 wt % and 2.5 wt %, or 2.5 wt % and 3.5 wt %. In certain embodiments, the total weight percent of β-stabilizer molybdenum in BE α-β Ti alloy may be between 0.75 wt % and 1.75 wt %, 1.0 wt % and 2.0 wt %, or 1.5 wt % and 2.5 wt %. In some embodiments, the total weight percent of β-stabilizer molybdenum in BE α-β Ti alloy may be less than 3.5 wt %, less than 3.0 wt %, less than 2.5 wt %, less than 2.0 wt %, less than 1.5 wt %, or less than 1.0 wt %.

The total weight percent of β-stabilizer vanadium in BE α-β Ti alloy may be between 1.0 wt % and 6.0 wt %, 1.1 wt % and 5.9 wt %, 1.2 wt % and 5.8 wt %, 1.3 wt % and 5.7 wt %, 1.4 wt % and 5.6 wt %, 1.5 wt % and 5.5 wt %, 1.6 wt % and 5.4 wt %, 1.7 wt % and 5.3 wt %, 1.8 wt % and 5.2 wt %, 1.9 wt % and 5.1 wt %, 2.0 wt % and 5.0 wt %, 2.1 wt % and 4.9 wt %, 2.2 wt % and 4.8 wt %, 2.3 wt % and 4.7 wt %, 2.4 wt % and 4.6 wt %, 2.5 wt % and 4.5 wt %, 2.6 wt % and 4.4 wt %, 2.7 wt % and 4.3 wt %, 2.8 wt % and 4.2 wt %, 2.9 wt % and 4.1 wt %, 3.0 wt % and 4.0 wt %, 3.1 wt % and 3.9 wt %, 3.2 wt % and 3.8 wt %, 3.3 wt % and 3.7 wt %, or 3.4 wt % and 3.6 wt %. In certain embodiments, the total weight percent of β-stabilizer vanadium in BE α-β Ti alloy may be between 1.5 wt % and 3.5 wt %, 3.0 wt % and 5.0 wt %, or 3.5 wt % and 5.5 wt %. In some embodiments, the total weight percent of β-stabilizer vanadium in BE α-β Ti alloy may be less than 6.0 wt %, less than 5.5 wt %, less than 5.0 wt %, less than 4.5 wt %, less than 4.0 wt %, less than 3.5 wt %, less than 3.0 wt %, less than 2.5 wt %, less than 2.0 wt %, or less than 1.5 wt %.

The total weight percent of β-stabilizer silicon in BE α-β Ti alloy may be between 0.05 wt % and 0.30 wt %, 0.06 wt % and 0.29 wt %, 0.07 wt % and 0.28 wt %, 0.08 wt % and 0.27 wt %, 0.09 wt % and 0.26 wt %, 0.10 wt % and 0.25 wt %, 0.11 wt % and 0.24 wt %, 0.12 wt % and 0.23 wt %, 0.13 wt % and 0.22 wt %, 0.14 wt % and 0.21 wt %, 0.15 wt % and 0.20 wt %, 0.16 wt % and 0.19 wt %, or 0.17 wt % and 0.18 wt %. In some embodiments the total weight percent of β-stabilizer silicon in BE α-β Ti alloy may be 0.0 wt %, 0.2 wt %, 0.3 wt %, 0.4 wt %, 0.5 wt %, 0.6 wt %, or 0.7 wt %. In certain embodiments, the total weight percent of β-stabilizer silicon in BE α-β Ti alloy may be between 0.10 wt % and 0.20 wt %. In some embodiments, the total weight percent of 3-stabilizer silicon in BE α-β Ti alloy may be greater than 0.05 wt %, greater than 0.10 wt %, greater than 0.15 wt %, or greater than 0.20 wt %.

The total weight percent of β-stabilizer iron in BE α-β Ti alloy may be between 0.0 wt % and 1.5 wt %, 0.2 wt % and 1.4 wt %, 0.3 wt % and 1.3 wt %, 0.4 wt % and 1.2 wt %, 0.5 wt % and 1.1 wt %, 0.6 wt % and 1.0 wt %, or 0.7 wt % and 0.9 wt %. In certain embodiments, the total weight percent of β-stabilizer iron in BE α-β Ti alloy may be between 0.2 wt % and 0.3 wt %, 0.2 wt % and 0.8 wt %, or 0.5 wt % and 1.0 wt %.

The total weight percent of aluminum controls the amount of α-stabilizer in the BE α-β Ti alloy. The total weight percent of α-stabilizer aluminum in BE α-β Ti alloy may be between 4.0 wt % and 9.0 wt %, 4.1 wt % and 8.9 wt %, 4.2 wt % and 8.8 wt %, 4.3 wt % and 8.7 wt %, 4.4 wt % and 8.6 wt %, 4.5 wt % and 8.5 wt %, 4.6 wt % and 8.4 wt %, 4.7 wt % and 8.3 wt %, 4.8 wt % and 8.2 wt %, 4.9 wt % and 8.1 wt %, 5.0 wt % and 8.0 wt %, 5.1 wt % and 7.9 wt %, 5.2 wt % and 7.8 wt %, 5.3 wt % and 7.7 wt %, 5.4 wt % and 7.6 wt %, 5.5 wt % and 7.5 wt %, 5.6 wt % and 7.4 wt %, 5.7 wt % and 7.3 wt %, 5.8 wt % and 7.2 wt %, 5.9 wt % and 7.1 wt %, 6.0 wt % and 7.0 wt %, 6.1 wt % and 6.9 wt %, 6.2 wt % and 6.8 wt %, 6.3 wt % and 6.7 wt %, or 6.4 wt % and 6.6 wt %, 4.0 wt % and 5.0 wt %, 4.0 wt % and 6.0 wt %, 4.0 wt % and 7.0 wt %, 5.0 wt % and 8.0 wt %, 4.0 wt % and 9.0 wt %, 5.0 wt % and 6.0 wt %, 5.0 wt % and 7.0 wt %, 5.0 wt % and 8.0 wt %, 5.0 wt % and 9.0 wt %, 6.0 wt % and 7.0 wt %, 6.0 wt % and 8.0 wt %, 6.0 wt % and 9.0 wt %, 7.0 wt % and 8.0 wt %, 7.0 wt % and 9.0 wt %, or 8.0 wt % and 9.0 wt %. In certain embodiments, the total weight percent of α-stabilizer aluminum in BE α-β Ti alloy may be between 5.0 wt % and 7.0 wt %, 6.0 wt % and 7.0 wt, or 6.0 wt % and 8.0 wt %.

The total weight percent of α-stabilizer oxygen in BE α-β Ti alloy can be less than 0.25 wt %. In some embodiments, the total weight percent of α-stabilizer oxygen in BE α-β Ti alloy can be less than or equal to 0.15 wt %. The total weight percent of α-stabilizer oxygen in BE α-β Ti alloy may be between 0.01 wt % and 0.25 wt %, 0.02 wt % and 0.24 wt %, 0.03 wt % and 0.23 wt %, 0.04 wt % and 0.22 wt %, 0.04 wt % and 0.21 wt %, 0.05 wt % and 0.20 wt %, 0.06 wt % and 0.19 wt %, 0.07 wt % and 0.18 wt %, 0.08 wt % and 0.17 wt %, 0.09 wt % and 0.16 wt %, 0.10 wt % and 0.15 wt %, 0.11 wt % and 0.14 wt %, 0.12 wt % and 0.13 wt %, 0.01 wt % and 0.24 wt %, 0.01 wt % and 0.23 wt %, 0.01 wt % and 0.22 wt %, 0.01 wt % and 0.21 wt %, 0.01 wt % and 0.20 wt %, 0.01 wt % and 0.19 wt %, 0.01 wt % and 0.18 wt %, 0.01 wt % and 0.17 wt %, 0.01 wt % and 0.16 wt %, 0.01 wt % and 0.15 wt %, 0.01 wt % and 0.14 wt %, 0.01 wt % and 0.13 wt %, 0.01 wt % and 0.12 wt %, 0.01 wt % and 0.11 wt %, 0.01 wt % and 0.10 wt %, 0.01 wt % and 0.09 wt %, 0.01 wt % and 0.08 wt %, 0.01 wt % and 0.07 wt %, 0.01 wt % and 0.06 wt %, 0.01 wt % and 0.05 wt %, 0.01 wt % and 0.04 wt %, 0.01 wt % and 0.03 wt %, 0.01 wt % and 0.03 wt %, 0.03 wt % and 0.05 wt %, 0.05 wt % and 0.07 wt %, 0.07 wt % and 0.09 wt %, 0.09 wt % and 0.11 wt %, 0.11 wt % and 0.13 wt %, 0.13 wt % and 0.15 wt %, 0.15 wt % and 0.17 wt % 0.17 wt % and 0.19 wt %, 0.21 wt % and 0.23 wt %, or 0.23 wt % and 0.25 wt %. In one example, the total weight percent of α-stabilizer oxygen in BE α-β Ti alloy can be 0.09 wt %.

Other elements such as carbon, nitrogen, and hydrogen have a less impactful effect on the mechanical properties of the BE α-β Ti alloy. However, oversaturating the BE α-β Ti alloy with the aforementioned elements may have a negative effect on the mechanical properties of the BE α-β Ti alloy. Therefore, the total weight percent of carbon may be less than or equal to 0.100 wt %, less than or equal to 0.090 wt %, less than or equal to 0.080 wt %, less than or equal to 0.070 wt %, less than or equal to 0.060 wt %, less than or equal to 0.050 wt %, less than or equal to 0.040 wt %, less than or equal to 0.030 wt %, less than or equal to 0.020 wt %, or less than or equal to 0.010 wt %. The total weight percent of nitrogen may be less than or equal to 0.050 wt %, less than or equal to 0.045 wt %, less than or equal to 0.040 wt %, less than or equal to 0.035 wt %, less than or equal to 0.030 wt %, less than or equal to 0.025 wt %, less than or equal to 0.020 wt %, less than or equal to 0.015 wt %, or less than or equal to 0.010 wt %. The total weight percent of hydrogen may be less than or equal to 0.015 wt %, less than or equal to 0.014 wt %, less than or equal to 0.013 wt %, less than or equal to 0.012 wt %, less than or equal to 0.011 wt %, less than or equal to 0.010 wt %, less than or equal to 0.009 wt %, less than or equal to 0.008 wt %, less than or equal to 0.007 wt %, less than or equal to 0.006 wt %, less than or equal to 0.005 wt %, less than or equal to 0.004 wt %, less than or equal to 0.003 wt %, less than or equal to 0.002 wt %, or less than or equal to 0.001 wt %.

Figure 9:
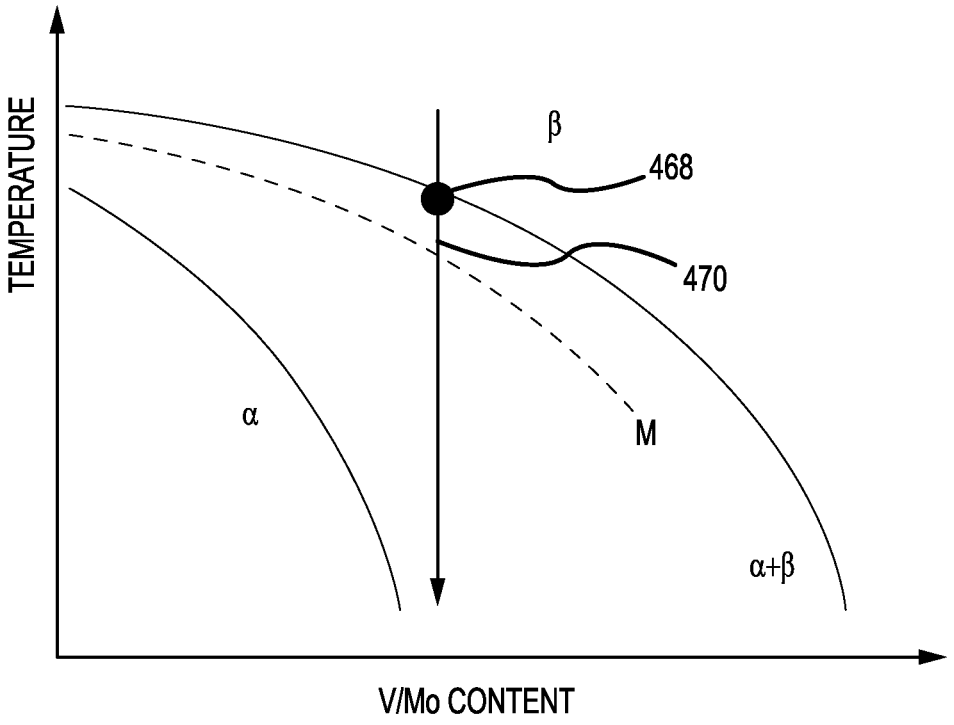
FIG. 9 illustrates a simplified phase diagram marked with approximate positions of the beta solvus temperature and the heat treatment temperature.

The solvus temperature is determined by the combination of α, β stabilizers, as discussed above. As shown in FIG. 9, as the wt % of vanadium and molybdenum (the (β stabilizers) increases the solvus temperature decreases. The solvus temperatures of most α-β Ti alloys are verified and readily available in academic literature or information published by material suppliers. If published data is unavailable, the temperature values can be estimated and experimentally confirmed, since it is dependent on the material's chemistry. The solvus temperature for α-β Ti can be above 800° C. and below 1000° C. In certain embodiments, the solvus temperature for BE α-β Ti alloy can be between 800° C. and 825° C., 825° C. and 850° C., 850° C. and 875° C., 875° C. and 900° C., 900° C. and 925° C., 925° C. and 950° C., 950° C. and 975° C., or 975° C. and 1000° C. In certain embodiment, the solvus temperature for a BE α-β Ti alloy can be below 800° C., below 825° C., below 850° C., below 875° C., below 900° C. and 925° C., below 950° C., below 975° C., or below 1000° C. In one exemplary embodiment the solvus temperature is approximately 930° C.

The overall composition of the BE α-β Ti alloy can be as follows. In one embodiment, the total weight percent of α-stabilizer aluminum in BE α-β Ti alloy may be between 5.0 wt % to 7.0 wt %, the total weight percent of α-stabilizer oxygen in BE α-β Ti alloy may be less than 0.15 wt %, the total weight percent of β-stabilizer molybdenum in BE α-β Ti alloy may be between 0.75 wt % and 1.75 wt %, and the total weight percent of β-stabilizer vanadium in BE α-β Ti alloy may be between 1.5 wt % and 3.5 wt %. The total weight percent of β-stabilizer silicon in BE α-β Ti alloy may be between 0.1 wt % and 0.2 wt %. The total weight percent of β-stabilizer iron in BE α-β Ti alloy may be between 0.2 wt % and 0.3 wt %. The total weight percent of carbon can be less than or equal to 0.08 wt %. The total weight percent of nitrogen can be less than or equal to 0.05 wt %. The total weight percent of hydrogen can be less than or equal to 0.015 wt %. The solvus temperature for this embodiment may be above 800° C. and below 1000° C. The solvus temperature for this embodiment may be below 1000° C., below 975° C., below 950° C., below 925° C., below 900° C., below 875° C., below 850° C., below 825° C., or below 800° C.

In one embodiment, the total weight percent of α-stabilizer aluminum in BE α-β Ti alloy may be between 6.0 wt % and 8.0 wt %, the total weight percent of α-stabilizer oxygen in BE α-β Ti alloy may be less than 0.15 wt %, the total weight percent of β-stabilizer molybdenum in BE α-β Ti alloy may be between 1.5 wt % and 2.5 wt %, and the total weight percent of β-stabilizer vanadium in BE α-β Ti alloy may be between 3.5 wt % and 5.5 wt %. The total weight percent of β-stabilizer silicon in BE α-β Ti alloy may be between 0.1 wt % and 0.2 wt %. The total weight percent of β-stabilizer iron in BE α-β Ti alloy may be between 0.5 wt % and 1.0 wt %. The total weight percent of carbon can be less than or equal to 0.10 wt %. The total weight percent of nitrogen can be less than or equal to 0.05 wt %. The total weight percent of hydrogen can be less than or equal to 0.015 wt %. The solvus temperature 468 for this embodiment may be above 800° C. and below 1000° C. The solvus temperature 468 for this embodiment may be below 1000° C., below 975° C., below 950° C., below 925° C., below 900° C., below 875° C., below 850° C., below 825° C., or below 800° C.

In one embodiment, the total weight percent of α-stabilizer aluminum in BE α-β Ti alloy may be between 6.0 wt % and 7.0 wt %, the total weight percent of α-stabilizer oxygen in BE α-β Ti alloy may be less than or equal to 0.15 wt %, the total weight percent of β-stabilizer molybdenum in BE α-β Ti alloy may be between 1.0 wt % and 2.0 wt %, and the total weight percent of β-stabilizer vanadium in BE α-β Ti alloy may be between 3.0 wt % and 5.0 wt %. The total weight percent of β-stabilizer silicon in BE α-β Ti alloy may be between 0.1 wt % and 0.2 wt %. The total weight percent of β-stabilizer iron in BE α-β Ti alloy may be between 0.2 wt % and 0.8 wt %. The total weight percent of carbon can be less than or equal to 0.08 wt %. The total weight percent of nitrogen can be less than or equal to 0.05 wt %. The total weight percent of hydrogen can be less than or equal to 0.015 wt %. The solvus temperature 468 for this embodiment may be above 800° C. and below 1000° C. The solvus temperature 468 for this embodiment may be below 1000° C., below 975° C., below 950° C., below 925° C., below 900° C., below 875° C., below 850° C., below 825° C., or below 800° C.

The combination of α, β stabilizers as described above, determines the mechanical properties of the BE α-β Ti alloy. A balance of the total weight percentages of each of the elements, as discussed above, provides the material with a desirable strength and ductility while ensuring the density of the BE α-β Ti alloy does not get too high. In one embodiment the density may be between 4.35 g/cm$^3$ and 4.50 g/cm$^3$, 4.35 g/cm$^3$ and 4.36 g/cm$^3$, 4.36 g/cm$^3$ and 4.37 g/cm$^3$, 4.37 g/cm$^3$ and 4.38 g/cm$^3$, 4.38 g/cm$^3$ and 4.39 g/cm$^3$, 4.39 g/cm$^3$ and 4.40 g/cm$^3$, 4.40 g/cm$^3$ and 4.41 g/cm$^3$, 4.41 g/cm$^3$ and 4.42 g/cm$^3$, 4.42 g/cm$^3$ and 4.43 g/cm$^3$, 4.43 g/cm$^3$ and 4.44 g/cm$^3$, 4.44 g/cm$^3$ and 4.45 g/cm$^3$, 4.45 g/cm$^3$ and 4.46 g/cm$^3$, 4.46 g/cm$^3$ and 4.47 g/cm$^3$, 4.47 g/cm$^3$ and 4.48 g/cm$^3$, 4.48 g/cm$^3$ and 4.49 g/cm$^3$, or 4.49 g/cm$^3$ and 4.50 g/cm$^3$. In one exemplary embodiment the density may be 4.413 g/cm$^3$. In a second exemplary embodiment the density can be 4.423 g/cm$^3$. In a third exemplary embodiment the density can be 4.423 g/cm$^3$.

The combination of α, β stabilizers, as described above, may allow the BE α-β Ti alloy to achieve a desirable minimum elongation. The minimum elongation refers to the amount of stretch the material can handle before it starts to permanently deform. For golf club heads 30, it is desirable to maximize the energy returned to a golf ball as it contacts the face during impact. This is achieved by an elastic collision, wherein the material of the faceplate 14 is allowed to flex and deform slightly at impact, maximizing the amount of energy transferred from the faceplate 14 to the golf ball. In one embodiment the minimum elongation may be between 5% and 15%, 6% and 14%, 7% and 13%, 8% and 12%, 9% and 11%, 5% and 6%, 6% and 7%, 7% and 8%, 8% and 9%, 9% and 10%, 10% and 11%, 11% and 12%, 12% and 13%, 13% and 14%, or 14% and 15%. In an exemplary embodiment the minimum elongation may be between 4.5% and 8.0%. In a second exemplary embodiment the minimum elongation may be between 4.5% and 7.0%. In a third exemplary embodiment the minimum elongation may be between 4.5% and 8.0%.

As discussed below, the mechanical properties of the BE α-β Ti alloy are determined by the chemical make-up, the mechanical processes applied and, the heat treatment applies. Variations of the mechanical processes, as described below, can affect the mechanical properties of the BE α-β Ti alloy, such as the yield strength, tensile strength, maximum elongation, and Young's modulus.

In some embodiments, the minimum yield strength of the BE α-β Ti alloy may be between 150 ksi and 170 ksi, 150 ksi and 151 ksi, 151 ksi and 152 ksi, 152 ksi and 153 ksi, 153 ksi and 153 ksi, 153 ksi and 154 ksi, 154 ksi and 155 ksi, 155 ksi and 156 ksi, 156 ksi and 157 ksi, 157 ksi and 158 ksi, 158 ksi and 159 ksi, 159 ksi and 160 ksi, 160 ksi and 161 ksi, 161 ksi and 162 ksi, 162 ksi and 163 ksi, 163 ksi and 163 ksi, 163 ksi and 164 ksi, 164 ksi and 165 ksi, 165 ksi and 166 ksi, 166 ksi and 167 ksi, 167 ksi and 168 ksi, 168 ksi and 169 ksi, or 169 ksi and 170 ksi.

In some embodiments, the minimum tensile strength of the BE α-β Ti alloy may be between 155 ksi and 175 ksi, 155 ksi and 156 ksi, 156 ksi and 157 ksi, 157 ksi and 158 ksi, 158 ksi and 159 ksi, 159 ksi and 160 ksi, 160 ksi and 161 ksi, 161 ksi and 162 ksi, 162 ksi and 163 ksi, 163 ksi and 163 ksi, 163 ksi and 164 ksi, 164 ksi and 165 ksi, 165 ksi and 166 ksi, 166 ksi and 167 ksi, 167 ksi and 168 ksi, 168 ksi and 169 ksi, 169 ksi and 170 ksi, 170 ksi and 171 ksi, 171 ksi and 172 ksi, 172 ksi and 173 ksi, 173 ksi and 173 ksi, 173 ksi and 174 ksi, or 174 ksi and 175 ksi.

In some embodiments, Young's Modulus of the BE α-β Ti alloy may be between 14 Mpsi and 20 Mpsi, 14.0 Mpsi and 14.25 Mpsi, 14.25 Mpsi and 14.5 Mpsi, 14.5 Mpsi and 14.75 Mpsi, 14.75 Mpsi and 15.0 Mpsi 15.0 Mpsi and 15.25 Mpsi, 15.25 Mpsi and 15.5 Mpsi, 15.5 Mpsi and 15.75 Mpsi, 15.75 Mpsi and 16.0 Mpsi, 16.0 Mpsi and 16.25 Mpsi, 16.25 Mpsi and 16.5 Mpsi, 16.5 Mpsi and 16.75 Mpsi, 16.75 Mpsi and 17.0 Mpsi, 18.0 Mpsi and 18.25 Mpsi, 18.25 Mpsi and 18.5 Mpsi, 18.5 Mpsi and 18.75 Mpsi, 18.75 Mpsi and 18.0 Mpsi, 19.0 Mpsi and 19.25 Mpsi, 19.25 Mpsi and 19.5 Mpsi, 19.5 Mpsi and 19.75 Mpsi, or 19.75 Mpsi and 20.0 Mpsi. In one exemplary embodiment, the Young's Modulus of the BE α-β Ti alloy is 17 Mpsi.

Method for Forming the be α-β Ti Alloy

The strength along with other mechanical properties can be increased by applying the following manufacturing process to the material. The manufacturing process is as follows. The first step 573 involves radial forging an ingot to form a billet 354. The second step 575 involves slicing the billet 354 to form a section 356. The third step 577 involves press forging the section 356 to form a plate 358. The fourth step 579 involves cross-rolling the plate 358 to form a sheet 360.

Figure 7A:
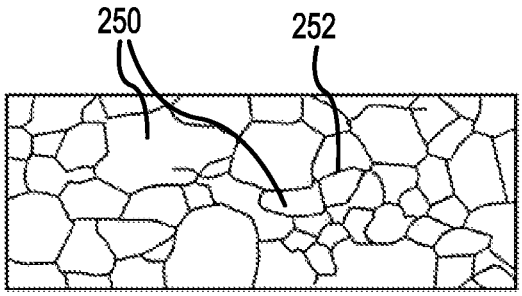
FIG. 7A is a scanning electron microscope image depicting grain structure of an arbitrary metal material prior to deformation.
Figure 7B:
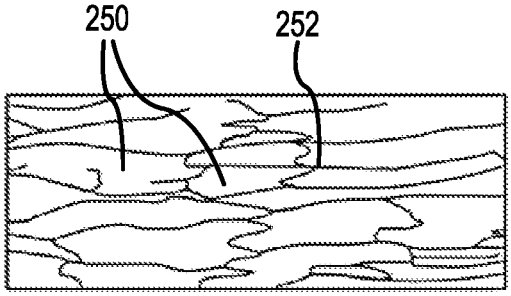
FIG. 7B is a scanning electron microscope image depicting grain structure of the material of FIG. 7A, following deformation by traditional hot rolling.
Figure 8:
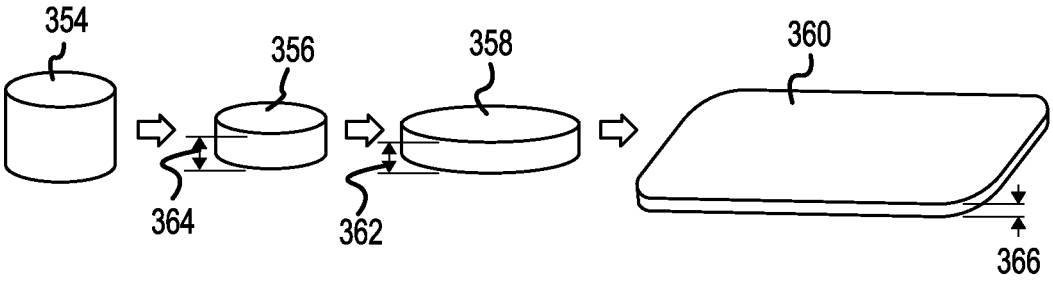
FIG. 8 is a visual depiction of the general shape of a metal across multiple stage of forging, pressing, and rolling.

Further, the first step 573 for radial forging includes heating an ingot to a point below the melting point and forcing the ingot through a plurality of dies to form a billet 354. In one embodiment, the ingot is heated to a temperature close to, but no greater than, the solvus temperature 468. Unlike traditional forging, which impacts the ingot from only the top and bottom, the plurality of dies may impact the ingot from multiple sides. The billet 354 formed by radial forging can have, in some embodiments, a square or rectangular cross section. In other embodiments, the billet 354 formed by radial forging can have a round or oval cross section. Referring to FIG. 7A, this ensures the grain structure 250 remains relatively uniform when compared to traditional forging (see FIG. 7B), which elongates the grain structure 250. As stated above, the grain boundaries 252 disrupt the movement of an external force through material, preventing the deformation of said material. The more grain boundaries 252 the external force contacts, the less the material deforms; therefore, more grain boundaries 252 results in a stronger material. Elongating the grain structure 250, as shown in FIG. 7B, does strengthen the material if the force were to be applied in a specific direction, it would travel though the material in a direction such that the grains 250 have a greater than 1:2 ratio of maximum height, measured in a top to bottom direction in FIGS. 7A and 7B, to maximum width, measured in a left to right direction in FIGS. 7A and 7B. However, the material would be significantly weaker if the force were to be applied from the opposite direction, for example, from the left or right (in reference to FIG. 7B). In embodiments in which the material is used for a golf club head faceplate 14, because of the way the material would have to be stretched to create the necessary shape and thickness of the faceplate 14, the force is applied in a direction that the grains are longer (from the left or right side reference to FIG. 7B). Further, since radial forging impacts all sides of the ingot the circumferential pressure removes porosity as well as any non-uniformity from the ingot that may have been formed when the ingot was cast.

Further in the second step 575, after the billet 354 is produced by radial forging, the billet 354 may be sliced across its diameter into a section 356 having a section thickness 364. In a third step 577, the section 356 is then press forged to form a plate 358 having a plate thickness 362. The plate thickness 362 is smaller than the section thickness 364. Next, in a fourth step 579, the plate 358 may be heated to a predetermined temperature that allows the plate 358 to be rolled and cross rolled to further thin the material and form a sheet 360. The predetermined temperature can be between 850° C. and 950° C. In one embodiment the predetermined temperature may be between 850° C. and 860° C., 860° C. and 870° C., 870° C. and 880° C., 880° C. and 890° C., 890° C. and 900° C., 900° C. and 910° C., 910° C. and 920° C., 920° C. and 930° C., 930° C. and 940° C., or 940° C. and 950° C. In one example, the predetermined temperature may be 900° C. In another example, the predetermined temperature may be 930° C. If the predetermined temperature is too high when the material is cross rolled this can result in undesirably large grain structures. This step involves feeding the sheet 360 of material through a series of rollers. Once the material fully passes through the series of rollers the sheet 360 is rotated 90 degrees and again fed through the series of rollers. This process is repeated until a desired thickness, slightly greater than the final desired thickness of the faceplate 14, is achieved. After the sheet 360 is cross rolled to achieve a desired thickness, a laser cutter is used to a cut out a general faceplate 14 shape.

Figure 11:
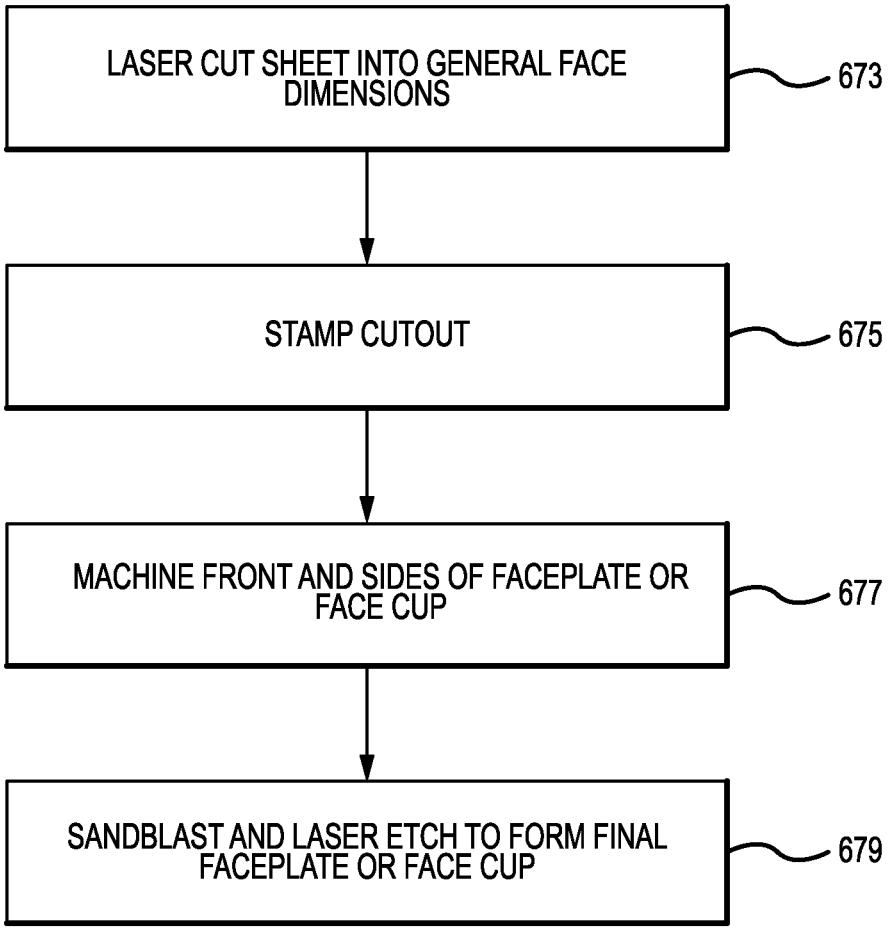
FIG. 11 is a schematic view of a process for forming a faceplate from a sheet.

As described below, the BE α-β Ti alloy may be applied to a faceplate 14 of a golf club head. FIG. 11 shows the process for forming a faceplate 14 from the sheet. In the first step 673, a laser cuts roughly the shape of a faceplate 14 out of the sheet, creating a cutout. In some embodiments, CNC machining is then used to machine multiple notches or tabs in the cutout. In other embodiments, the cutout is left without notches. The second step 675 involves raw stamping the cutout at a specified temperature to form the faceplate 14. In many embodiments, the stamping temperature can be between 800° C. and 850° C. In some embodiments, the second step can include a multi-step stamping process. The multi-step stamping process can involve heating the cutout to a temperature between 800° C. and 850° C. and stamping two or more times. In embodiments comprising a face cup 114, a series of dies are positioned strategically around the cutout, causing a peripheral region of the faceplate 14 to curve when stamped, thereby forming the crown return 148 and sole return 150 regions. The third step 677 involves CNC machining the front and side walls of the faceplate 14 to include details such as grooves and milling or other texture. In the fourth step 679, the faceplate 14 is sandblasted and finished by laser etching. The faceplate 14 is then secured to the club head by means of plasma welding, thereby creating a club head assembly.

As previously mentioned, the faceplate 14 may be secured to the club head body 10 by welding, orienting the new BE α-β Ti alloy in the faceplate 14 to the golf club, as described below. In one embodiment, after the desired shape of the faceplate 14 is achieved, as discussed above, the faceplate 14 is secured to the club head body 10 by means of plasma welding. In another embodiment, the faceplate 14 may be secured to the club head body 10 by means of pulse laser welding. In another embodiment, the faceplate 14 may be secured to the club head body 10 by means of continuous laser welding. In another embodiment, the faceplate 14 may be secured to the club head body 10 by means of friction welding. After this step, the faceplate 14 and the club head body 10 may undergo a heat treatment to improve mechanical properties. The chemical make-up of the BE α-β Ti alloy allows for the ability to undergo a two-step heat treatment, wherein the material is heated to a temperature 470 just below the solvus temperature 468 and then quenched before an aging process is applied.

As understood by a person of ordinary skill, referring to FIG. 9, the solvus temperature 468 for an alloy is the temperature barrier at which the α and β crystalline structures start to transform into all β crystalline structure. It is at this point that the hexagonal close packed crystal structure associated with alpha microstructures start to transform into body centered cubic crystal structures associated with β microstructures. Body centered cubic structures tend to be stronger and offer more planes for the lattice to deform than hexagonal close packed structures, thereby improving mechanical properties. Hexagonal close packed structures tend to be more brittle and prone to cracking than body centered cubic structures. Cooling the material allows the material to transform from the β phase back into a mixture of β phase and α phase. If the material is heated to a temperature 470 just below the solvus temperature 468, as discovered above, and then cooled fast (quenched) enough the atoms may be frozen in an in-between phase called martensite. Capturing the material in the martensite phase keeps the grain size smaller, which greatly increases the strength of the material. The combination of α, β stabilizers, as described above, and more specifically the β stabilizers, MO and V, decreases the solvus temperature 468 allowing the material to be easily quenched, catching the material in martensite. However, for α enhanced α-β titanium alloys, martensite can be an extremely brittle state because of the high presence of close packed hexagonal crystal structures. The increased amount of body centered cubic crystal structures, resulting from the increased presence of β stabilizers in BE α-β Ti alloy ensures the material is less brittle than a traditional α enhanced α-β Ti alloy. Specifically, the increased presence of β stabilizers (e.g., molybdenum, iron, silicon, and vanadium) results in the ability to perform processing and methods below solvus temperature 468. One notable benefit of the BE α-β titanium alloy is its ability to allow for rapid cooling (i.e., quenching) following heat treatment, thereby completely removing the need for stress-relieving post-processing heat treatment at high temperatures above the solvus temperature 468, which is required for α enhanced α-β titanium alloys, such as Ti-9S.

Further, the combination of α, β stabilizers, as discussed above allows the α-β Ti alloys to be heat treated in the manner provided below. In one embodiment, the heat treatment can be a two-step process. The first step may be performed to increase certain mechanical properties such as strength, and fracture toughness. The second step may be performed to soften the material, making it more workable and increasing the minimum elongation and ductility. The combination of a, (β stabilizers, as discussed above, along with the two-step heat treatment, as discussed below, allows the BE α-β Ti alloy to obtain the desirable balance of strength, fracture resistance, and ductility.

In many embodiments, the heat treatment steps are completed after the BE α-β Ti alloy is formed into its final state. The first step of the heat treatment may involve heating the metal to a predetermined temperature 470 followed by a rapid cooling (quenching). In one embodiment, the BE α-β Ti alloy may be heated to a temperature 470 at, just below, or less than the solvus temperature 468 of the material for a predetermined amount of time. In these embodiments, the BE α-β Ti alloy, may be heated to a temperature 470 between 800° C. and 825° C., 825° C. and 850° C., 850° C. and 875° C., 875° C. and 900° C., 900° C. and 925° C., 925° C. and 950° C., 950° C. and 975° C., or 975° C. and 1000° C. In some embodiments, the BE α-β Ti alloy can be heated to a temperature 470 of approximately 925° C., 926° C., 927° C., 928° C., 929° C., 930° C., 931° C., 932° C., 933° C., 934° C., or 935° C. In one exemplary embodiment, the BE α-β Ti alloy can be heated to a temperature 470 of approximately 930° C.

As discussed above, after heating the BE α-β Ti alloy, it can be quenched in order to quickly return the club head assembly back to room temperature, thereby freezing the material in martensite, as discussed above. The BE α-β Ti alloy may be cooled by a quench selected from the group consisting of caustics (i.e., water, brines, and caustic sodas), oil, molten salt, or inert gas. In one exemplary embodiment, the quenching of the club head assembly 30 may be done in an inert gas environment. The inert gas may be selected from the group consisting of nitrogen (N), argon (Ar), helium (He), neon (Ne), krypton (Kr), and xenon (Xe) or a compound gas thereof. Further, the cooling of the BE α-β Ti alloy may be done in a pressurized environment. Wherein the pressure may be between 0.5 Bar and 20 Bar. In one embodiment the pressure may be between 0.50 Bar and 1.00 Bar, 1.00 Bar and 1.50 Bar, 1.50 Bar and 2.00 Bar, 2.00 Bar and 2.50 Bar, 2.50 Bar and 3.00 Bar, 3.00 Bar and 3.50 Bar, 3.50 Bar and 4.00 Bar, 4.00 Bar and 4.50 Bar, 4.50 Bar and 5.00 Bar, 5.00 Bar and 5.50 Bar, 5.50 Bar and 6.00 Bar, 6.00 Bar and 6.50 Bar, 6.50 Bar and 7.00 Bar, 7.00 Bar and 8.50 Bar, 8.50 Bar and 9.00 Bar, 9.00 Bar and 9.50 Bar, 9.50 Bar and 10.00 Bar, 10.00 Bar and 10.50 Bar, 10.50 Bar and 11.00 Bar, 11.00 Bar and 11.50 Bar, 11.50 Bar and 12.00 Bar, 12.00 Bar and 12.50 Bar, 12.50 Bar and 13.00 Bar, 13.00 Bar and 13.50 Bar, 13.50 Bar and 14.00 Bar, 14.00 Bar and 15.50 Bar, 15.50 Bar and 16.00 Bar, 16.00 Bar and 17.50 Bar, 17.50 Bar and 18.00 Bar, 18.00 Bar and 18.50 Bar, 18.50 Bar and 19.00 Bar, 19.00 Bar and 19.50 Bar, or 19.50 Bar and 20.00 Bar. The pressurized environment may accelerate the rate of cooling when comparted to normal atmospheric pressure. Increasing the pressure in the environment can simulate the type of flash freezing one would associate with water quenching without causing the distortion typically associated with cooling a metal this quickly. Increasing the pressure during quenching ensures that the atoms are frozen in martensite (in-between phase) without causing distortion.

After the BE α-β Ti alloy undergoes the first heat treatment step, as described above, it may undergo a second heat treatment step involving a form of aging. In one embodiment, after the solution annealing process is complete, the BE α-β Ti alloy may be heated to a temperature 470 below the solvus temperature 468 for a predetermined amount of time. In another embodiment, after the solution annealing process is complete, the BE α-β Ti alloy may be heated to a temperature below the solvus temperature 468 for a predetermined amount of time. The temperature may be between 500° C. and 700° C. In one embodiment, the temperature may be between 500° C. and 525° C., 525° C. and 550° C., 550° C. and 575° C., 575° C. and 600° C., 600° C. and 625° C., 625° C. and 650° C., 650° C. and 675° C., or 675° C. and 700° C. In some embodiments, the temperature may be In one exemplary embodiment, the temperature is approximately 590° C. In a second exemplary embodiment, the temperature is approximately 620° C. In one embodiment, the BE α-β Ti alloy may be heated at a temperature, as described above for a predetermined amount of time between 3 hours and 9 hours. The time may be between 3.0 hours and 3.5 hours, 3.5 hours and 4.0 hours, 4.0 hours and 4.5 hours, 4.5 hours and 5.0 hours, 5.0 hours and 5.5 hours, 5.5 hours and 6.0 hours, 6.0 hours and 6.5 hours, 6.5 hours and 7.0 hour, 7.0 hours and 7.5 hours, 7.5 hours and 8.0 hours, 8.0 hours and 8.5 hours, or 8.5 hours and 9.0 hours.

As discussed above, after heating the BE α-β Ti alloy, it is allowed to cool to room temperature. In another embodiment, after the heat treatment, the BE α-β Ti alloy may be allowed to air cool to slowly reduce the temperature of the material. The cooling may be done in an inert gas environment or non-contained environment (open air). In another embodiment, the BE α-β Ti alloy may be allowed to cool in an inert gas environment to slowly reduce the club head assembly's temperature and reduce chance for oxidation. The inert gas may be selected from the group consisting of nitrogen (N), argon (Ar), helium (He), neon (Ne), krypton (Kr), and xenon (Xe) or a compound gas thereof. In another embodiment, the BE α-β Ti alloy may be allowed to first cool in an inert gas environment for a predetermined amount of time and then may be allowed to cool in a non-contained environment until it reaches room temperature.

The heat treatment, as described above improves the strength and durability of the faceplate 14. The improved strength permits the faceplate 14 to be made thinner without sacrificing durability, thereby reducing club head weight. The reduced weight of faceplate 14 shifts the center of gravity of the club head assembly 30 and allows additional weight to be added to another component of the club to further adjust the center of gravity. Increasing the durability of the faceplate 14 permits the faceplate 14 to endure a significantly higher number of hits against a golf ball and maintain the faceplate 14's slightly bowed or rounded shape over the life of the club while sustaining hundreds or thousands of golf ball strikes. Therefore, the club is more forgiving when a ball is struck off-center because the rounded shape of the faceplate 14 provides a "gear effect" between the ball and faceplate 14.

Figure 2:
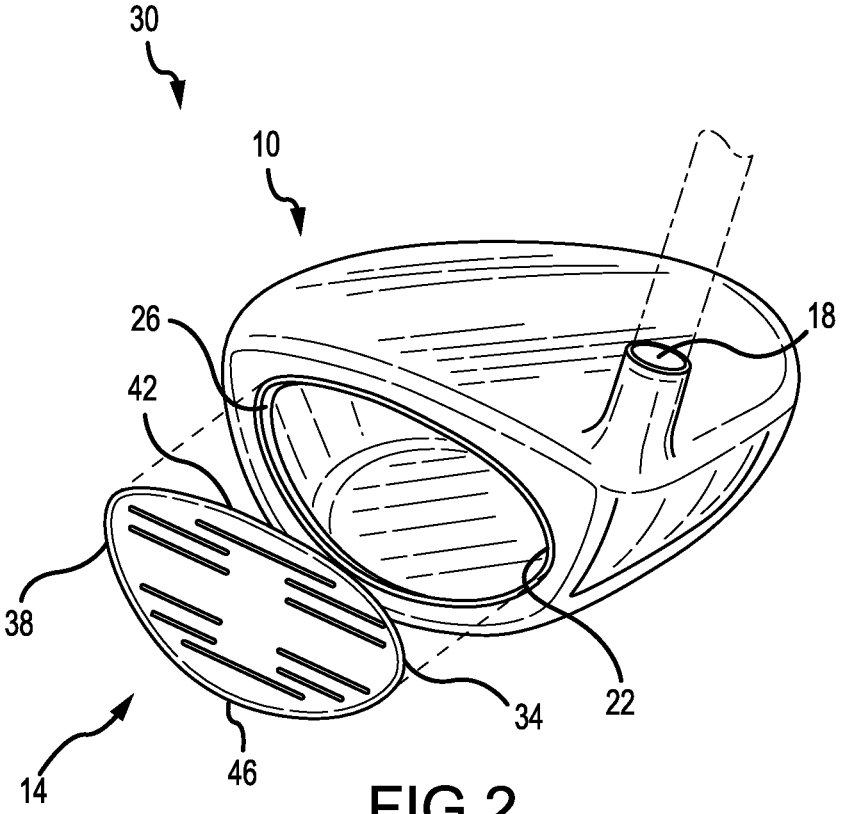
FIG. 2 is a perspective view of the club head of FIG. 1 with the faceplate removed.
Figure 3:
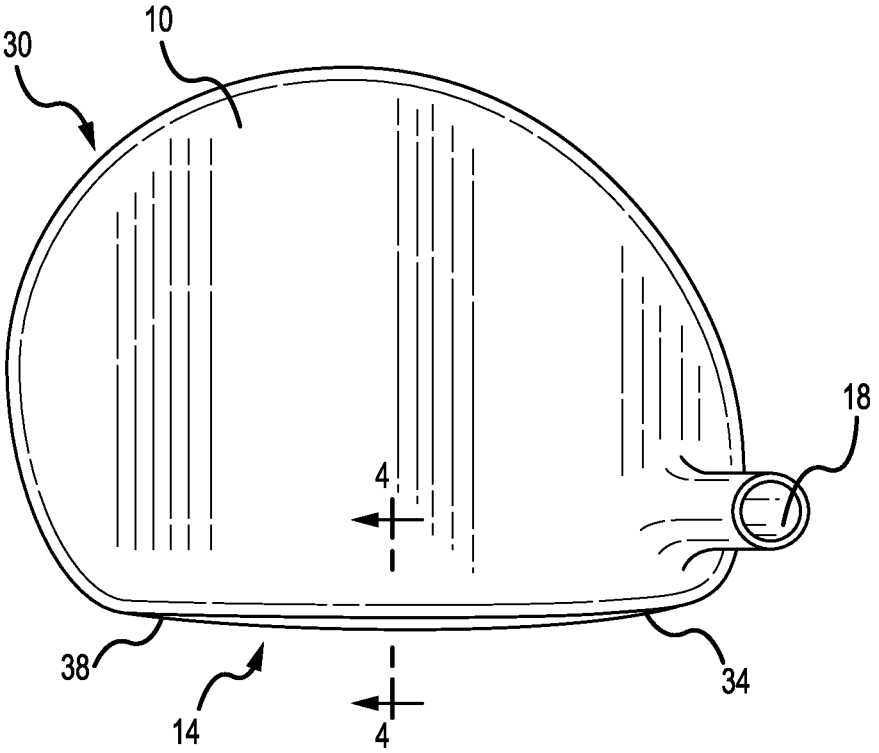
FIG. 3 is a top view of a club head assembly.
Figure 5:
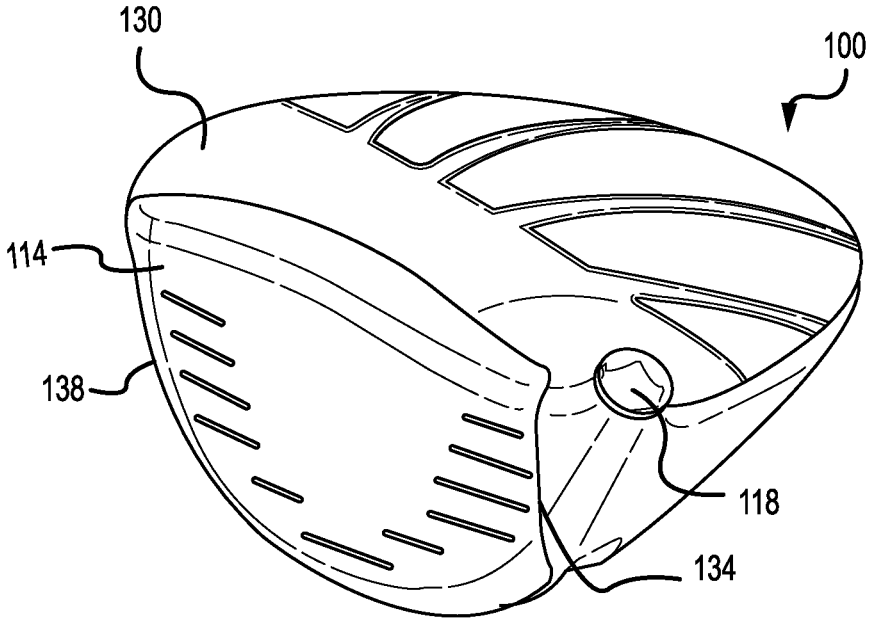
FIG. 5 is a perspective view of a club head and a face cup, according to a second embodiment.
Figure 6:
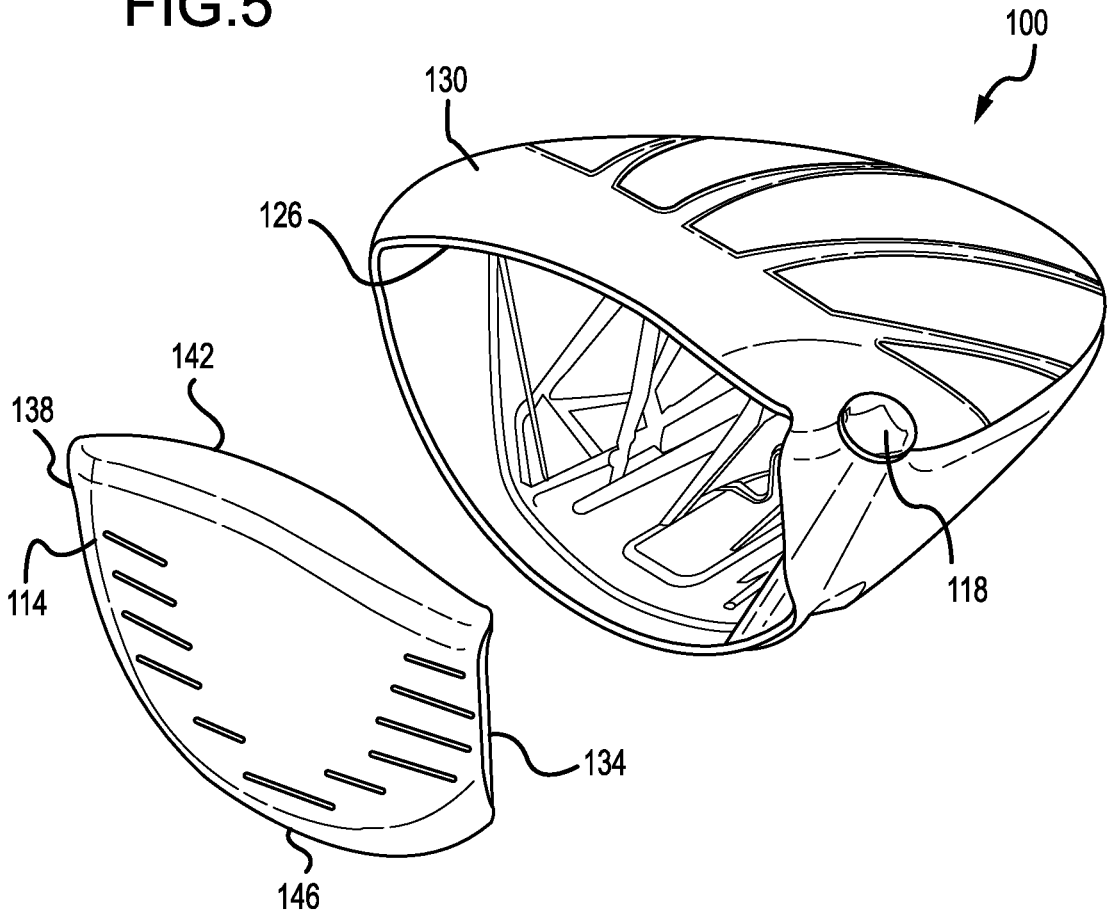
FIG. 6 is a perspective view of the club head of FIG. 5 with the face cup removed.

The BE α-β Ti alloy described herein can, in some embodiments, be formed and assembled so as to be used as a faceplate 14 for a golf club head 10. These embodiments require the following manufacturing steps to form and attach the faceplate 14 to the golf club head 10 to form the golf club head assembly 30. Referring to FIGS. 1-3, the golf club head assembly 30 can have a club head body 10 and a faceplate 14. In some embodiments, as illustrated in FIGS. 5 and 6, the faceplate 14 can be a face cup 114. The details described below in reference to golf club head body 10 including a faceplate 14 can also be applied to golf club head body 100 including a face cup 114, unless otherwise specified. In one embodiment, the golf club head body 10 is formed from a cast material and the faceplate 14 is formed from a rolled material. Further, in the illustrated embodiments, the golf club head body 10 is a metal wood driver; in other embodiments, the golf club head body 10 can be a fairway wood, a hybrid, or an iron. The club head body 10 may also include a hosel region 18 including a hosel and a hosel transition. In one example, the hosel may be located at or proximate to the heel end 34. The hosel may extend from the club head body 10 via the hosel transition. To form a golf club, the hosel may receive a first end of a shaft 20. The shaft 20 may be secured to the golf club head body 10 by an adhesive bonding process (e.g., epoxy) and/or other suitable bonding process (e.g., mechanical bonding, soldering, welding, and/or brazing). Further, a grip (not shown) may be secured to a second end of the shaft 20 to complete the golf club.

As shown in FIG. 2, the club head body 10 further includes an aperture or opening 22 for receiving the faceplate 14. In the illustrated embodiment, the opening 22 includes a lip 26 extending around the perimeter of the opening 22. The faceplate 14 is aligned with the opening and abuts the lip 26. The faceplate 14 is secured to the club head body 10 by welding, forming a club head assembly 30. In one embodiment, the welding is a pulse plasma welding process.

Figure 4:
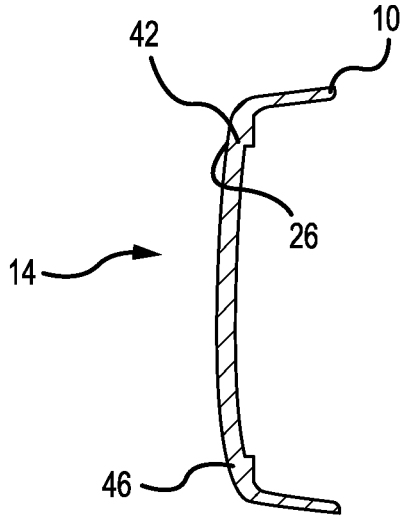
FIG. 4 is a side section view of the club head assembly of FIG. 3 along section 4-4.

The faceplate 14 includes a heel end 34 and a toe end 38, opposite the heel end 34. The heel end 34 is positioned proximate the hosel portion (hosel and hosel transition 18) where the shaft 20 (FIG. 1) is coupled to the club head assembly 30. The faceplate 14 further includes a crown edge 42 and a sole edge 46 opposite the crown edge 42. The crown edge 42 is positioned adjacent an upper edge of the club head body 10, while the sole edge 46 is positioned adjacent the lower edge of the club head body 10. As shown in FIG. 3, the faceplate 14 has a bulge curvature in a direction extending between the heel end 34 and the toe end 38. As shown in FIGS. 4 and 5, the faceplate 14 also has a roll curvature in a direction extending between the crown edge 42 and the sole edge 46.

In many embodiments, the faceplate 14 may have a minimum wall thickness between 0.065 inch and 0.0100 inch. In some examples, the minimum wall thickness of the faceplate 14 can be between 0.065 inch and 0.100 inch, 0.065 inch and 0.070 inch, 0.070 inch and 0.075 inch, 0.075 inch and 0.080 inch, 0.080 inch and 0.085 inch, 0.085 inch and 0.090 inch, 0.090 inch and 0.095 inch, or 0.095 inch and 0.100 inch. In many embodiments, the faceplate 14 can have a maximum wall thickness between 0.115 inch and 0.150 inch. In some examples, the maximum wall thickness of the faceplate 14 can be between 0.115 inch and 0.120 inch, 0.120 inch and 0.125 inch, 0.125 inch and 0.130 inch, 0.130 inch and 0.135 inch, 0.135 inch and 0.140 inch, 0.140 inch and 0.145 inch, or 0.145 inch and 0.150 inch. In many embodiments, the minimum and maximum wall thicknesses of the faceplate 14 comprising the BE α-β Ti alloy described herein can be between 0.003" and 0.007" thinner than that of a faceplate 14 comprising an α enhanced α-β Ti alloy, such as the currently used Ti-9S alloy. In some embodiments, the minimum and maximum wall thicknesses of the faceplate 14 comprising the BE α-β Ti alloy described herein can be up to 15% to 25% to thinner than that of a faceplate 14 comprising an α enhanced α-β Ti alloy, such as the currently used Ti-9S alloy. In other embodiments, the minimum and maximum wall thicknesses of the faceplate 14 comprising the BE α-β Ti alloy described herein can be up to 5% to 15% to thinner than that of a faceplate 14 comprising an α enhanced α-β Ti alloy, such as the currently used Ti-9S alloy.

The face cup 114 of golf club head body 100, illustrated in FIGS. 5 and 6, is similar in many ways to faceplate 14, described above. As shown in FIG. 5, the club head body 100 further includes a recess or opening 122 for receiving the face cup 114. In the illustrated embodiment, the opening 122 includes a lip 126 extending around the perimeter of the opening 122. The face cup 114 is aligned with the opening and abuts the lip 126. The face cup 114 is secured to the body by welding, forming a club head assembly 100. In one embodiment, the welding is a pulse plasma welding process.

The face cup 114 comprises a face cup toe portion 138, a face cup heel portion 134, a crown edge 142 and a sole edge 146 opposite the crown edge 142. The face cup 114 is configured to be received within and permanently affixed to an aperture 122 in the body 110 to form a front portion 152 of the golf cub head 100. The face cup 114 crown return 148, face cup sole return 150, and face cup toe portion 138 surround the face cup strike face portion. The face cup crown edge 142 defines a peripheral edge of the face cup crown return 148. The face cup sole edge 146 defines a peripheral edge of the face cup sole return 150. The crown edge 142 is positioned adjacent an upper edge of the club head body 100, while the sole edge 146 is positioned adjacent a lower edge of the club head body 100. The face cup crown edge 142 and sole edge 146 are configured to abut the lip 126 of the aperture 122. Alternate embodiments can include a version of the face cup 114 comprising a sole return 150 while lacking a crown return 148, or comprising a crown return 148 while lacking a sole return 150. Further embodiments can include a version of the face cup 114 comprising only a portion of the sole return (not extending along the entire width of the sole in a heel to toe direction), and/or only a portion of the crown return (not extending along the entire width of the crown in a heel to toe direction).

The BE α-β Ti alloy described herein can be made to have many different composition combinations, all comprising a greater p stabilizer amounts than most conventional α-β Ti alloys, particularly those commonly used in the golf industry, such as Ti-9S. Three specific compositions, described below, create three different embodiments of BE α-β Ti alloys having the properties and characteristics discussed above.

BE α-β Ti alloy—Composition 1

In one embodiment, the BE α-β Ti alloy (hereafter referred to as "TSG1") may have a total weight percent of α-stabilizer aluminum between 5.0 wt % to 7.0 wt %, a total weight percent of α-stabilizer oxygen less than or equal to 0.15 wt %, a total weight percent of β-stabilizer molybdenum between 0.75 wt % and 1.75 wt %, a total weight percent of β-stabilizer vanadium between 1.5 wt % and 3.5 wt %, a total weight percent of β-stabilizer silicon between 0.0 wt % and 0.2 wt %, and a total weight percent of β-stabilizer iron between 0.2 wt % and 0.3 wt %. TSG1 may undergo a series of mechanical manufacturing steps to achieve the desired shape as described above. During the mechanical manufacturing process, TSG1 is heated to a predetermined temperature 470 between 850° C. and 950° C. prior to the cross-rolling step. In some embodiments, the predetermined temperature 470 can be between 850° C. and 860° C., 860° C. and 870° C., 870° C. and 880° C., 880° C. and 890° C., 890° C. and 900° C., 900° C. and 910° C., 910° C. and 920° C., 920° C. and 930° C., 930° C. and 940° C., or 940° C. and 950° C. In some embodiments, the predetermined temperature 470 can be 895° C., 896° C., 897° C., 898° C., 899° C., 900° C., 901° C., 902° C., 903° C., 904° C., or 905° C. In one example, TSG1 is heated to a predetermined temperature 470 of 900° C. prior to the cross-rolling step.

TSG1, once in its final state, may undergo a two-step heat treatment. In embodiments wherein TSG1 is formed into a golf club head faceplate 14, these heat treatment steps are applied to the golf club head assembly 30, following welding the faceplate 14 to the golf club head body 10. While the heat treatment embodiments detailed below refer to the golf club head assembly 30 receiving the described treatment, any product in a final state of shaping can receive the heat treatment as described.

The first step is a solution annealing process that involves heating the club head assembly 30 to a predetermined temperature, near the solvus temperature 468, between 800° C. and 950° C. for approximately 1 hour. In some embodiments, the heat treatment first step predetermined temperature can be between 800° C. and 810° C., 810° C. and 820° C., 820° C. and 830° C., 830° C. and 840° C., 840° C. and 850° C., 850° C. and 860° C., 860° C. and 870° C., 870° C. and 880° C., 880° C. and 890° C., 890° C. and 900° C., 900° C. and 910° C., 910° C. and 920° C., 920° C. and 930° C., 930° C. and 940° C., or 940° C. and 950° C. In some embodiments, the heat treatment first step predetermined temperature can be 895° C., 896° C., 897° C., 898° C., 899° C., 900° C., 901° C., 902° C., 903° C., 904° C., or 905° C. In one example, the predetermined temperature in the first step of the heat treatment process can be approximately 900° C. The club head assembly 30 is then quenched in an inert gas pressurized environment. In some embodiments the pressure can be 1 Bar, 2 Bar, 3 Bar, 4 Bar, 5 Bar, 6 Bar, 7 Bar, 8 Bar, 9 Bar, 10 Bar, 10 Bar, 11 Bar, 12 Bar, 13 Bar, 14 Bar, 15 Bar, 16 Bar, 17 Bar, 18 Bar, 19 Bar, or 20 Bar. In one example the pressure in the pressurized environment is 5 Bar. The heat treatment second step is an aging process that involves heating the club head assembly 30 to a temperature between 500° C. and 640° C. for between 1 and 10 hours. In some embodiments, the heat treatment second step temperature can be between 500° C. and 510° C., 510° C. and 520° C., 520° C. and 530° C., 530° C. and 540° C., 540° C. and 550° C., 550° C. and 560° C., 560° C. and 570° C., 570° C. and 580° C., 580° C. and 590° C., 590° C. and 600° C., 600° C. and 610° C., 610° C. and 620° C., 620° C. and 630° C., or 630° C. and 640° C. In some embodiments, the heat treatment second step can be performed for 1 hour, 2 hours, 3 hours, 4 hours, 5 hours, 6 hours, 7 hours, 8 hours, 9 hours, or 10 hours. In one example, the predetermined temperature in the first step of the heat treatment process can be approximately 590° C. for approximately 4 hours. The club head assembly 30 is then allowed to cool to room temperature via air cooling. In some embodiments, the club head assembly 30 is briefly jet cooled with an inert gas prior to air cooling in order to expedite the cooling process.

In one embodiment TSG1 may have a total weight percent of α-stabilizer aluminum between 5.0 wt % to 7.0 wt %, a total weight percent of α-stabilizer oxygen less than or equal to 0.15 wt %, a total weight percent of β-stabilizer molybdenum between 0.75 wt % and 1.75 wt %, a total weight percent of β-stabilizer vanadium between 1.5 wt % and 3.5 wt %, a total weight percent of β-stabilizer silicon between 0.0 wt % and 0.2 wt %, and a total weight percent of β-stabilizer iron between 0.2 wt % and 0.3 wt %. TSG1 may undergo a series of mechanical manufacturing steps to achieve the desired shape as described above. During the mechanical manufacturing process, TSG1 is heated to a predetermined temperature between 850° C. and 950° C. prior to the cross-rolling step. In some embodiments, the predetermined temperature can be between 850° C. and 860° C., 860° C. and 870° C., 870° C. and 880° C., 880° C. and 890° C., 890° C. and 900° C., 900° C. and 910° C., 910° C. and 920° C., 920° C. and 930° C., 930° C. and 940° C., or 940° C. and 950° C. In some embodiments, the predetermined temperature can be 895° C., 896° C., 897° C., 898° C., 899° C., 900° C., 901° C., 902° C., 903° C., 904° C., or 905° C. In one example, BE α-β Ti alloy TSG1 is heated to a predetermined temperature of 900° C. prior to the cross-rolling step.

After the faceplate 14 is formed and welded to the club head, the club head assembly may undergo a two-step heat treatment, wherein the first step is a solution annealing process that involves heating the club head assembly 30 to a predetermined temperature 470, near the solvus temperature 468, between 850° C. and 950° C. for approximately 1 hour. In some embodiments, the heat treatment first step predetermined temperature can be between 850° C. and 860° C., 860° C. and 870° C., 870° C. and 880° C., 880° C. and 890° C., 890° C. and 900° C., 900° C. and 910° C., 910° C. and 920° C., 920° C. and 930° C., 930° C. and 940° C., or 940° C. and 950° C. In some embodiments, the heat treatment first step 470 can be 895° C., 896° C., 897° C., 898° C., 899° C., 900° C., 901° C., 902° C., 903° C., 904° C., or 905° C. In one example, the predetermined temperature 470 in the first step of the heat treatment process can be approximately 900° C. The club head assembly 30 is then quenched in an inert gas pressurized environment. In some embodiments the pressure can be 1 Bar, 2 Bar, 3 Bar, 4 Bar, 5 Bar, 6 Bar, 7 Bar, 8 Bar, 9 Bar, 10 Bar, 10 Bar, 11 Bar, 12 Bar, 13 Bar, 14 Bar, 15 Bar, 16 Bar, 17 Bar, 18 Bar, 19 Bar, or 20 Bar. In one example the pressure in the pressurized environment is 1 Bar. The heat treatment second step is an aging process that involves heating the club head assembly 30 to a temperature between 570° C. and 640° C. for approximately 8 hours. In some embodiments, the heat treatment second step temperature can be between 570° C. and 580° C., 580° C. and 590° C., 590° C. and 600° C., 600° C. and 610° C., 610° C. and 620° C., 620° C. and 630° C., or 630° C. and 640° C. In one example, the predetermined temperature 470 in the first step of the heat treatment process can be approximately 590° C. The club head assembly is then allowed to cool to room temperature via air cooling. In some embodiments, the club head assembly 30 is briefly jet cooled with an inert gas prior to air cooling in order to expedite the cooling process.

In one embodiment TSG1 may have a total weight percent of α-stabilizer aluminum between 5.0 wt % to 7.0 wt %, a total weight percent of α-stabilizer oxygen less than or equal to 0.15 wt %, a total weight percent of β-stabilizer molybdenum between 0.75 wt % and 1.75 wt %, a total weight percent of β-stabilizer vanadium between 1.5 wt % and 3.5 wt %, a total weight percent of β-stabilizer silicon between 0.0 wt % and 0.2 wt %, and a total weight percent of β-stabilizer iron between 0.2 wt % and 0.3 wt %. TSG1 may undergo a series of mechanical manufacturing steps to achieve the desired shape as described above. During the mechanical manufacturing process, TSG1 is heated to a predetermined temperature 470 between 850° C. and 950° C. prior to the cross-rolling step. In some embodiments, the predetermined temperature 470 can be between 850° C. and 860° C., 860° C. and 870° C., 870° C. and 880° C., 880° C. and 890° C., 890° C. and 900° C., 900° C. and 910° C., 910° C. and 920° C., 920° C. and 930° C., 930° C. and 940° C., or 940° C. and 950° C. In some embodiments, the predetermined temperature 470 can be 895° C., 896° C., 897° C., 898° C., 899° C., 900° C., 901° C., 902° C., 903° C., 904° C., or 905° C. In one example, BE α-β Ti alloy TSG1 is heated to a predetermined temperature 470 of 900° C. prior to the cross-rolling step.

After the faceplate 14 is formed and welded to the club head, the club head assembly may undergo a two-step heat treatment, wherein the first step is a solution annealing process that involves heating the club head assembly 30 to a predetermined temperature 470, near the solvus temperature 468, between 850° C. and 950° C. for approximately 1 hour. In some embodiments, the heat treatment first step predetermined temperature 470 can be between 850° C. and 860° C., 860° C. and 870° C., 870° C. and 880° C., 880° C. and 890° C., 890° C. and 900° C., 900° C. and 910° C., 910° C. and 920° C., 920° C. and 930° C., 930° C. and 940° C., or 940° C. and 950° C. In some embodiments, the heat treatment first step predetermined temperature 470 can be 895° C., 896° C., 897° C., 898° C., 899° C., 900° C., 901° C., 902° C., 903° C., 904° C., or 905° C. In one example, the predetermined temperature 470 in the first step of the heat treatment process can be approximately 900° C. The club head assembly 30 is then quenched in an inert gas pressurized environment. In some embodiments the pressure can be 1 Bar, 2 Bar, 3 Bar, 4 Bar, 5 Bar, 6 Bar, 7 Bar, 8 Bar, 9 Bar, 10 Bar, 10 Bar, 11 Bar, 12 Bar, 13 Bar, 14 Bar, 15 Bar, 16 Bar, 17 Bar, 18 Bar, 19 Bar, or 20 Bar. In one example the pressure in the pressurized environment is 1 Bar. The heat treatment second step is an aging process that involves heating the club head assembly 30 to a temperature between 590° C. and 650° C. for approximately 4 hours. In some embodiments, the heat treatment second step temperature can be between 590° C. and 600° C., 600° C. and 610° C., 610° C. and 620° C., 620° C. and 630° C., 630° C. and 640° C., 640° C. and 650° C. In one example, the predetermined temperature 470 in the first step of the heat treatment process can be approximately 620° C. The club head assembly is then allowed to cool to room temperature via air cooling. In some embodiments, the club head assembly 30 is briefly jet cooled with an inert gas prior to air cooling in order to expedite the cooling process.

In one embodiment, TSG1 may have a total weight percent of α-stabilizer aluminum between 5.0 wt % to 7.0 wt %, a total weight percent of α-stabilizer oxygen less than or equal to 0.15 wt %, a total weight percent of β-stabilizer molybdenum between 0.75 wt % and 1.75 wt %, a total weight percent of β-stabilizer vanadium between 1.5 wt % and 3.5 wt %, a total weight percent of β-stabilizer silicon between 0.1 wt % and 0.2 wt %, and a total weight percent of β-stabilizer iron between 0.2 wt % and 0.3 wt %. TSG1 may undergo a series of mechanical manufacturing steps to achieve the desired shape as described above. During the mechanical manufacturing process, TSG1 is heated to a predetermined temperature 470 between 880° C. and 980° C. prior to the cross-rolling step. In some embodiments, the predetermined temperature 470 can be between 880° C. and 890° C., 890° C. and 900° C., 900° C. and 910° C., 910° C. and 920° C., 920° C. and 930° C., 930° C. and 940° C., 940° C. and 950° C., 950° C. and 960° C., 960° C. and 970° C., or 970° C. and 980° C. In some embodiments, the predetermined temperature 470 can be 925° C., 926° C., 927° C., 928° C., 929° C., 930° C., 931° C., 932° C., 933° C., 934° C., or 935° C. In one example, TSG1 is heated to a predetermined temperature 470 of 930° C. prior to the cross-rolling step.

After the faceplate 14 is formed and welded to the club head, the club head assembly may undergo a two-step heat treatment, wherein the first step is a solution annealing process that involves heating the club head assembly 30 to a predetermined temperature 470, near the solvus temperature 468, between 850° C. and 950° C. for approximately 1 hour. In some embodiments, the heat treatment first step predetermined temperature 470 can be between 850° C. and 860° C., 860° C. and 870° C., 870° C. and 880° C., 880° C. and 890° C., 890° C. and 900° C., 900° C. and 910° C., 910° C. and 920° C., 920° C. and 930° C., 930° C. and 940° C., or 940° C. and 950° C. In some embodiments, the heat treatment first step predetermined temperature 470 can be 895° C., 896° C., 897° C., 898° C., 899° C., 900° C., 901° C., 902° C., 903° C., 904° C., or 905° C. In one example, the predetermined temperature 470 in the first step of the heat treatment process can be approximately 900° C. The club head assembly 30 is then quenched in an inert gas pressurized environment. In some embodiments the pressure can be 1 Bar, 2 Bar, 3 Bar, 4 Bar, 5 Bar, 6 Bar, 7 Bar, 8 Bar, 9 Bar, 10 Bar, 10 Bar, 11 Bar, 12 Bar, 13 Bar, 14 Bar, 15 Bar, 16 Bar, 17 Bar, 18 Bar, 19 Bar, or 20 Bar. In one example the pressure in the pressurized environment is 5 Bar. The heat treatment second step is an aging process that involves heating the club head assembly 30 to a temperature between 570° C. and 640° C. for approximately 4 hours. In some embodiments, the heat treatment second step temperature can be between 570° C. and 580° C., 580° C. and 590° C., 590° C. and 600° C., 600° C. and 610° C., 610° C. and 620° C., 620° C. and 630° C., or 630° C. and 640° C. In one example, the predetermined temperature 470 in the first step of the heat treatment process can be approximately 590° C. The club head assembly is then allowed to cool to room temperature via air cooling. In some embodiments, the club head assembly 30 is briefly jet cooled with an inert gas prior to air cooling in order to expedite the cooling process.

In one embodiment TSG1 may have a total weight percent of α-stabilizer aluminum between 5.0 wt % to 7.0 wt %, a total weight percent of α-stabilizer oxygen less than or equal to 0.15 wt %, a total weight percent of β-stabilizer molybdenum between 0.75 wt % and 1.75 wt %, a total weight percent of β-stabilizer vanadium between 1.5 wt % and 3.5 wt %, a total weight percent of β-stabilizer silicon between 0.1 wt % and 0.2 wt %, and a total weight percent of β-stabilizer iron between 0.2 wt % and 0.3 wt %. BE α-β Ti alloy TSG1 may undergo a series of mechanical manufacturing steps to achieve the desired shape as described above. During the mechanical manufacturing process, TSG1 is heated to a predetermined temperature 470 between 880° C. and 980° C. prior to the cross-rolling step. In some embodiments, the predetermined temperature 470 can be between 880° C. and 890° C., 890° C. and 900° C., 900° C. and 910° C., 910° C. and 920° C., 920° C. and 930° C., 930° C. and 940° C., 940° C. and 950° C., 950° C. and 960° C., 960° C. and 970° C., or 970° C. and 980° C. In some embodiments, the predetermined temperature 470 can be 925° C., 926° C., 927° C., 928° C., 929° C., 930° C., 931° C., 932° C., 933° C., 934° C., or 935° C. In one example, TSG1 is heated to a predetermined temperature 470 of 930° C. prior to the cross-rolling step.

After the faceplate 14 is formed and welded to the club head, the club head assembly may undergo a two-step heat treatment, wherein the first step is a solution annealing process that involves heating the club head assembly 30 to a predetermined temperature 470, near the solvus temperature 468, between 850° C. and 950° C. for approximately 1 hour. In some embodiments, the heat treatment first step predetermined temperature 470 can be between 850° C. and 860° C., 860° C. and 870° C., 870° C. and 880° C., 880° C. and 890° C., 890° C. and 900° C., 900° C. and 910° C., 910° C. and 920° C., 920° C. and 930° C., 930° C. and 940° C., or 940° C. and 950° C. In some embodiments, the heat treatment first step predetermined temperature 470 can be 895° C., 896° C., 897° C., 898° C., 899° C., 900° C., 901° C., 902° C., 903° C., 904° C., or 905° C. In one example, the predetermined temperature 470 in the first step of the heat treatment process can be approximately 900° C. The club head assembly 30 is then quenched in an inert gas pressurized environment. In some embodiments the pressure can be 1 Bar, 2 Bar, 3 Bar, 4 Bar, 5 Bar, 6 Bar, 7 Bar, 8 Bar, 9 Bar, 10 Bar, 10 Bar, 11 Bar, 12 Bar, 13 Bar, 14 Bar, 15 Bar, 16 Bar, 17 Bar, 18 Bar, 19 Bar, or 20 Bar. In one example the pressure in the pressurized environment is 1 Bar. The heat treatment second step is an aging process that involves heating the club head assembly 30 to a temperature between 570° C. and 640° C. for approximately 8 hours. In some embodiments, the heat treatment second step temperature can be between 570° C. and 580° C., 580° C. and 590° C., 590° C. and 600° C., 600° C. and 610° C., 610° C. and 620° C., 620° C. and 630° C., or 630° C. and 640° C. In one example, the predetermined temperature in the first step of the heat treatment process can be approximately 590° C. The club head assembly is then allowed to cool to room temperature via air cooling. In some embodiments, the club head assembly 30 is briefly jet cooled with an inert gas prior to air cooling in order to expedite the cooling process.

In one embodiment TSG1 may have a total weight percent of α-stabilizer aluminum between 5.0 wt % to 7.0 wt %, a total weight percent of α-stabilizer oxygen less than or equal to 0.15 wt %, a total weight percent of β-stabilizer molybdenum between 0.75 wt % and 1.75 wt %, a total weight percent of β-stabilizer vanadium between 1.5 wt % and 3.5 wt %, a total weight percent of β-stabilizer silicon between 0.0 wt % and 0.2 wt %, and a total weight percent of β-stabilizer iron between 0.2 wt % and 0.3 wt %. TSG1 may undergo a series of mechanical manufacturing steps to achieve the desired shape as described above. During the mechanical manufacturing process, TSG1 is heated to a predetermined temperature 470 between 880° C. and 980° C. prior to the cross-rolling step. In some embodiments, the predetermined temperature 470 can be between 880° C. and 890° C., 890° C. and 900° C., 900° C. and 910° C., 910° C. and 920° C., 920° C. and 930° C., 930° C. and 940° C., 940° C. and 950° C., 950° C. and 960° C., 960° C. and 970° C., or 970° C. and 980° C. In some embodiments, the predetermined temperature 470 can be 925° C., 926° C., 927° C., 928° C., 929° C., 930° C., 931° C., 932° C., 933° C., 934° C., or 935° C. In one example, TSG1 is heated to a predetermined temperature 470 of 930° C. prior to the cross-rolling step.

After the faceplate 14 is formed and welded to the club head, the club head assembly may undergo a two-step heat treatment, wherein the first step is a solution annealing process that involves heating the club head assembly 30 to a predetermined temperature 470, near the solvus temperature 468, between 850° C. and 950° C. for approximately 1 hour. In some embodiments, the heat treatment first step predetermined temperature 470 can be between 850° C. and 860° C., 860° C. and 870° C., 870° C. and 880° C., 880° C. and 890° C., 890° C. and 900° C., 900° C. and 910° C., 910° C. and 920° C., 920° C. and 930° C., 930° C. and 940° C., or 940° C. and 950° C. In some embodiments, the heat treatment first step predetermined temperature 470 can be 895° C., 896° C., 897° C., 898° C., 899° C., 900° C., 901° C., 902° C., 903° C., 904° C., or 905° C. In one example, the predetermined temperature 470 in the first step of the heat treatment process can be approximately 900° C. The club head assembly 30 is then quenched in an inert gas pressurized environment. In some embodiments the pressure can be 1 Bar, 2 Bar, 3 Bar, 4 Bar, 5 Bar, 6 Bar, 7 Bar, 8 Bar, 9 Bar, 10 Bar, 10 Bar, 11 Bar, 12 Bar, 13 Bar, 14 Bar, 15 Bar, 16 Bar, 17 Bar, 18 Bar, 19 Bar, or 20 Bar. In one example the pressure in the pressurized environment is 1 Bar. The heat treatment second step is an aging process that involves heating the club head assembly 30 to a temperature between 590° C. and 650° C. for approximately 4 hours. In some embodiments, the heat treatment second step temperature can be between 590° C. and 600° C., 600° C. and 610° C., 610° C. and 620° C., 620° C. and 630° C., 630° C. and 640° C., 640° C. and 650° C. In one example, the predetermined temperature in the first step of the heat treatment process can be approximately 620° C. The club head assembly is then allowed to cool to room temperature via air cooling. In some embodiments, the club head assembly 30 is briefly jet cooled with an inert gas prior to air cooling in order to expedite the cooling process.

In one embodiment TSG1 may have a total weight percent of α-stabilizer aluminum between 5.0 wt % to 7.0 wt %, a total weight percent of α-stabilizer oxygen less than or equal to 0.15 wt %, a total weight percent of β-stabilizer molybdenum between 0.75 wt % and 1.75 wt %, a total weight percent of β-stabilizer vanadium between 1.5 wt % and 3.5 wt %, a total weight percent of β-stabilizer silicon between 0.0 wt % and 0.2 wt %, and a total weight percent of β-stabilizer iron between 0.2 wt % and 0.3 wt %. TSG1 may undergo a series of mechanical manufacturing steps to achieve the desired shape as described above. During the mechanical manufacturing process, TSG1 is heated to a predetermined temperature 470 between 900° C. and 1000° C. prior to the cross-rolling step. In some embodiments, the predetermined temperature 470 can be between 900° C. and 910° C., 910° C. and 920° C., 920° C. and 930° C., 930° C. and 940° C., 940° C. and 950° C., 950° C. and 960° C., 960° C. and 970° C., 970° C. and 980° C., 980° C. and 990° C., or 990° C. and 1000° C. In some embodiments, the predetermined temperature 470 can be 945° C., 946° C., 947° C., 948° C., 949° C., 950° C., 951° C., 952° C., 953° C., 954° C., or 955° C. In one example, TSG1 is heated to a predetermined temperature 470 of 950° C. prior to the cross-rolling step.

After the faceplate 14 is formed and welded to the club head, the club head assembly may undergo a two-step heat treatment, wherein the first step is a solution annealing process that involves heating the club head assembly 30 to a predetermined temperature 470, near the solvus temperature 468, between 850° C. and 950° C. for approximately 1 hour. In some embodiments, the heat treatment first step predetermined temperature 470 can be between 850° C. and 860° C., 860° C. and 870° C., 870° C. and 880° C., 880° C. and 890° C., 890° C. and 900° C., 900° C. and 910° C., 910° C. and 920° C., 920° C. and 930° C., 930° C. and 940° C., or 940° C. and 950° C. In some embodiments, the heat treatment first step predetermined temperature 470 can be 895° C., 896° C., 897° C., 898° C., 899° C., 900° C., 901° C., 902° C., 903° C., 904° C., or 905° C. In one example, the predetermined temperature 470 in the first step of the heat treatment process can be approximately 900° C. The club head assembly 30 is then quenched in an inert gas pressurized environment. In some embodiments the pressure can be 1 Bar, 2 Bar, 3 Bar, 4 Bar, 5 Bar, 6 Bar, 7 Bar, 8 Bar, 9 Bar, 10 Bar, 10 Bar, 11 Bar, 12 Bar, 13 Bar, 14 Bar, 15 Bar, 16 Bar, 17 Bar, 18 Bar, 19 Bar, or 20 Bar. In one example the pressure in the pressurized environment is 5 Bar. The heat treatment second step is an aging process that involves heating the club head assembly 30 to a temperature between 570° C. and 640° C. for approximately 4 hours. In some embodiments, the heat treatment second step temperature can be between 570° C. and 580° C., 580° C. and 590° C., 590° C. and 600° C., 600° C. and 610° C., 610° C. and 620° C., 620° C. and 630° C., or 630° C. and 640° C. In one example, the predetermined temperature in the first step of the heat treatment process can be approximately 590° C. The club head assembly is then allowed to cool to room temperature via air cooling. In some embodiments, the club head assembly 30 is briefly jet cooled with an inert gas prior to air cooling in order to expedite the cooling process.

In one embodiment TSG1 may have a total weight percent of α-stabilizer aluminum between 5.0 wt % to 7.0 wt %, a total weight percent of α-stabilizer oxygen less than or equal to 0.15 wt %, a total weight percent of β-stabilizer molybdenum between 0.75 wt % and 1.75 wt %, a total weight percent of β-stabilizer vanadium between 1.5 wt % and 3.5 wt %, a total weight percent of β-stabilizer silicon between 0.0 wt % and 0.2 wt %, and a total weight percent of β-stabilizer iron between 0.2 wt % and 0.3 wt %. TSG1 may undergo a series of mechanical manufacturing steps to achieve the desired shape as described above. During the mechanical manufacturing process, TSG1 is heated to a predetermined temperature 470 between 900° C. and 1000° C. prior to the cross-rolling step. In some embodiments, the predetermined temperature 470 can be between 900° C. and 910° C., 910° C. and 920° C., 920° C. and 930° C., 930° C. and 940° C., 940° C. and 950° C., 950° C. and 960° C., 960° C. and 970° C., 970° C. and 980° C., 980° C. and 990° C., or 990° C. and 1000° C. In some embodiments, the predetermined temperature 470 can be 945° C., 946° C., 947° C., 948° C., 949° C., 950° C., 951° C., 952° C., 953° C., 954° C., or 955° C. In one example, the TSG1 is heated to a predetermined temperature 470 of 950° C. prior to the cross-rolling step.

After the faceplate 14 is formed and welded to the club head, the club head assembly may undergo a two-step heat treatment, wherein the first step is a solution annealing process that involves heating the club head assembly 30 to a predetermined temperature 470, near the solvus temperature 468, between 850° C. and 950° C. for approximately 1 hour. In some embodiments, the heat treatment first step predetermined temperature 470 can be between 850° C. and 860° C., 860° C. and 870° C., 870° C. and 880° C., 880° C. and 890° C., 890° C. and 900° C., 900° C. and 910° C., 910° C. and 920° C., 920° C. and 930° C., 930° C. and 940° C., or 940° C. and 950° C. In some embodiments, the heat treatment first step predetermined temperature 470 can be 895° C., 896° C., 897° C., 898° C., 899° C., 900° C., 901° C., 902° C., 903° C., 904° C., or 905° C. In one example, the predetermined temperature 470 in the first step of the heat treatment process can be approximately 900° C. The club head assembly 30 is then quenched in an inert gas pressurized environment. In some embodiments the pressure can be 1 Bar, 2 Bar, 3 Bar, 4 Bar, 5 Bar, 6 Bar, 7 Bar, 8 Bar, 9 Bar, 10 Bar, 10 Bar, 11 Bar, 12 Bar, 13 Bar, 14 Bar, 15 Bar, 16 Bar, 17 Bar, 18 Bar, 19 Bar, or 20 Bar. In one example the pressure in the pressurized environment is 1 Bar. The heat treatment second step is an aging process that involves heating the club head assembly 30 to a temperature between 570° C. and 640° C. for approximately 8 hours. In some embodiments, the heat treatment second step temperature can be between 570° C. and 580° C., 580° C. and 590° C., 590° C. and 600° C., 600° C. and 610° C., 610° C. and 620° C., 620° C. and 630° C., or 630° C. and 640° C. In one example, the predetermined temperature in the first step of the heat treatment process can be approximately 590° C. The club head assembly is then allowed to cool to room temperature via air cooling. In some embodiments, the club head assembly 30 is briefly jet cooled with an inert gas prior to air cooling in order to expedite the cooling process.

In one embodiment the TSG1 may have a total weight percent of α-stabilizer aluminum between 5.0 wt % to 7.0 wt %, a total weight percent of α-stabilizer oxygen less than or equal to 0.15 wt %, a total weight percent of β-stabilizer molybdenum between 0.75 wt % and 1.75 wt %, a total weight percent of β-stabilizer vanadium between 1.5 wt % and 3.5 wt %, a total weight percent of β-stabilizer silicon between 0.0 wt % and 0.2 wt %, and a total weight percent of β-stabilizer iron between 0.2 wt % and 0.3 wt %. TSG1 may undergo a series of mechanical manufacturing steps to achieve the desired shape as described above. During the mechanical manufacturing process, TSG1 is heated to a predetermined temperature 470 between 900° C. and 1000° C. prior to the cross-rolling step. In some embodiments, the predetermined temperature 470 can be between 900° C. and 910° C., 910° C. and 920° C., 920° C. and 930° C., 930° C. and 940° C., 940° C. and 950° C., 950° C. and 960° C., 960° C. and 970° C., 970° C. and 980° C., 980° C. and 990° C., or 990° C. and 1000° C. In some embodiments, the predetermined temperature 470 can be 945° C., 946° C., 947° C., 948° C., 949° C., 950° C., 951° C., 952° C., 953° C., 954° C., or 955° C. In one example, TSG1 is heated to a predetermined temperature 470 of 950° C. prior to the cross-rolling step.

After the faceplate 14 is formed and welded to the club head, the club head assembly may undergo a two-step heat treatment, wherein the first step is a solution annealing process that involves heating the club head assembly 30 to a predetermined temperature 470, near the solvus temperature 468, between 850° C. and 950° C. for approximately 1 hour. In some embodiments, the heat treatment first step predetermined temperature 470 can be between 850° C. and 860° C., 860° C. and 870° C., 870° C. and 880° C., 880° C. and 890° C., 890° C. and 900° C., 900° C. and 910° C., 910° C. and 920° C., 920° C. and 930° C., 930° C. and 940° C., or 940° C. and 950° C. In some embodiments, the heat treatment first step predetermined temperature 470 can be 895° C., 896° C., 897° C., 898° C., 899° C., 900° C., 901° C., 902° C., 903° C., 904° C., or 905° C. In one example, the predetermined temperature 470 in the first step of the heat treatment process can be approximately 900° C. The club head assembly 30 is then quenched in an inert gas pressurized environment. In some embodiments the pressure can be 1 Bar, 2 Bar, 3 Bar, 4 Bar, 5 Bar, 6 Bar, 7 Bar, 8 Bar, 9 Bar, 10 Bar, 10 Bar, 11 Bar, 12 Bar, 13 Bar, 14 Bar, 15 Bar, 16 Bar, 17 Bar, 18 Bar, 19 Bar, or 20 Bar. In one example the pressure in the pressurized environment is 1 Bar. The heat treatment second step is an aging process that involves heating the club head assembly 30 to a temperature between 590° C. and 650° C. for approximately 4 hours. In some embodiments, the heat treatment second step temperature can be between 590° C. and 600° C., 600° C. and 610° C., 610° C. and 620° C., 620° C. and 630° C., 630° C. and 640° C., 640° C. and 650° C. In one example, the predetermined temperature in the first step of the heat treatment process can be approximately 620° C. The club head assembly is then allowed to cool to room temperature via air cooling. In some embodiments, the club head assembly 30 is briefly jet cooled with an inert gas prior to air cooling in order to expedite the cooling process.

TSG1 is expected to display improved durability properties than an α enhanced Ti alloy, such as Ti-9S. In a durability analysis, a golf club head assembly 30 including a faceplate 14 composed of TSG1 is expected to require up to 3800 strikes in an air cannon before failure. When the minimum and maximum face thickness are reduced by up to 25%, the golf club head assembly 30 comprising the TSG1 faceplate 14 is expected to require between 3300 strikes and 3600 strike in an air cannon before failure.

BE α-β Ti alloy—Composition 2

In one embodiment the BE α-β Ti alloy (hereafter referred to as "TSG2") may have a total weight percent of α-stabilizer aluminum between 6.0 wt % to 8.0 wt %, a total weight percent of α-stabilizer oxygen less than or equal to 0.15 wt %, a total weight percent of β-stabilizer molybdenum between 1.5 wt % and 2.5 wt %, a total weight percent of β-stabilizer vanadium between 3.5 wt % and 3.5 wt %, a total weight percent of β-stabilizer silicon between 0.1 wt % and 0.2 wt %, and a total weight percent of β-stabilizer iron between 0.5 wt % and 1.0 wt %. TSG2 may undergo a series of mechanical manufacturing steps to achieve the desired shape as described above. During the mechanical manufacturing process, TSG2 is heated to a predetermined temperature 470 between 850° C. and 950° C. prior to the cross-rolling step. In some embodiments, the heat treatment first step predetermined temperature 470 can be 895° C., 896° C., 897° C., 898° C., 899° C., 900° C., 901° C., 902° C., 903° C., 904° C., or 905° C. In some embodiments, the predetermined temperature 470 can be between 850° C. and 860° C., 860° C. and 870° C., 870° C. and 880° C., 880° C. and 890° C., 890° C. and 900° C., 900° C. and 910° C., 910° C. and 920° C., 920° C. and 930° C., 930° C. and 940° C., or 940° C. and 950° C. In some embodiments, the predetermined temperature 470 can be 895° C., 896° C., 897° C., 898° C., 899° C., 900° C., 901° C., 902° C., 903° C., 904° C., or 905° C. In one example, TSG2 is heated to a predetermined temperature 470 of 900° C. prior to the cross-rolling step.

TSG2 material, once in its final state, may undergo a two-step heat treatment. In embodiments wherein TSG2 is formed into a golf club head faceplate 14, these heat treatment steps are applied to the golf club head assembly 30, following welding the faceplate 14 to the golf club head body 10. While the heat treatment embodiments detailed below refer to the golf club head assembly 30 receiving the described treatment, any product in a final state of shaping can receive the heat treatment as described.

After the faceplate 14 is formed and welded to the club head, the club head assembly may undergo a two-step heat treatment, wherein the first step is a solution annealing process that involves heating the club head assembly 30 to a predetermined temperature 470, near the solvus temperature 468, between 850° C. and 950° C. for approximately 1 hour. In some embodiments, the heat treatment first step predetermined temperature 470 can be between 850° C. and 860° C., 860° C. and 870° C., 870° C. and 880° C., 880° C. and 890° C., 890° C. and 900° C., 900° C. and 910° C., 910° C. and 920° C., 920° C. and 930° C., 930° C. and 940° C., or 940° C. and 950° C. In some embodiments, the heat treatment first step predetermined temperature 470 can be 895° C., 896° C., 897° C., 898° C., 899° C., 900° C., 901° C., 902° C., 903° C., 904° C., or 905° C. In one example, the predetermined temperature 470 in the first step of the heat treatment process can be approximately 900° C. The club head assembly 30 is then quenched in an inert gas pressurized environment. In some embodiments the pressure can be 1 Bar, 2 Bar, 3 Bar, 4 Bar, 5 Bar, 6 Bar, 7 Bar, 8 Bar, 9 Bar, 10 Bar, 10 Bar, 11 Bar, 12 Bar, 13 Bar, 14 Bar, 15 Bar, 16 Bar, 17 Bar, 18 Bar, 19 Bar, or 20 Bar. In one example the pressure in the pressurized environment is 5 Bar. The heat treatment second step is an aging process that involves heating the club head assembly 30 to a temperature between 570° C. and 640° C. for approximately 4 hours. In some embodiments, the heat treatment second step temperature can be between 570° C. and 580° C., 580° C. and 590° C., 590° C. and 600° C., 600° C. and 610° C., 610° C. and 620° C., 620° C. and 630° C., or 630° C. and 640° C. In one example, the predetermined temperature in the first step of the heat treatment process can be approximately 590° C. The club head assembly is then allowed to cool to room temperature via air cooling. In some embodiments, the club head assembly 30 is briefly jet cooled with an inert gas prior to air cooling in order to expedite the cooling process.

In one embodiment TSG2 may have a total weight percent of α-stabilizer aluminum between 6.0 wt % to 8.0 wt %, a total weight percent of α-stabilizer oxygen less than or equal to 0.15 wt %, a total weight percent of β-stabilizer molybdenum between 1.5 wt % and 2.5 wt %, a total weight percent of β-stabilizer vanadium between 3.5 w-t % and 3.5 wt %, a total weight percent of β-stabilizer silicon between 0.0 wt % and 0.2 wt %, and a total weight percent of β-stabilizer iron between 0.5 wt % and 1.0 wt %. In one example, TSG2 may have a total weight percent of α-stabilizer aluminum of 7.73 wt %, a total weight percent of α-stabilizer oxygen less than or equal to 0.15 wt %, a total weight percent of β-stabilizer molybdenum of 3.09 wt %, a total weight percent of β-stabilizer vanadium of 4.63 wt %, a total weight percent of β-stabilizer silicon of 0.12 wt %, and a total weight percent of β-stabilizer iron of 0.53 wt %. In another example, TSG2 may have a total weight percent of α-stabilizer aluminum of 7.00 wt %, a total weight percent of α-stabilizer oxygen less than or equal to 0.15 wt %, a total weight percent of β-stabilizer molybdenum of 1.50 wt %, a total weight percent of β-stabilizer vanadium of 4.50 wt %, a total weight percent of β-stabilizer silicon of 0.15 wt %, and a total weight percent of β-stabilizer iron of 0.70 wt %. TSG2 may undergo a series of mechanical manufacturing steps to achieve the desired shape as described above. During the mechanical manufacturing process, TSG2 is heated to a predetermined temperature 470 between 850° C. and 950° C. prior to the cross-rolling step. In some embodiments, the predetermined temperature 470 can be between 850° C. and 860° C., 860° C. and 870° C., 870° C. and 880° C., 880° C. and 890° C., 890° C. and 900° C., 900° C. and 910° C., 910° C. and 920° C., 920° C. and 930° C., 930° C. and 940° C., or 940° C. and 950° C. In some embodiments, the predetermined temperature 470 can be 895° C., 896° C., 897° C., 898° C., 899° C., 900° C., 901° C., 902° C., 903° C., 904° C., or 905° C. In one example, TSG2 is heated to a predetermined temperature 470 of 900° C. prior to the cross-rolling step.

After the faceplate 14 is formed and welded to the club head, the club head assembly may undergo a two-step heat treatment, wherein the first step is a solution annealing process that involves heating the club head assembly 30 to a predetermined temperature 470, near the solvus temperature 468, between 850° C. and 950° C. for approximately 1 hour. In some embodiments, the heat treatment first step predetermined temperature 470 can be between 850° C. and 860° C., 860° C. and 870° C., 870° C. and 880° C., 880° C. and 890° C., 890° C. and 900° C., 900° C. and 910° C., 910° C. and 920° C., 920° C. and 930° C., 930° C. and 940° C., or 940° C. and 950° C. In some embodiments, the heat treatment first step predetermined temperature 470 can be 895° C., 896° C., 897° C., 898° C., 899° C., 900° C., 901° C., 902° C., 903° C., 904° C., or 905° C. In one example, the predetermined temperature 470 in the first step of the heat treatment process can be approximately 900° C. The club head assembly 30 is then quenched in an inert gas pressurized environment. In some embodiments the pressure can be 1 Bar, 2 Bar, 3 Bar, 4 Bar, 5 Bar, 6 Bar, 7 Bar, 8 Bar, 9 Bar, 10 Bar, 10 Bar, 11 Bar, 12 Bar, 13 Bar, 14 Bar, 15 Bar, 16 Bar, 17 Bar, 18 Bar, 19 Bar, or 20 Bar. In one example the pressure in the pressurized environment is 1 Bar. The heat treatment second step is an aging process that involves heating the club head assembly 30 to a temperature between 570° C. and 640° C. for approximately 8 hours. In some embodiments, the heat treatment second step temperature can be between 570° C. and 580° C., 580° C. and 590° C., 590° C. and 600° C., 600° C. and 610° C., 610° C. and 620° C., 620° C. and 630° C., or 630° C. and 640° C. In one example, the predetermined temperature in the first step of the heat treatment process can be approximately 590° C. The club head assembly is then allowed to cool to room temperature via air cooling. In some embodiments, the club head assembly 30 is briefly jet cooled with an inert gas prior to air cooling in order to expedite the cooling process.

In one embodiment TSG2 may have a total weight percent of α-stabilizer aluminum between 6.0 wt % to 8.0 wt %, a total weight percent of α-stabilizer oxygen less than or equal to 0.15 wt %, a total weight percent of β-stabilizer molybdenum between 1.5 wt % and 2.5 wt %, a total weight percent of β-stabilizer vanadium between 3.5 w-t % and 3.5 wt %, a total weight percent of β-stabilizer silicon between 0.1 wt % and 0.2 wt %, and a total weight percent of β-stabilizer iron between 0.5 wt % and 1.0 wt %. In one example, TSG2 may have a total weight percent of α-stabilizer aluminum of 7.73 wt %, a total weight percent of α-stabilizer oxygen less than or equal to 0.15 wt %, a total weight percent of β-stabilizer molybdenum of 3.09 wt %, a total weight percent of β-stabilizer vanadium of 4.63 wt %, a total weight percent of β-stabilizer silicon of 0.12 wt %, and a total weight percent of β-stabilizer iron of 0.53 wt %. In another example, TSG2 may have a total weight percent of α-stabilizer aluminum of 7.00 wt %, a total weight percent of α-stabilizer oxygen less than or equal to 0.15 wt %, a total weight percent of β-stabilizer molybdenum of 1.50 wt %, a total weight percent of β-stabilizer vanadium of 4.50 wt %, a total weight percent of β-stabilizer silicon of 0.15 wt %, and a total weight percent of β-stabilizer iron of 0.70 wt %. TSG2 may undergo a series of mechanical manufacturing steps to achieve the desired shape as described above. During the mechanical manufacturing process, TSG2 is heated to a predetermined temperature 470 between 850° C. and 950° C. prior to the cross-rolling step. In some embodiments, the predetermined temperature 470 can be between 850° C. and 860° C., 860° C. and 870° C., 870° C. and 880° C., 880° C. and 890° C., 890° C. and 900° C., 900° C. and 910° C., 910° C. and 920° C., 920° C. and 930° C., 930° C. and 940° C., or 940° C. and 950° C. In some embodiments, the predetermined temperature 470 can be 895° C., 896° C., 897° C., 898° C., 899° C., 900° C., 901° C., 902° C., 903° C., 904° C., or 905° C. In one example, TSG2 is heated to a predetermined temperature 470 of 900° C. prior to the cross-rolling step.

After the faceplate 14 is formed and welded to the club head, the club head assembly may undergo a two-step heat treatment, wherein the first step is a solution annealing process that involves heating the club head assembly 30 to a predetermined temperature 470, near the solvus temperature 468, between 850° C. and 950° C. for approximately 1 hour. In some embodiments, the heat treatment first step predetermined temperature 470 can be between 850° C. and 860° C., 860° C. and 870° C., 870° C. and 880° C., 880° C. and 890° C., 890° C. and 900° C., 900° C. and 910° C., 910° C. and 920° C., 920° C. and 930° C., 930° C. and 940° C., or 940° C. and 950° C. In some embodiments, the heat treatment first step predetermined temperature 470 can be 895° C., 896° C., 897° C., 898° C., 899° C., 900° C., 901° C., 902° C., 903° C., 904° C., or 905° C. In one example, the predetermined temperature 470 in the first step of the heat treatment process can be approximately 900° C. The club head assembly 30 is then quenched in an inert gas pressurized environment. In some embodiments the pressure can be 1 Bar, 2 Bar, 3 Bar, 4 Bar, 5 Bar, 6 Bar, 7 Bar, 8 Bar, 9 Bar, 10 Bar, 10 Bar, 11 Bar, 12 Bar, 13 Bar, 14 Bar, 15 Bar, 16 Bar, 17 Bar, 18 Bar, 19 Bar, or 20 Bar. In one example the pressure in the pressurized environment is 1 Bar. The heat treatment second step is an aging process that involves heating the club head assembly 30 to a temperature between 590° C. and 650° C. for approximately 4 hours. In some embodiments, the heat treatment second step temperature can be between 590° C. and 600° C., 600° C. and 610° C., 610° C. and 620° C., 620° C. and 630° C., 630° C. and 640° C., 640° C. and 650° C. In one example, the predetermined temperature in the first step of the heat treatment process can be approximately 620° C. The club head assembly is then allowed to cool to room temperature via air cooling. In some embodiments, the club head assembly 30 is briefly jet cooled with an inert gas prior to air cooling in order to expedite the cooling process.

In one embodiment, TSG2 may have a total weight percent of α-stabilizer aluminum between 6.0 wt % to 8.0 wt %, a total weight percent of α-stabilizer oxygen less than or equal to 0.15 wt %, a total weight percent of β-stabilizer molybdenum between 1.5 wt % and 2.5 wt %, a total weight percent of β-stabilizer vanadium between 3.5 w-t % and 3.5 wt %, a total weight percent of β-stabilizer silicon between 0.1 wt % and 0.2 wt %, and a total weight percent of β-stabilizer iron between 0.5 wt % and 1.0 wt %. In one example, TSG2 may have a total weight percent of α-stabilizer aluminum of 7.73 wt %, a total weight percent of α-stabilizer oxygen less than or equal to 0.15 wt %, a total weight percent of β-stabilizer molybdenum of 3.09 wt %, a total weight percent of β-stabilizer vanadium of 4.63 wt %, a total weight percent of β-stabilizer silicon of 0.12 wt %, and a total weight percent of β-stabilizer iron of 0.53 wt %. In another example, TSG2 may have a total weight percent of α-stabilizer aluminum of 7.00 wt %, a total weight percent of α-stabilizer oxygen less than or equal to 0.15 wt %, a total weight percent of β-stabilizer molybdenum of 1.50 wt %, a total weight percent of β-stabilizer vanadium of 4.50 wt %, a total weight percent of β-stabilizer silicon of 0.15 wt %, and a total weight percent of β-stabilizer iron of 0.70 wt %. TSG2 may undergo a series of mechanical manufacturing steps to achieve the desired shape as described above. During the mechanical manufacturing process, TSG2 is heated to a predetermined temperature 470 between 880° C. and 980° C. prior to the cross-rolling step. In some embodiments, the predetermined temperature 470 can be between 880° C. and 890° C., 890° C. and 900° C., 900° C. and 910° C., 910° C. and 920° C., 920° C. and 930° C., 930° C. and 940° C., 940° C. and 950° C., 950° C. and 960° C., 960° C. and 970° C., or 970° C. and 980° C. In some embodiments, the predetermined temperature 470 can be 925° C., 926° C., 927° C., 928° C., 929° C., 930° C., 931° C., 932° C., 933° C., 934° C., or 935° C. In one example, TSG2 is heated to a predetermined temperature 470 of 930° C. prior to the cross-rolling step.

After the faceplate 14 is formed and welded to the club head, the club head assembly may undergo a two-step heat treatment, wherein the first step is a solution annealing process that involves heating the club head assembly 30 to a predetermined temperature 470, near the solvus temperature 468, between 850° C. and 950° C. for approximately 1 hour. In some embodiments, the heat treatment first step predetermined temperature 470 can be between 850° C. and 860° C., 860° C. and 870° C., 870° C. and 880° C., 880° C. and 890° C., 890° C. and 900° C., 900° C. and 910° C., 910° C. and 920° C., 920° C. and 930° C., 930° C. and 940° C., or 940° C. and 950° C. In some embodiments, the heat treatment first step predetermined temperature 470 can be 895° C., 896° C., 897° C., 898° C., 899° C., 900° C., 901° C., 902° C., 903° C., 904° C., or 905° C. In one example, the predetermined temperature 470 in the first step of the heat treatment process can be approximately 900° C. The club head assembly 30 is then quenched in an inert gas pressurized environment. In some embodiments the pressure can be 1 Bar, 2 Bar, 3 Bar, 4 Bar, 5 Bar, 6 Bar, 7 Bar, 8 Bar, 9 Bar, 10 Bar, 10 Bar, 11 Bar, 12 Bar, 13 Bar, 14 Bar, 15 Bar, 16 Bar, 17 Bar, 18 Bar, 19 Bar, or 20 Bar. In one example the pressure in the pressurized environment is 5 Bar. The heat treatment second step is an aging process that involves heating the club head assembly 30 to a temperature between 570° C. and 640° C. for approximately 4 hours. In some embodiments, the heat treatment second step temperature can be between 570° C. and 580° C., 580° C. and 590° C., 590° C. and 600° C., 600° C. and 610° C., 610° C. and 620° C., 620° C. and 630° C., or 630° C. and 640° C. In one example, the predetermined temperature in the first step of the heat treatment process can be approximately 590° C. The club head assembly is then allowed to cool to room temperature via air cooling. In some embodiments, the club head assembly 30 is briefly jet cooled with an inert gas prior to air cooling in order to expedite the cooling process.

In one embodiment, BE α-β Ti alloy TSG2 may have a total weight percent of α-stabilizer aluminum between 6.0 wt % to 8.0 wt %, a total weight percent of α-stabilizer oxygen less than or equal to 0.15 wt %, a total weight percent of β-stabilizer molybdenum between 1.5 wt % and 2.5 wt %, a total weight percent of β-stabilizer vanadium between 3.5 wt % and 3.5 wt %, a total weight percent of β-stabilizer silicon between 0.0 wt % and 0.2 wt %, and a total weight percent of β-stabilizer iron between 0.5 wt % and 1.0 wt %. In one example, TSG2 may have a total weight percent of α-stabilizer aluminum of 7.73 wt %, a total weight percent of α-stabilizer oxygen less than or equal to 0.15 wt %, a total weight percent of β-stabilizer molybdenum of 3.09 wt %, a total weight percent of β-stabilizer vanadium of 4.63 wt %, a total weight percent of β-stabilizer silicon of 0.12 wt %, and a total weight percent of β-stabilizer iron of 0.53 wt %. In another example, TSG2 may have a total weight percent of α-stabilizer aluminum of 7.00 wt %, a total weight percent of α-stabilizer oxygen less than or equal to 0.15 wt %, a total weight percent of β-stabilizer molybdenum of 1.50 wt %, a total weight percent of β-stabilizer vanadium of 4.50 wt %, a total weight percent of β-stabilizer silicon of 0.15 wt %, and a total weight percent of β-stabilizer iron of 0.70 wt %. TSG2 may undergo a series of mechanical manufacturing steps to achieve the desired shape as described above. During the mechanical manufacturing process, TSG2 is heated to a predetermined temperature 470 between 880° C. and 980° C. prior to the cross-rolling step. In some embodiments, the predetermined temperature 470 can be between 880° C. and 890° C., 890° C. and 900° C., 900° C. and 910° C., 910° C. and 920° C., 920° C. and 930° C., 930° C. and 940° C., 940° C. and 950° C., 950° C. and 960° C., 960° C. and 970° C., or 970° C. and 980° C. In some embodiments, the predetermined temperature 470 can be 925° C., 926° C., 927° C., 928° C., 929° C., 930° C., 931° C., 932° C., 933° C., 934° C., or 935° C. In one example, TSG2 is heated to a predetermined temperature 470 of 930° C. prior to the cross-rolling step.

After the faceplate 14 is formed and welded to the club head, the club head assembly may undergo a two-step heat treatment, wherein the first step is a solution annealing process that involves heating the club head assembly 30 to a predetermined temperature 470, near the solvus temperature 468, between 850° C. and 950° C. for approximately 1 hour. In some embodiments, the heat treatment first step predetermined temperature 470 can be between 850° C. and 860° C., 860° C. and 870° C., 870° C. and 880° C., 880° C. and 890° C., 890° C. and 900° C., 900° C. and 910° C., 910° C. and 920° C., 920° C. and 930° C., 930° C. and 940° C., or 940° C. and 950° C. In some embodiments, the heat treatment first step predetermined temperature 470 can be 895° C., 896° C., 897° C., 898° C., 899° C., 900° C., 901° C., 902° C., 903° C., 904° C., or 905° C. In one example, the predetermined temperature 470 in the first step of the heat treatment process can be approximately 900° C. The club head assembly 30 is then quenched in an inert gas pressurized environment. In some embodiments the pressure can be 1 Bar, 2 Bar, 3 Bar, 4 Bar, 5 Bar, 6 Bar, 7 Bar, 8 Bar, 9 Bar, 10 Bar, 10 Bar, 11 Bar, 12 Bar, 13 Bar, 14 Bar, 15 Bar, 16 Bar, 17 Bar, 18 Bar, 19 Bar, or 20 Bar. In one example the pressure in the pressurized environment is 1 Bar. The heat treatment second step is an aging process that involves heating the club head assembly 30 to a temperature between 570° C. and 640° C. for approximately 8 hours. In some embodiments, the heat treatment second step temperature can be between 570° C. and 580° C., 580° C. and 590° C., 590° C. and 600° C., 600° C. and 610° C., 610° C. and 620° C., 620° C. and 630° C., or 630° C. and 640° C. In one example, the predetermined temperature in the first step of the heat treatment process can be approximately 590° C. The club head assembly is then allowed to cool to room temperature via air cooling. In some embodiments, the club head assembly 30 is briefly jet cooled with an inert gas prior to air cooling in order to expedite the cooling process.

In one embodiment, TSG2 may have a total weight percent of α-stabilizer aluminum between 6.0 wt % to 8.0 wt %, a total weight percent of α-stabilizer oxygen less than or equal to 0.15 wt %, a total weight percent of β-stabilizer molybdenum between 1.5 wt % and 2.5 wt %, a total weight percent of β-stabilizer vanadium between 3.5 wt % and 3.5 wt %, a total weight percent of β-stabilizer silicon between 0.1 wt % and 0.2 wt %, and a total weight percent of β-stabilizer iron between 0.5 wt % and 1.0 wt %. In one example, TSG2 may have a total weight percent of α-stabilizer aluminum of 7.73 wt %, a total weight percent of α-stabilizer oxygen less than or equal to 0.15 wt %, a total weight percent of β-stabilizer molybdenum of 3.09 wt %, a total weight percent of β-stabilizer vanadium of 4.63 wt %, a total weight percent of β-stabilizer silicon of 0.12 wt %, and a total weight percent of β-stabilizer iron of 0.53 wt %. In another example, TSG2 may have a total weight percent of α-stabilizer aluminum of 7.00 wt %, a total weight percent of α-stabilizer oxygen less than or equal to 0.15 wt %, a total weight percent of β-stabilizer molybdenum of 1.50 wt %, a total weight percent of β-stabilizer vanadium of 4.50 wt %, a total weight percent of β-stabilizer silicon of 0.15 wt %, and a total weight percent of β-stabilizer iron of 0.70 wt %. TSG2 may undergo a series of mechanical manufacturing steps to achieve the desired shape as described above. During the mechanical manufacturing process, TSG2 is heated to a predetermined temperature 470 between 880° C. and 980° C. prior to the cross-rolling step. In some embodiments, the predetermined temperature 470 can be between 880° C. and 890° C., 890° C. and 900° C., 900° C. and 910° C., 910° C. and 920° C., 920° C. and 930° C., 930° C. and 940° C., 940° C. and 950° C., 950° C. and 960° C., 960° C. and 970° C., or 970° C. and 980° C. In some embodiments, the predetermined temperature 470 can be 925° C., 926° C., 927° C., 928° C., 929° C., 930° C., 931° C., 932° C., 933° C., 934° C., or 935° C. In one example, TSG2 is heated to a predetermined temperature 470 of 930° C. prior to the cross-rolling step.

After the faceplate 14 is formed and welded to the club head, the club head assembly may undergo a two-step heat treatment, wherein the first step is a solution annealing process that involves heating the club head assembly 30 to a predetermined temperature 470, near the solvus temperature 468, between 850° C. and 950° C. for approximately 1 hour. In some embodiments, the heat treatment first step predetermined temperature 470 can be between 850° C. and 860° C., 860° C. and 870° C., 870° C. and 880° C., 880° C. and 890° C., 890° C. and 900° C., 900° C. and 910° C., 910° C. and 920° C., 920° C. and 930° C., 930° C. and 940° C., or 940° C. and 950° C. In some embodiments, the heat treatment first step predetermined temperature 470 can be 895° C., 896° C., 897° C., 898° C., 899° C., 900° C., 901° C., 902° C., 903° C., 904° C., or 905° C. In one example, the predetermined temperature 470 in the first step of the heat treatment process can be approximately 900° C. The club head assembly 30 is then quenched in an inert gas pressurized environment. In some embodiments the pressure can be 1 Bar, 2 Bar, 3 Bar, 4 Bar, 5 Bar, 6 Bar, 7 Bar, 8 Bar, 9 Bar, 10 Bar, 10 Bar, 11 Bar, 12 Bar, 13 Bar, 14 Bar, 15 Bar, 16 Bar, 17 Bar, 18 Bar, 19 Bar, or 20 Bar. In one example the pressure in the pressurized environment is 1 Bar. The heat treatment second step is an aging process that involves heating the club head assembly 30 to a temperature between 590° C. and 650° C. for approximately 4 hours. In some embodiments, the heat treatment second step temperature can be between 590° C. and 600° C., 600° C. and 610° C., 610° C. and 620° C., 620° C. and 630° C., 630° C. and 640° C., 640° C. and 650° C. In one example, the predetermined temperature in the first step of the heat treatment process can be approximately 620° C. The club head assembly is then allowed to cool to room temperature via air cooling. In some embodiments, the club head assembly 30 is briefly jet cooled with an inert gas prior to air cooling in order to expedite the cooling process.

In one embodiment TSG2 may have a total weight percent of α-stabilizer aluminum between 6.0 wt % to 8.0 wt %, a total weight percent of α-stabilizer oxygen less than or equal to 0.15 wt %, a total weight percent of β-stabilizer molybdenum between 1.5 wt % and 2.5 wt %, a total weight percent of β-stabilizer vanadium between 3.5 w-t % and 3.5 wt %, a total weight percent of β-stabilizer silicon between 0.0 wt % and 0.2 wt %, and a total weight percent of β-stabilizer iron between 0.5 wt % and 1.0 wt %. In one example, TSG2 may have a total weight percent of α-stabilizer aluminum of 7.73 wt %, a total weight percent of α-stabilizer oxygen less than or equal to 0.15 wt %, a total weight percent of β-stabilizer molybdenum of 3.09 wt %, a total weight percent of β-stabilizer vanadium of 4.63 wt %, a total weight percent of β-stabilizer silicon of 0.12 wt %, and a total weight percent of β-stabilizer iron of 0.53 wt %. In another example, TSG2 may have a total weight percent of α-stabilizer aluminum of 7.00 wt %, a total weight percent of α-stabilizer oxygen less than or equal to 0.15 wt %, a total weight percent of β-stabilizer molybdenum of 1.50 wt %, a total weight percent of β-stabilizer vanadium of 4.50 wt %, a total weight percent of β-stabilizer silicon of 0.15 wt %, and a total weight percent of β-stabilizer iron of 0.70 wt %. The TSG2 may undergo a series of mechanical manufacturing steps to achieve the desired shape as described above. During the mechanical manufacturing process, TSG2 is heated to a predetermined temperature 470 between 900° C. and 1000° C. prior to the cross-rolling step. In some embodiments, the predetermined temperature 470 can be between 900° C. and 910° C., 910° C. and 920° C., 920° C. and 930° C., 930° C. and 940° C., 940° C. and 950° C., 950° C. and 960° C., 960° C. and 970° C., 970° C. and 980° C., 980° C. and 990° C., or 990° C. and 1000° C. In some embodiments, the predetermined temperature 470 can be 945° C., 946° C., 947° C., 948° C., 949° C., 950° C., 951° C., 952° C., 953° C., 954° C., or 955° C. In one example, TSG2 is heated to a predetermined temperature 470 of 950° C. prior to the cross-rolling step.

After the faceplate 14 is formed and welded to the club head, the club head assembly may undergo a two-step heat treatment, wherein the first step is a solution annealing process that involves heating the club head assembly 30 to a predetermined temperature 470, near the solvus temperature 468, between 850° C. and 950° C. for approximately 1 hour. In some embodiments, the heat treatment first step predetermined temperature 470 can be between 850° C. and 860° C., 860° C. and 870° C., 870° C. and 880° C., 880° C. and 890° C., 890° C. and 900° C., 900° C. and 910° C., 910° C. and 920° C., 920° C. and 930° C., 930° C. and 940° C., or 940° C. and 950° C. In some embodiments, the heat treatment first step predetermined temperature 470 can be 895° C., 896° C., 897° C., 898° C., 899° C., 900° C., 901° C., 902° C., 903° C., 904° C., or 905° C. In one example, the predetermined temperature 470 in the first step of the heat treatment process can be approximately 900° C. The club head assembly 30 is then quenched in an inert gas pressurized environment. In some embodiments the pressure can be 1 Bar, 2 Bar, 3 Bar, 4 Bar, 5 Bar, 6 Bar, 7 Bar, 8 Bar, 9 Bar, 10 Bar, 10 Bar, 11 Bar, 12 Bar, 13 Bar, 14 Bar, 15 Bar, 16 Bar, 17 Bar, 18 Bar, 19 Bar, or 20 Bar. In one example the pressure in the pressurized environment is 5 Bar. The heat treatment second step is an aging process that involves heating the club head assembly 30 to a temperature between 570° C. and 640° C. for approximately 4 hours. In some embodiments, the heat treatment second step temperature can be between 570° C. and 580° C., 580° C. and 590° C., 590° C. and 600° C., 600° C. and 610° C., 610° C. and 620° C., 620° C. and 630° C., or 630° C. and 640° C. In one example, the predetermined temperature in the first step of the heat treatment process can be approximately 590° C. The club head assembly is then allowed to cool to room temperature via air cooling. In some embodiments, the club head assembly 30 is briefly jet cooled with an inert gas prior to air cooling in order to expedite the cooling process.

In one embodiment TSG2 may have a total weight percent of α-stabilizer aluminum between 6.0 wt % to 8.0 wt %, a total weight percent of α-stabilizer oxygen less than or equal to 0.15 wt %, a total weight percent of β-stabilizer molybdenum between 1.5 wt % and 2.5 wt %, a total weight percent of β-stabilizer vanadium between 3.5 wt % and 3.5 wt %, a total weight percent of β-stabilizer silicon between 0.0 wt % and 0.2 wt %, and a total weight percent of β-stabilizer iron between 0.5 wt % and 1.0 wt %. In one example, TSG2 may have a total weight percent of α-stabilizer aluminum of 7.73 wt %, a total weight percent of α-stabilizer oxygen less than or equal to 0.15 wt %, a total weight percent of β-stabilizer molybdenum of 3.09 wt %, a total weight percent of β-stabilizer vanadium of 4.63 wt %, a total weight percent of β-stabilizer silicon of 0.12 wt %, and a total weight percent of β-stabilizer iron of 0.53 wt %. In another example, TSG2 may have a total weight percent of α-stabilizer aluminum of 7.00 wt %, a total weight percent of α-stabilizer oxygen less than or equal to 0.15 wt %, a total weight percent of β-stabilizer molybdenum of 1.50 wt %, a total weight percent of β-stabilizer vanadium of 4.50 wt %, a total weight percent of β-stabilizer silicon of 0.15 wt %, and a total weight percent of β-stabilizer iron of 0.70 wt %. TSG2 may undergo a series of mechanical manufacturing steps to achieve the desired shape as described above. During the mechanical manufacturing process, TSG2 is heated to a predetermined temperature 470 between 900° C. and 1000° C. prior to the cross-rolling step. In some embodiments, the predetermined temperature 470 can be between 900° C. and 910° C., 910° C. and 920° C., 920° C. and 930° C., 930° C. and 940° C., 940° C. and 950° C., 950° C. and 960° C., 960° C. and 970° C., 970° C. and 980° C., 980° C. and 990° C., or 990° C. and 1000° C. In some embodiments, the predetermined temperature 470 can be 945° C., 946° C., 947° C., 948° C., 949° C., 950° C., 951° C., 952° C., 953° C., 954° C., or 955° C. In one example, TSG2 is heated to a predetermined temperature 470 of 950° C. prior to the cross-rolling step.

After the faceplate 14 is formed and welded to the club head, the club head assembly may undergo a two-step heat treatment, wherein the first step is a solution annealing process that involves heating the club head assembly 30 to a predetermined temperature 470, near the solvus temperature 468, between 850° C. and 950° C. for approximately 1 hour. In some embodiments, the heat treatment first step predetermined temperature 470 can be between 850° C. and 860° C., 860° C. and 870° C., 870° C. and 880° C., 880° C. and 890° C., 890° C. and 900° C., 900° C. and 910° C., 910° C. and 920° C., 920° C. and 930° C., 930° C. and 940° C., or 940° C. and 950° C. In some embodiments, the heat treatment first step predetermined temperature 470 can be 895° C., 896° C., 897° C., 898° C., 899° C., 900° C., 901° C., 902° C., 903° C., 904° C., or 905° C. In one example, the predetermined temperature 470 in the first step of the heat treatment process can be approximately 900° C. The club head assembly 30 is then quenched in an inert gas pressurized environment. In some embodiments the pressure can be 1 Bar, 2 Bar, 3 Bar, 4 Bar, 5 Bar, 6 Bar, 7 Bar, 8 Bar, 9 Bar, 10 Bar, 10 Bar, 11 Bar, 12 Bar, 13 Bar, 14 Bar, 15 Bar, 16 Bar, 17 Bar, 18 Bar, 19 Bar, or 20 Bar. In one example the pressure in the pressurized environment is 1 Bar. The heat treatment second step is an aging process that involves heating the club head assembly 30 to a temperature between 570° C. and 640° C. for approximately 8 hours. In some embodiments, the heat treatment second step temperature can be between 570° C. and 580° C., 580° C. and 590° C., 590° C. and 600° C., 600° C. and 610° C., 610° C. and 620° C., 620° C. and 630° C., or 630° C. and 640° C. In one example, the predetermined temperature in the first step of the heat treatment process can be approximately 590° C. The club head assembly is then allowed to cool to room temperature via air cooling. In some embodiments, the club head assembly 30 is briefly jet cooled with an inert gas prior to air cooling in order to expedite the cooling process.

In one embodiment TSG2 may have a total weight percent of α-stabilizer aluminum between 6.0 wt % to 8.0 wt %, a total weight percent of α-stabilizer oxygen less than or equal to 0.15 wt %, a total weight percent of β-stabilizer molybdenum between 1.5 wt % and 2.5 wt %, a total weight percent of β-stabilizer vanadium between 3.5 wt % and 3.5 wt %, a total weight percent of β-stabilizer silicon between 0.1 wt % and 0.2 wt %, and a total weight percent of β-stabilizer iron between 0.5 wt % and 1.0 wt %. In one example, TSG2 may have a total weight percent of α-stabilizer aluminum of 7.73 wt %, a total weight percent of α-stabilizer oxygen less than or equal to 0.15 wt %, a total weight percent of β-stabilizer molybdenum of 3.09 wt %, a total weight percent of β-stabilizer vanadium of 4.63 wt %, a total weight percent of β-stabilizer silicon of 0.12 wt %, and a total weight percent of β-stabilizer iron of 0.53 wt %. In another example, TSG2 may have a total weight percent of α-stabilizer aluminum of 7.00 wt %, a total weight percent of α-stabilizer oxygen less than or equal to 0.15 wt %, a total weight percent of β-stabilizer molybdenum of 1.50 wt %, a total weight percent of β-stabilizer vanadium of 4.50 wt %, a total weight percent of β-stabilizer silicon of 0.15 wt %, and a total weight percent of β-stabilizer iron of 0.70 wt %. TSG2 may undergo a series of mechanical manufacturing steps to achieve the desired shape as described above. During the mechanical manufacturing process, TSG2 is heated to a predetermined temperature 470 between 900° C. and 1000° C. prior to the cross-rolling step. In some embodiments, the predetermined temperature 470 can be between 900° C. and 910° C., 910° C. and 920° C., 920° C. and 930° C., 930° C. and 940° C., 940° C. and 950° C., 950° C. and 960° C., 960° C. and 970° C., 970° C. and 980° C., 980° C. and 990° C., or 990° C. and 1000° C. In some embodiments, the predetermined temperature 470 can be 945° C., 946° C., 947° C., 948° C., 949° C., 950° C., 951° C., 952° C., 953° C., 954° C., or 955° C. In one example, TSG2 is heated to a predetermined temperature 470 of 950° C. prior to the cross-rolling step.

After the faceplate 14 is formed and welded to the club head, the club head assembly may undergo a two-step heat treatment, wherein the first step is a solution annealing process that involves heating the club head assembly 30 to a predetermined temperature 470, near the solvus temperature 468, between 850° C. and 950° C. for approximately 1 hour. In some embodiments, the heat treatment first step predetermined temperature 470 can be between 850° C. and 860° C., 860° C. and 870° C., 870° C. and 880° C., 880° C. and 890° C., 890° C. and 900° C., 900° C. and 910° C., 910° C. and 920° C., 920° C. and 930° C., 930° C. and 940° C., or 940° C. and 950° C. In some embodiments, the heat treatment first step predetermined temperature 470 can be 895° C., 896° C., 897° C., 898° C., 899° C., 900° C., 901° C., 902° C., 903° C., 904° C., or 905° C. In one example, the predetermined temperature 470 in the first step of the heat treatment process can be approximately 900° C. The club head assembly 30 is then quenched in an inert gas pressurized environment. In some embodiments the pressure can be 1 Bar, 2 Bar, 3 Bar, 4 Bar, 5 Bar, 6 Bar, 7 Bar, 8 Bar, 9 Bar, 10 Bar, 10 Bar, 11 Bar, 12 Bar, 13 Bar, 14 Bar, 15 Bar, 16 Bar, 17 Bar, 18 Bar, 19 Bar, or 20 Bar. In one example the pressure in the pressurized environment is 1 Bar. The heat treatment second step is an aging process that involves heating the club head assembly 30 to a temperature between 590° C. and 650° C. for approximately 4 hours. In some embodiments, the heat treatment second step temperature can be between 590° C. and 600° C., 600° C. and 610° C., 610° C. and 620° C., 620° C. and 630° C., 630° C. and 640° C., 640° C. and 650° C. In one example, the predetermined temperature in the first step of the heat treatment process can be approximately 620° C. The club head assembly is then allowed to cool to room temperature via air cooling. In some embodiments, the club head assembly 30 is briefly jet cooled with an inert gas prior to air cooling in order to expedite the cooling process.

BE α-β Ti alloy—Composition 3

In one embodiment the BE α-β Ti alloy (hereafter referred to as "TSG3") may have a total weight percent of α-stabilizer aluminum between 6.0 wt % to 7.0 wt %, a total weight percent of α-stabilizer oxygen less than or equal to 0.15 wt %, a total weight percent of β-stabilizer molybdenum between 1.0 wt % and 2.0 wt %, a total weight percent of β-stabilizer vanadium between 3.0 wt % and 5.0 wt %, a total weight percent of β-stabilizer silicon between 0.1 wt % and 0.2 wt %, and a total weight percent of β-stabilizer iron between 0.2 wt % and 0.8 wt %. In one example, TSG3 may have a total weight percent of α-stabilizer aluminum of 6.46 wt %, a total weight percent of α-stabilizer oxygen less than or equal to 0.15 wt %, a total weight percent of β-stabilizer molybdenum of 2.25 wt %, a total weight percent of β-stabilizer vanadium of 4.40 wt %, a total weight percent of β-stabilizer silicon of 0.14 wt %, and a total weight percent of β-stabilizer iron of 0.34 wt %. In another example, TSG3 may have a total weight percent of α-stabilizer aluminum of 6.30 wt %, a total weight percent of α-stabilizer oxygen less than or equal to 0.15 wt %, a total weight percent of β-stabilizer molybdenum of 1.50 wt %, a total weight percent of β-stabilizer vanadium of 4.00 wt %, a total weight percent of β-stabilizer silicon of 0.15 wt %, and a total weight percent of β-stabilizer iron of 0.40 wt %. TSG3 may undergo a series of mechanical manufacturing steps to achieve the desired shape as described above. During the mechanical manufacturing process, TSG3 is heated to a predetermined temperature 470 between 850° C. and 950° C. prior to the cross-rolling step. In some embodiments, the predetermined temperature 470 can be between 850° C. and 860° C., 860° C. and 870° C., 870° C. and 880° C., 880° C. and 890° C., 890° C. and 900° C., 900° C. and 910° C., 910° C. and 920° C., 920° C. and 930° C., 930° C. and 940° C., or 940° C. and 950° C. In some embodiments, the predetermined temperature 470 can be 895° C., 896° C., 897° C., 898° C., 899° C., 900° C., 901° C., 902° C., 903° C., 904° C., or 905° C. In one example, BE α-β Ti alloy TSG3 is heated to a predetermined temperature 470 of 900° C. prior to the cross-rolling step.

TSG3, once in its final state, may undergo a two-step heat treatment. In embodiments wherein TSG3 is formed into a golf club head faceplate 14, these heat treatment steps are applied to the golf club head assembly 30, following welding the faceplate 14 to the golf club head body 10. While the heat treatment embodiments detailed below refer to the golf club head assembly 30 receiving the described treatment, any product in a final state of shaping can receive the heat treatment as described.

After the faceplate 14 is formed and welded to the club head, the club head assembly may undergo a two-step heat treatment, wherein the first step is a solution annealing process that involves heating the club head assembly 30 to a predetermined temperature 470, near the solvus temperature 468, between 850° C. and 950° C. for approximately 1 hour. In some embodiments, the heat treatment first step predetermined temperature 470 can be between 850° C. and 860° C., 860° C. and 870° C., 870° C. and 880° C., 880° C. and 890° C., 890° C. and 900° C., 900° C. and 910° C., 910° C. and 920° C., 920° C. and 930° C., 930° C. and 940° C., or 940° C. and 950° C. In some embodiments, the heat treatment first step predetermined temperature 470 can be 895° C., 896° C., 897° C., 898° C., 899° C., 900° C., 901° C., 902° C., 903° C., 904° C., or 905° C. In one example, the predetermined temperature 470 in the first step of the heat treatment process can be approximately 900° C. The club head assembly 30 is then quenched in an inert gas pressurized environment. In some embodiments the pressure can be 1 Bar, 2 Bar, 3 Bar, 4 Bar, 5 Bar, 6 Bar, 7 Bar, 8 Bar, 9 Bar, 10 Bar, 10 Bar, 11 Bar, 12 Bar, 13 Bar, 14 Bar, 15 Bar, 16 Bar, 17 Bar, 18 Bar, 19 Bar, or 20 Bar. In one example the pressure in the pressurized environment is 5 Bar. The heat treatment second step is an aging process that involves heating the club head assembly 30 to a temperature between 570° C. and 640° C. for approximately 4 hours. In some embodiments, the heat treatment second step temperature can be between 570° C. and 580° C., 580° C. and 590° C., 590° C. and 600° C., 600° C. and 610° C., 610° C. and 620° C., 620° C. and 630° C., or 630° C. and 640° C. In one example, the predetermined temperature in the first step of the heat treatment process can be approximately 590° C. The club head assembly is then allowed to cool to room temperature via air cooling. In some embodiments, the club head assembly 30 is briefly jet cooled with an inert gas prior to air cooling in order to expedite the cooling process.

In one embodiment TSG3 may have a total weight percent of α-stabilizer aluminum between 6.0 wt % to 7.0 wt %, a total weight percent of α-stabilizer oxygen less than or equal to 0.15 wt %, a total weight percent of β-stabilizer molybdenum between 1.0 wt % and 2.0 wt %, a total weight percent of β-stabilizer vanadium between 3.0 wt % and 5.0 wt %, a total weight percent of β-stabilizer silicon between 0.1 wt % and 0.2 wt %, and a total weight percent of β-stabilizer iron between 0.2 wt % and 0.8 wt %. In one example, TSG3 may have a total weight percent of α-stabilizer aluminum of 6.46 wt %, a total weight percent of α-stabilizer oxygen less than or equal to 0.15 wt %, a total weight percent of β-stabilizer molybdenum of 2.25 wt %, a total weight percent of β-stabilizer vanadium of 4.40 wt %, a total weight percent of β-stabilizer silicon of 0.14 wt %, and a total weight percent of β-stabilizer iron of 0.34 wt %. In another example, TSG3 may have a total weight percent of α-stabilizer aluminum of 6.30 wt %, a total weight percent of α-stabilizer oxygen less than or equal to 0.15 wt %, a total weight percent of β-stabilizer molybdenum of 1.50 wt %, a total weight percent of β-stabilizer vanadium of 4.00 wt %, a total weight percent of β-stabilizer silicon of 0.15 wt %, and a total weight percent of β-stabilizer iron of 0.40 wt %. TSG3 may undergo a series of mechanical manufacturing steps to achieve the desired shape as described above. During the mechanical manufacturing process, TSG3 is heated to a predetermined temperature 470 between 850° C. and 950° C. prior to the cross-rolling step. In some embodiments, the predetermined temperature 470 can be between 850° C. and 860° C., 860° C. and 870° C., 870° C. and 880° C., 880° C. and 890° C., 890° C. and 900° C., 900° C. and 910° C., 910° C. and 920° C., 920° C. and 930° C., 930° C. and 940° C., or 940° C. and 950° C. In some embodiments, the predetermined temperature 470 can be 895° C., 896° C., 897° C., 898° C., 899° C., 900° C., 901° C., 902° C., 903° C., 904° C., or 905° C. In one example, BE α-β Ti alloy TSG3 is heated to a predetermined temperature 470 of 900° C. prior to the cross-rolling step.

After the faceplate 14 is formed and welded to the club head, the club head assembly may undergo a two-step heat treatment, wherein the first step is a solution annealing process that involves heating the club head assembly 30 to a predetermined temperature 470, near the solvus temperature 468, between 850° C. and 950° C. for approximately 1 hour. In some embodiments, the heat treatment first step predetermined temperature 470 can be between 850° C. and 860° C., 860° C. and 870° C., 870° C. and 880° C., 880° C. and 890° C., 890° C. and 900° C., 900° C. and 910° C., 910° C. and 920° C., 920° C. and 930° C., 930° C. and 940° C., or 940° C. and 950° C. In some embodiments, the heat treatment first step predetermined temperature 470 can be 895° C., 896° C., 897° C., 898° C., 899° C., 900° C., 901° C., 902° C., 903° C., 904° C., or 905° C. In one example, the predetermined temperature 470 in the first step of the heat treatment process can be approximately 900° C. The club head assembly 30 is then quenched in an inert gas pressurized environment. In some embodiments the pressure can be 1 Bar, 2 Bar, 3 Bar, 4 Bar, 5 Bar, 6 Bar, 7 Bar, 8 Bar, 9 Bar, 10 Bar, 10 Bar, 11 Bar, 12 Bar, 13 Bar, 14 Bar, 15 Bar, 16 Bar, 17 Bar, 18 Bar, 19 Bar, or 20 Bar. In one example the pressure in the pressurized environment is 1 Bar. The heat treatment second step is an aging process that involves heating the club head assembly 30 to a temperature between 570° C. and 640° C. for approximately 8 hours. In some embodiments, the heat treatment second step temperature can be between 570° C. and 580° C., 580° C. and 590° C., 590° C. and 600° C., 600° C. and 610° C., 610° C. and 620° C., 620° C. and 630° C., or 630° C. and 640° C. In one example, the predetermined temperature in the first step of the heat treatment process can be approximately 590° C. The club head assembly is then allowed to cool to room temperature via air cooling. In some embodiments, the club head assembly 30 is briefly jet cooled with an inert gas prior to air cooling in order to expedite the cooling process.

In one embodiment TSG3 may have a total weight percent of α-stabilizer aluminum between 6.0 wt % to 7.0 wt %, a total weight percent of α-stabilizer oxygen less than or equal to 0.15 wt %, a total weight percent of β-stabilizer molybdenum between 1.0 wt % and 2.0 wt %, a total weight percent of β-stabilizer vanadium between 3.0 wt % and 5.0 wt %, a total weight percent of β-stabilizer silicon between 0.0 wt % and 0.2 wt %, and a total weight percent of β-stabilizer iron between 0.2 wt % and 0.8 wt %. In one example, TSG3 may have a total weight percent of α-stabilizer aluminum of 6.46 wt %, a total weight percent of α-stabilizer oxygen less than or equal to 0.15 wt %, a total weight percent of β-stabilizer molybdenum of 2.25 wt %, a total weight percent of β-stabilizer vanadium of 4.40 wt %, a total weight percent of β-stabilizer silicon of 0.14 wt %, and a total weight percent of β-stabilizer iron of 0.34 wt %. In another example, TSG3 may have a total weight percent of α-stabilizer aluminum of 6.30 wt %, a total weight percent of α-stabilizer oxygen less than or equal to 0.15 wt %, a total weight percent of β-stabilizer molybdenum of 1.50 wt %, a total weight percent of β-stabilizer vanadium of 4.00 wt %, a total weight percent of β-stabilizer silicon of 0.15 wt %, and a total weight percent of β-stabilizer iron of 0.40 wt %. TSG3 may undergo a series of mechanical manufacturing steps to achieve the desired shape as described above. During the mechanical manufacturing process, TSG3 is heated to a predetermined temperature 470 between 850° C. and 950° C. prior to the cross-rolling step. In some embodiments, the predetermined temperature 470 can be between 850° C. and 860° C., 860° C. and 870° C., 870° C. and 880° C., 880° C. and 890° C., 890° C. and 900° C., 900° C. and 910° C., 910° C. and 920° C., 920° C. and 930° C., 930° C. and 940° C., or 940° C. and 950° C. In some embodiments, the predetermined temperature 470 can be 895° C., 896° C., 897° C., 898° C., 899° C., 900° C., 901° C., 902° C., 903° C., 904° C., or 905° C. In one example, BE α-β Ti alloy TSG3 is heated to a predetermined temperature 470 of 900° C. prior to the cross-rolling step.

After the faceplate 14 is formed and welded to the club head, the club head assembly may undergo a two-step heat treatment, wherein the first step is a solution annealing process that involves heating the club head assembly 30 to a predetermined temperature 470, near the solvus temperature 468, between 850° C. and 950° C. for approximately 1 hour. In some embodiments, the heat treatment first step predetermined temperature 470 can be between 850° C. and 860° C., 860° C. and 870° C., 870° C. and 880° C., 880° C. and 890° C., 890° C. and 900° C., 900° C. and 910° C., 910° C. and 920° C., 920° C. and 930° C., 930° C. and 940° C., or 940° C. and 950° C. In some embodiments, the heat treatment first step predetermined temperature 470 can be 895° C., 896° C., 897° C., 898° C., 899° C., 900° C., 901° C., 902° C., 903° C., 904° C., or 905° C. In one example, the predetermined temperature 470 in the first step of the heat treatment process can be approximately 900° C. The club head assembly 30 is then quenched in an inert gas pressurized environment. In some embodiments the pressure can be 1 Bar, 2 Bar, 3 Bar, 4 Bar, 5 Bar, 6 Bar, 7 Bar, 8 Bar, 9 Bar, 10 Bar, 10 Bar, 11 Bar, 12 Bar, 13 Bar, 14 Bar, 15 Bar, 16 Bar, 17 Bar, 18 Bar, 19 Bar, or 20 Bar. In one example the pressure in the pressurized environment is 1 Bar. The heat treatment second step is an aging process that involves heating the club head assembly 30 to a temperature between 590° C. and 650° C. for approximately 4 hours. In some embodiments, the heat treatment second step temperature can be between 590° C. and 600° C., 600° C. and 610° C., 610° C. and 620° C., 620° C. and 630° C., 630° C. and 640° C., 640° C. and 650° C. In one example, the predetermined temperature in the first step of the heat treatment process can be approximately 620° C. The club head assembly is then allowed to cool to room temperature via air cooling. In some embodiments, the club head assembly 30 is briefly jet cooled with an inert gas prior to air cooling in order to expedite the cooling process.

In one embodiment TSG3 may have a total weight percent of α-stabilizer aluminum between 6.0 wt % to 7.0 wt %, a total weight percent of α-stabilizer oxygen less than or equal to 0.15 wt %, a total weight percent of β-stabilizer molybdenum between 1.0 wt % and 2.0 wt %, a total weight percent of β-stabilizer vanadium between 3.0 wt % and 5.0 wt %, a total weight percent of β-stabilizer silicon between 0.1 wt % and 0.2 wt %, and a total weight percent of β-stabilizer iron between 0.2 wt % and 0.8 wt %. In one example, TSG3 may have a total weight percent of α-stabilizer aluminum of 6.46 wt %, a total weight percent of α-stabilizer oxygen less than or equal to 0.15 wt %, a total weight percent of β-stabilizer molybdenum of 2.25 wt %, a total weight percent of β-stabilizer vanadium of 4.40 wt %, a total weight percent of β-stabilizer silicon of 0.14 wt %, and a total weight percent of β-stabilizer iron of 0.34 wt %. In another example, TSG3 may have a total weight percent of α-stabilizer aluminum of 6.30 wt %, a total weight percent of α-stabilizer oxygen less than or equal to 0.15 wt %, a total weight percent of β-stabilizer molybdenum of 1.50 wt %, a total weight percent of β-stabilizer vanadium of 4.00 wt %, a total weight percent of β-stabilizer silicon of 0.15 wt %, and a total weight percent of β-stabilizer iron of 0.40 wt %. TSG3 may undergo a series of mechanical manufacturing steps to achieve the desired shape as described above. During the mechanical manufacturing process, TSG3 is heated to a predetermined temperature 470 between 880° C. and 980° C. prior to the cross-rolling step. In some embodiments, the predetermined temperature 470 can be between 880° C. and 890° C., 890° C. and 900° C., 900° C. and 910° C., 910° C. and 920° C., 920° C. and 930° C., 930° C. and 940° C., 940° C. and 950° C., 950° C. and 960° C., 960° C. and 970° C., or 970° C. and 980° C. In some embodiments, the predetermined temperature 470 can be 925° C., 926° C., 927° C., 928° C., 929° C., 930° C., 931° C., 932° C., 933° C., 934° C., or 935° C. In one example, BE α-β Ti alloy TSG3 is heated to a predetermined temperature 470 of 930° C. prior to the cross-rolling step.

After the faceplate 14 is formed and welded to the club head, the club head assembly may undergo a two-step heat treatment, wherein the first step is a solution annealing process that involves heating the club head assembly 30 to a predetermined temperature 470, near the solvus temperature 468, between 850° C. and 950° C. for approximately 1 hour. In some embodiments, the heat treatment first step predetermined temperature 470 can be between 850° C. and 860° C., 860° C. and 870° C., 870° C. and 880° C., 880° C. and 890° C., 890° C. and 900° C., 900° C. and 910° C., 910° C. and 920° C., 920° C. and 930° C., 930° C. and 940° C., or 940° C. and 950° C. In some embodiments, the heat treatment first step predetermined temperature 470 can be 895° C., 896° C., 897° C., 898° C., 899° C., 900° C., 901° C., 902° C., 903° C., 904° C., or 905° C. In one example, the predetermined temperature 470 in the first step of the heat treatment process can be approximately 900° C. The club head assembly 30 is then quenched in an inert gas pressurized environment. In some embodiments the pressure can be 1 Bar, 2 Bar, 3 Bar, 4 Bar, 5 Bar, 6 Bar, 7 Bar, 8 Bar, 9 Bar, 10 Bar, 10 Bar, 11 Bar, 12 Bar, 13 Bar, 14 Bar, 15 Bar, 16 Bar, 17 Bar, 18 Bar, 19 Bar, or 20 Bar. In one example the pressure in the pressurized environment is 5 Bar. The heat treatment second step is an aging process that involves heating the club head assembly 30 to a temperature between 570° C. and 640° C. for approximately 4 hours. In some embodiments, the heat treatment second step temperature can be between 570° C. and 580° C., 580° C. and 590° C., 590° C. and 600° C., 600° C. and 610° C., 610° C. and 620° C., 620° C. and 630° C., or 630° C. and 640° C. In one example, the predetermined temperature in the first step of the heat treatment process can be approximately 590° C. The club head assembly is then allowed to cool to room temperature via air cooling. In some embodiments, the club head assembly 30 is briefly jet cooled with an inert gas prior to air cooling in order to expedite the cooling process.

In one embodiment TSG3 may have a total weight percent of α-stabilizer aluminum between 6.0 wt % to 7.0 wt %, a total weight percent of α-stabilizer oxygen less than or equal to 0.15 wt %, a total weight percent of β-stabilizer molybdenum between 1.0 wt % and 2.0 wt %, a total weight percent of β-stabilizer vanadium between 3.0 wt % and 5.0 wt %, a total weight percent of β-stabilizer silicon between 0.1 wt % and 0.2 wt %, and a total weight percent of β-stabilizer iron between 0.2 wt % and 0.8 wt %. In one example, TSG3 may have a total weight percent of α-stabilizer aluminum of 6.46 wt %, a total weight percent of α-stabilizer oxygen less than or equal to 0.15 wt %, a total weight percent of β-stabilizer molybdenum of 2.25 wt %, a total weight percent of β-stabilizer vanadium of 4.40 wt %, a total weight percent of β-stabilizer silicon of 0.14 wt %, and a total weight percent of β-stabilizer iron of 0.34 wt %. In another example, TSG3 may have a total weight percent of α-stabilizer aluminum of 6.30 wt %, a total weight percent of α-stabilizer oxygen less than or equal to 0.15 wt %, a total weight percent of β-stabilizer molybdenum of 1.50 wt %, a total weight percent of β-stabilizer vanadium of 4.00 wt %, a total weight percent of β-stabilizer silicon of 0.15 wt %, and a total weight percent of β-stabilizer iron of 0.40 wt %. TSG3 may undergo a series of mechanical manufacturing steps to achieve the desired shape as described above. During the mechanical manufacturing process, TSG3 is heated to a predetermined temperature 470 between 880° C. and 980° C. prior to the cross-rolling step. In some embodiments, the predetermined temperature 470 can be between 880° C. and 890° C., 890° C. and 900° C., 900° C. and 910° C., 910° C. and 920° C., 920° C. and 930° C., 930° C. and 940° C., 940° C. and 950° C., 950° C. and 960° C., 960° C. and 970° C., or 970° C. and 980° C. In some embodiments, the predetermined temperature 470 can be 925° C., 926° C., 927° C., 928° C., 929° C., 930° C., 931° C., 932° C., 933° C., 934° C., or 935° C. In one example, BE α-β Ti alloy TSG3 is heated to a predetermined temperature 470 of 930° C. prior to the cross-rolling step.

After the faceplate 14 is formed and welded to the club head, the club head assembly may undergo a two-step heat treatment, wherein the first step is a solution annealing process that involves heating the club head assembly 30 to a predetermined temperature 470, near the solvus temperature 468, between 850° C. and 950° C. for approximately 1 hour. In some embodiments, the heat treatment first step predetermined temperature 470 can be between 850° C. and 860° C., 860° C. and 870° C., 870° C. and 880° C., 880° C. and 890° C., 890° C. and 900° C., 900° C. and 910° C., 910° C. and 920° C., 920° C. and 930° C., 930° C. and 940° C., or 940° C. and 950° C. In some embodiments, the heat treatment first step predetermined temperature 470 can be 895° C., 896° C., 897° C., 898° C., 899° C., 900° C., 901° C., 902° C., 903° C., 904° C., or 905° C. In one example, the predetermined temperature 470 in the first step of the heat treatment process can be approximately 900° C. The club head assembly 30 is then quenched in an inert gas pressurized environment. In some embodiments the pressure can be 1 Bar, 2 Bar, 3 Bar, 4 Bar, 5 Bar, 6 Bar, 7 Bar, 8 Bar, 9 Bar, 10 Bar, 10 Bar, 11 Bar, 12 Bar, 13 Bar, 14 Bar, 15 Bar, 16 Bar, 17 Bar, 18 Bar, 19 Bar, or 20 Bar. In one example the pressure in the pressurized environment is 1 Bar. The heat treatment second step is an aging process that involves heating the club head assembly 30 to a temperature between 570° C. and 640° C. for approximately 8 hours. In some embodiments, the heat treatment second step temperature can be between 570° C. and 580° C., 580° C. and 590° C., 590° C. and 600° C., 600° C. and 610° C., 610° C. and 620° C., 620° C. and 630° C., or 630° C. and 640° C. In one example, the predetermined temperature in the first step of the heat treatment process can be approximately 590° C. The club head assembly is then allowed to cool to room temperature via air cooling. In some embodiments, the club head assembly 30 is briefly jet cooled with an inert gas prior to air cooling in order to expedite the cooling process.

In one embodiment TSG3 may have a total weight percent of α-stabilizer aluminum between 6.0 wt % to 7.0 wt %, a total weight percent of α-stabilizer oxygen less than or equal to 0.15 wt %, a total weight percent of β-stabilizer molybdenum between 1.0 wt % and 2.0 wt %, a total weight percent of β-stabilizer vanadium between 3.0 wt % and 5.0 wt %, a total weight percent of β-stabilizer silicon between 0.0 wt % and 0.2 wt %, and a total weight percent of β-stabilizer iron between 0.2 wt % and 0.8 wt %. In one example, TSG3 may have a total weight percent of α-stabilizer aluminum of 6.46 wt %, a total weight percent of α-stabilizer oxygen less than or equal to 0.15 wt %, a total weight percent of β-stabilizer molybdenum of 2.25 wt %, a total weight percent of β-stabilizer vanadium of 4.40 wt %, a total weight percent of β-stabilizer silicon of 0.14 wt %, and a total weight percent of β-stabilizer iron of 0.34 wt %. In another example, TSG3 may have a total weight percent of α-stabilizer aluminum of 6.30 wt %, a total weight percent of α-stabilizer oxygen less than or equal to 0.15 wt %, a total weight percent of β-stabilizer molybdenum of 1.50 wt %, a total weight percent of β-stabilizer vanadium of 4.00 wt %, a total weight percent of β-stabilizer silicon of 0.15 wt %, and a total weight percent of β-stabilizer iron of 0.40 wt %. TSG3 may undergo a series of mechanical manufacturing steps to achieve the desired shape as described above. During the mechanical manufacturing process, TSG3 is heated to a predetermined temperature 470 between 880° C. and 980° C. prior to the cross-rolling step. In some embodiments, the predetermined temperature 470 can be between 880° C. and 890° C., 890° C. and 900° C., 900° C. and 910° C., 910° C. and 920° C., 920° C. and 930° C., 930° C. and 940° C., 940° C. and 950° C., 950° C. and 960° C., 960° C. and 970° C., or 970° C. and 980° C. In some embodiments, the predetermined temperature 470 can be 925° C., 926° C., 927° C., 928° C., 929° C., 930° C., 931° C., 932° C., 933° C., 934° C., or 935° C. In one example, BE α-β Ti alloy TSG3 is heated to a predetermined temperature 470 of 930° C. prior to the cross-rolling step.

After the faceplate 14 is formed and welded to the club head, the club head assembly may undergo a two-step heat treatment, wherein the first step is a solution annealing process that involves heating the club head assembly 30 to a predetermined temperature 470, near the solvus temperature 468, between 850° C. and 950° C. for approximately 1 hour. In some embodiments, the heat treatment first step predetermined temperature 470 can be between 850° C. and 860° C., 860° C. and 870° C., 870° C. and 880° C., 880° C. and 890° C., 890° C. and 900° C., 900° C. and 910° C., 910° C. and 920° C., 920° C. and 930° C., 930° C. and 940° C., or 940° C. and 950° C. In some embodiments, the heat treatment first step predetermined temperature 470 can be 895° C., 896° C., 897° C., 898° C., 899° C., 900° C., 901° C., 902° C., 903° C., 904° C., or 905° C. In one example, the predetermined temperature 470 in the first step of the heat treatment process can be approximately 900° C. The club head assembly 30 is then quenched in an inert gas pressurized environment. In some embodiments the pressure can be 1 Bar, 2 Bar, 3 Bar, 4 Bar, 5 Bar, 6 Bar, 7 Bar, 8 Bar, 9 Bar, 10 Bar, 10 Bar, 11 Bar, 12 Bar, 13 Bar, 14 Bar, 15 Bar, 16 Bar, 17 Bar, 18 Bar, 19 Bar, or 20 Bar. In one example the pressure in the pressurized environment is 1 Bar. The heat treatment second step is an aging process that involves heating the club head assembly 30 to a temperature between 590° C. and 650° C. for approximately 4 hours. In some embodiments, the heat treatment second step temperature can be between 590° C. and 600° C., 600° C. and 610° C., 610° C. and 620° C., 620° C. and 630° C., 630° C. and 640° C., 640° C. and 650° C. In one example, the predetermined temperature in the first step of the heat treatment process can be approximately 620° C. The club head assembly is then allowed to cool to room temperature via air cooling. In some embodiments, the club head assembly 30 is briefly jet cooled with an inert gas prior to air cooling in order to expedite the cooling process.

In one embodiment TSG3 may have a total weight percent of α-stabilizer aluminum between 6.0 wt % to 7.0 wt %, a total weight percent of α-stabilizer oxygen less than or equal to 0.15 wt %, a total weight percent of β-stabilizer molybdenum between 1.0 wt % and 2.0 wt %, a total weight percent of β-stabilizer vanadium between 3.0 wt % and 5.0 wt %, a total weight percent of β-stabilizer silicon between 0.1 wt % and 0.2 wt %, and a total weight percent of β-stabilizer iron between 0.2 wt % and 0.8 wt %. In one example, TSG3 may have a total weight percent of α-stabilizer aluminum of 6.46 wt %, a total weight percent of α-stabilizer oxygen less than or equal to 0.15 wt %, a total weight percent of β-stabilizer molybdenum of 2.25 wt %, a total weight percent of β-stabilizer vanadium of 4.40 wt %, a total weight percent of β-stabilizer silicon of 0.14 wt %, and a total weight percent of β-stabilizer iron of 0.34 wt %. In another example, TSG3 may have a total weight percent of α-stabilizer aluminum of 6.30 wt %, a total weight percent of α-stabilizer oxygen less than or equal to 0.15 wt %, a total weight percent of β-stabilizer molybdenum of 1.50 wt %, a total weight percent of β-stabilizer vanadium of 4.00 wt %, a total weight percent of β-stabilizer silicon of 0.15 wt %, and a total weight percent of β-stabilizer iron of 0.40 wt %. TSG3 may undergo a series of mechanical manufacturing steps to achieve the desired shape as described above. During the mechanical manufacturing process, TSG3 is heated to a predetermined temperature 470 between 900° C. and 1000° C. prior to the cross-rolling step. In some embodiments, the predetermined temperature 470 can be between 900° C. and 910° C., 910° C. and 920° C., 920° C. and 930° C., 930° C. and 940° C., 940° C. and 950° C., 950° C. and 960° C., 960° C. and 970° C., 970° C. and 980° C., 980° C. and 990° C., or 990° C. and 1000° C. In some embodiments, the predetermined temperature 470 can be 945° C., 946° C., 947° C., 948° C., 949° C., 950° C., 951° C., 952° C., 953° C., 954° C., or 955° C. In one example, BE α-β Ti alloy TSG3 is heated to a predetermined temperature 470 of 950° C. prior to the cross-rolling step.

After the faceplate 14 is formed and welded to the club head, the club head assembly may undergo a two-step heat treatment, wherein the first step is a solution annealing process that involves heating the club head assembly 30 to a predetermined temperature 470, near the solvus temperature 468, between 850° C. and 950° C. for approximately 1 hour. In some embodiments, the heat treatment first step predetermined temperature 470 can be between 850° C. and 860° C., 860° C. and 870° C., 870° C. and 880° C., 880° C. and 890° C., 890° C. and 900° C., 900° C. and 910° C., 910° C. and 920° C., 920° C. and 930° C., 930° C. and 940° C., or 940° C. and 950° C. In some embodiments, the heat treatment first step predetermined temperature 470 can be 895° C., 896° C., 897° C., 898° C., 899° C., 900° C., 901° C., 902° C., 903° C., 904° C., or 905° C. In one example, the predetermined temperature 470 in the first step of the heat treatment process can be approximately 900° C. The club head assembly 30 is then quenched in an inert gas pressurized environment. In some embodiments the pressure can be 1 Bar, 2 Bar, 3 Bar, 4 Bar, 5 Bar, 6 Bar, 7 Bar, 8 Bar, 9 Bar, 10 Bar, 10 Bar, 11 Bar, 12 Bar, 13 Bar, 14 Bar, 15 Bar, 16 Bar, 17 Bar, 18 Bar, 19 Bar, or 20 Bar. In one example the pressure in the pressurized environment is 5 Bar. The heat treatment second step is an aging process that involves heating the club head assembly 30 to a temperature between 570° C. and 640° C. for approximately 4 hours. In some embodiments, the heat treatment second step temperature can be between 570° C. and 580° C., 580° C. and 590° C., 590° C. and 600° C., 600° C. and 610° C., 610° C. and 620° C., 620° C. and 630° C., or 630° C. and 640° C. In one example, the predetermined temperature in the first step of the heat treatment process can be approximately 590° C. The club head assembly is then allowed to cool to room temperature via air cooling. In some embodiments, the club head assembly 30 is briefly jet cooled with an inert gas prior to air cooling in order to expedite the cooling process.

In one embodiment TSG3 may have a total weight percent of α-stabilizer aluminum between 6.0 wt % to 7.0 wt %, a total weight percent of α-stabilizer oxygen less than or equal to 0.15 wt %, a total weight percent of β-stabilizer molybdenum between 1.0 wt % and 2.0 wt %, a total weight percent of β-stabilizer vanadium between 3.0 wt % and 5.0 wt %, a total weight percent of β-stabilizer silicon between 0.1 wt % and 0.2 wt %, and a total weight percent of β-stabilizer iron between 0.2 wt % and 0.8 wt %. In one example, TSG3 may have a total weight percent of α-stabilizer aluminum of 6.46 wt %, a total weight percent of α-stabilizer oxygen less than or equal to 0.15 wt %, a total weight percent of β-stabilizer molybdenum of 2.25 wt %, a total weight percent of β-stabilizer vanadium of 4.40 wt %, a total weight percent of β-stabilizer silicon of 0.14 wt %, and a total weight percent of β-stabilizer iron of 0.34 wt %. In another example, TSG3 may have a total weight percent of α-stabilizer aluminum of 6.30 wt %, a total weight percent of α-stabilizer oxygen less than or equal to 0.15 wt %, a total weight percent of β-stabilizer molybdenum of 1.50 wt %, a total weight percent of β-stabilizer vanadium of 4.00 wt %, a total weight percent of β-stabilizer silicon of 0.15 wt %, and a total weight percent of β-stabilizer iron of 0.40 wt %. TSG3 may undergo a series of mechanical manufacturing steps to achieve the desired shape as described above. During the mechanical manufacturing process, TSG3 is heated to a predetermined temperature 470 between 900° C. and 1000° C. prior to the cross-rolling step. In some embodiments, the predetermined temperature 470 can be between 900° C. and 910° C., 910° C. and 920° C., 920° C. and 930° C., 930° C. and 940° C., 940° C. and 950° C., 950° C. and 960° C., 960° C. and 970° C., 970° C. and 980° C., 980° C. and 990° C., or 990° C. and 1000° C. In some embodiments, the predetermined temperature 470 470 can be 945° C., 946° C., 947° C., 948° C., 949° C., 950° C., 951° C., 952° C., 953° C., 954° C., or 955° C. In one example, BE α-β Ti TSG3 alloy is heated to a predetermined temperature 470 of 950° C. prior to the cross-rolling step.

After the faceplate 14 is formed and welded to the club head, the club head assembly may undergo a two-step heat treatment, wherein the first step is a solution annealing process that involves heating the club head assembly 30 to a predetermined temperature 470, near the solvus temperature 468, between 850° C. and 950° C. for approximately 1 hour. In some embodiments, the heat treatment first step predetermined temperature 470 can be between 850° C. and 860° C., 860° C. and 870° C., 870° C. and 880° C., 880° C. and 890° C., 890° C. and 900° C., 900° C. and 910° C., 910° C. and 920° C., 920° C. and 930° C., 930° C. and 940° C., or 940° C. and 950° C. In some embodiments, the heat treatment first step predetermined temperature 470 can be 895° C., 896° C., 897° C., 898° C., 899° C., 900° C., 901° C., 902° C., 903° C., 904° C., or 905° C. In one example, the predetermined temperature 470 in the first step of the heat treatment process can be approximately 900° C. The club head assembly 30 is then quenched in an inert gas pressurized environment. In some embodiments the pressure can be 1 Bar, 2 Bar, 3 Bar, 4 Bar, 5 Bar, 6 Bar, 7 Bar, 8 Bar, 9 Bar, 10 Bar, 10 Bar, 11 Bar, 12 Bar, 13 Bar, 14 Bar, 15 Bar, 16 Bar, 17 Bar, 18 Bar, 19 Bar, or 20 Bar. In one example the pressure in the pressurized environment is 1 Bar. The heat treatment second step is an aging process that involves heating the club head assembly 30 to a temperature between 570° C. and 640° C. for approximately 8 hours. In some embodiments, the heat treatment second step temperature can be between 570° C. and 580° C., 580° C. and 590° C., 590° C. and 600° C., 600° C. and 610° C., 610° C. and 620° C., 620° C. and 630° C., or 630° C. and 640° C. In one example, the predetermined temperature in the first step of the heat treatment process can be approximately 590° C. The club head assembly is then allowed to cool to room temperature via air cooling. In some embodiments, the club head assembly 30 is briefly jet cooled with an inert gas prior to air cooling in order to expedite the cooling process.

In one embodiment TSG3 may have a total weight percent of α-stabilizer aluminum between 6.0 wt % to 7.0 wt %, a total weight percent of α-stabilizer oxygen less than or equal to 0.15 wt %, a total weight percent of β-stabilizer molybdenum between 1.0 wt % and 2.0 wt %, a total weight percent of β-stabilizer vanadium between 3.0 wt % and 5.0 wt %, a total weight percent of β-stabilizer silicon between 0.0 wt % and 0.2 wt %, and a total weight percent of β-stabilizer iron between 0.2 wt % and 0.8 wt %. In one example, TSG3 may have a total weight percent of α-stabilizer aluminum of 6.46 wt %, a total weight percent of α-stabilizer oxygen less than or equal to 0.15 wt %, a total weight percent of β-stabilizer molybdenum of 2.25 wt %, a total weight percent of β-stabilizer vanadium of 4.40 wt %, a total weight percent of β-stabilizer silicon of 0.14 wt %, and a total weight percent of β-stabilizer iron of 0.34 wt %. In another example, TSG3 may have a total weight percent of α-stabilizer aluminum of 6.30 wt %, a total weight percent of α-stabilizer oxygen less than or equal to 0.15 wt %, a total weight percent of β-stabilizer molybdenum of 1.50 wt %, a total weight percent of β-stabilizer vanadium of 4.00 wt %, a total weight percent of β-stabilizer silicon of 0.15 wt %, and a total weight percent of β-stabilizer iron of 0.40 wt %. TSG3 may undergo a series of mechanical manufacturing steps to achieve the desired shape as described above. During the mechanical manufacturing process, TSG3 is heated to a predetermined temperature 470 between 900° C. and 1000° C. prior to the cross-rolling step. In some embodiments, the predetermined temperature 470 can be between 900° C. and 910° C., 910° C. and 920° C., 920° C. and 930° C., 930° C. and 940° C., 940° C. and 950° C., 950° C. and 960° C., 960° C. and 970° C., 970° C. and 980° C., 980° C. and 990° C., or 990° C. and 1000° C. In some embodiments, the predetermined temperature 470 can be 945° C., 946° C., 947° C., 948° C., 949° C., 950° C., 951° C., 952° C., 953° C., 954° C., or 955° C. In one example, BE α-β Ti alloy TSG3 is heated to a predetermined temperature 470 of 950° C. prior to the cross-rolling step.

After the faceplate 14 is formed and welded to the club head, the club head assembly may undergo a two-step heat treatment, wherein the first step is a solution annealing process that involves heating the club head assembly 30 to a predetermined temperature 470, near the solvus temperature 468, between 850° C. and 950° C. for approximately 1 hour. In some embodiments, the heat treatment first step predetermined temperature 470 can be between 850° C. and 860° C., 860° C. and 870° C., 870° C. and 880° C., 880° C. and 890° C., 890° C. and 900° C., 900° C. and 910° C., 910° C. and 920° C., 920° C. and 930° C., 930° C. and 940° C., or 940° C. and 950° C. In some embodiments, the heat treatment first step predetermined temperature 470 can be 895° C., 896° C., 897° C., 898° C., 899° C., 900° C., 901° C., 902° C., 903° C., 904° C., or 905° C. In one example, the predetermined temperature 470 in the first step of the heat treatment process can be approximately 900° C. The club head assembly 30 is then quenched in an inert gas pressurized environment. In some embodiments the pressure can be 1 Bar, 2 Bar, 3 Bar, 4 Bar, 5 Bar, 6 Bar, 7 Bar, 8 Bar, 9 Bar, 10 Bar, 10 Bar, 11 Bar, 12 Bar, 13 Bar, 14 Bar, 15 Bar, 16 Bar, 17 Bar, 18 Bar, 19 Bar, or 20 Bar. In one example the pressure in the pressurized environment is 1 Bar. The heat treatment second step is an aging process that involves heating the club head assembly 30 to a temperature between 590° C. and 650° C. for approximately 4 hours. In some embodiments, the heat treatment second step temperature can be between 590° C. and 600° C., 600° C. and 610° C., 610° C. and 620° C., 620° C. and 630° C., 630° C. and 640° C., 640° C. and 650° C. In one example, the predetermined temperature in the first step of the heat treatment process can be approximately 620° C. The club head assembly is then allowed to cool to room temperature via air cooling. In some embodiments, the club head assembly 30 is briefly jet cooled with an inert gas prior to air cooling in order to expedite the cooling process.

TSG3 is expected to display improved durability properties than an enhanced Ti alloy, such as Ti-9S. In a durability analysis, a golf club head assembly 30 including a faceplate 14 composed of TSG3 is expected to require up to 3800 strikes in an air cannon before failure. When the minimum and maximum face thickness are reduced by up to 25%, the golf club head assembly 30 comprising the TSG3 faceplate 14 is expected to require between 3300 strikes and 3600 strike in an air cannon before failure.

Table 1, shown below, summarizes the compositions of TSG1, TSG2, and TSG3, as described above. Table 2, shown below, summarizes mechanical properties of TSG1, TSG2, and TSG3, including: tensile strength, yield strength, density, minimum elongation, Young's modulus, and thickness.

TABLE 1

Chart Summarizing the Compositions of TSG1, TSG2, and TSG3.

| | V (wt %) | Mo (wt %) | Si (wt %) | Fe (wt %) | Al (wt %) | O (wt %) | C (wt %) | N (wt %) | H (wt %) |
|---|---|---|---|---|---|---|---|---|---|
| TSG1 | 1.5-3.5 | 0.75-1.75 | 0.1-0.2 | 0.2-0.3 | 5.0-7.0 | 0.15 MAX | 0.08 MAX | 0.05 MAX | 0.015 MAX |
| TSG2 | 3.5-5.5 | 1.5-2.5 | 0.1-0.2 | 0.5-1.0 | 6.0-8.0 | 0.15 MAX | 0.10 MAX | 0.05 MAX | 0.015 MAX |
| TSG3 | 3.0-5.0 | 1.0-2.0 | 0.1-0.2 | 0.2-0.8 | 6.0-7.0 | 0.15 MAX | 0.10 MAX | 0.05 MAX | 0.015 MAX |

TABLE 2

Chart Summarizing the Mechanical Properties of TSG1, TSG2, and TSG3

| | Tensile Strength (ksi) | Yield Strength (ksi) | Density (g/cm^2) | Minimum Elongation (%) | Young's Modulus (Mpsi) | Minimum Faceplate 14 Thickness (inch) |
|---|---|---|---|---|---|---|
| TSG1 | 157-170 | 150-160 | 4.413 | 4.5-8.0 | 15.4-16.9 | 0.065 |
| TSG2 | 163-175 | 155-170 | 4.423 | 4.5-7.0 | 15.5-17.0 | 0.065 |
| TSG3 | 157-170 | 150-160 | 4.416 | 4.5-8.0 | 15.4-16.9 | 0.065 |

In one embodiment, the BE α-β Ti alloy can have less than 5.25 wt % of vanadium, but greater than 1.00 wt %, greater than 1.25 wt %, greater than 1.50 wt %, greater than 1.75 wt %, greater than 2.00 wt % V, greater than 2.25 wt %, greater than 2.50 wt %, greater than 2.75 wt %, greater than 3.00 wt %, greater than 3.00 wt %, greater than 3.25 wt %, greater than 3.50 wt %, or greater than 4.75 wt %, or greater than 5.00 wt % vanadium.

In one embodiment, the BE α-β Ti alloy can have less than 2.30 wt % of molybdenum, but greater than 0.50 wt %, greater than 0.60 wt %, greater than 0.70 wt %, greater than 0.80 wt %, greater than 0.90 wt %, greater than 1.00 wt %, greater than 1.10 wt %, greater than 1.20 wt %, greater than 1.30 wt %, greater than 1.40 wt %, greater than 1.50 wt %, greater than 1.60 wt %, greater than 1.70 wt %, greater than 1.80 wt %, greater than 1.90 wt %, greater than 2.00 wt %, greater than 2.10 wt %, or greater than 2.20 wt %.

In one embodiment, the BE α-β Ti alloy can have less than 2.30 wt % of molybdenum, but greater than 0.50 wt %, greater than 0.60 wt %, greater than 0.70 wt %, greater than 0.80 wt %, greater than 0.90 wt %, greater than 1.00 wt %, greater than 1.10 wt %, greater than 1.20 wt %, greater than 1.30 wt %, greater than 1.40 wt %, greater than 1.50 wt %, greater than 1.60 wt %, greater than 1.70 wt %, greater than 1.80 wt %, greater than 1.90 wt %, greater than 2.00 wt %, greater than 2.10 wt %, or greater than 2.20 wt %.

In one embodiment, the BE α-β Ti alloy can have less than 7.0 wt % aluminum, but greater than 4.0 wt %, greater than 4.25 wt %, greater than 4.5 wt %, greater than 4.75 wt %, greater than 5.0 wt %, greater than 5.25 wt %, greater than 5.5 wt %, greater than 5.75 wt %, greater than 6.0 wt %, greater than 6.25 wt %, or greater than 6.5 wt % aluminum.

In one embodiment, the BE α-β Ti alloy can have less than 0.8 wt % iron, but greater than 0.1 wt %, greater than 0.2 wt % greater than 0.3 wt %, greater than 0.4 wt %, or greater than 0.5 wt % iron.

EXAMPLES

I. Example 1: A Golf Club Head Having a TSG1 Faceplate

Described herein is an exemplary embodiment of a club head assembly comprising a club head and a faceplate, wherein the faceplate further comprises TSG1, a BE α-β Ti alloy. The mechanical properties of the TSG1 were determined by the chemical makeup, the manufacturing processes the material underwent, as well as the heat treatment the material underwent.

TABLE 3

Chart Showing the Compositions of TSG1 and Ti-9S.

| | V (wt %) | Mo (wt %) | Si (wt %) | Fe (wt %) | Al (wt %) | O (wt %) | C (wt %) | N (wt %) | H (wt %) |
|---|---|---|---|---|---|---|---|---|---|
| TSG1 | 1.5-3.5 | 0.75-1.75 | 0.1-0.2 | 0.2-0.3 | 5.0-7.0 | 0.15 MAX | 0.08 MAX | 0.05 MAX | 0.015 MAX |
| Ti-9S | 1.0-2.0 | trace | 0.2 MAX | 0.3 MAX | 6.5-8.5 | 0.20 MAX | 0.08 MAX | trace | trace |

The total weight percent of α-stabilizer aluminum in TSG1 α-β Ti alloy was 6.0 wt %. The total weight percent of α-stabilizer oxygen in TSG1 α-β Ti alloy was less than or equal to 0.15 wt %. The total weight percent of β-stabilizer molybdenum in TSG1 α-β Ti alloy was 1.25 wt %. The total weight percent of β-stabilizer vanadium in TSG1 α-β Ti alloy was 2.5 wt % The total weight percent of β-stabilizer silicon in TSG1 α-β Ti alloy was 0.15 wt %. The total weight percent of β-stabilizer iron in TSG1 α-β Ti alloy was 0.25 wt %. Other elements included are carbon, nitrogen, and hydrogen. The total weight percent of carbon in TSG1 α-β Ti alloy was less than or equal to 0.08 wt %. The total weight percent of nitrogen in TSG1 α-β Ti alloy was less than or equal to 0.05 wt %. The total weight percent of hydrogen in TSG1 α-β Ti alloy was less than or equal to 0.015 wt %. Titanium made up the remaining weight percentage of TSG1 α-β Ti alloy. The density of the TSG1 α-β Ti alloy as described above was 4.413 g/cm$^3$.

Figure 10:
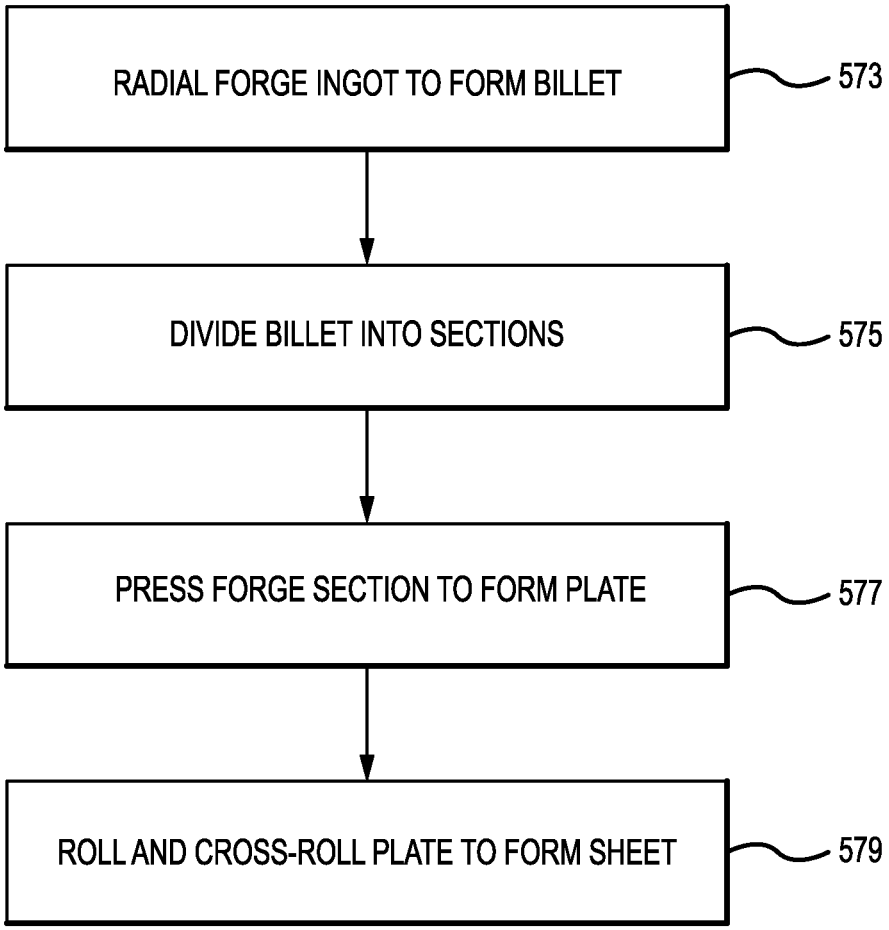
FIG. 10 is a schematic view of a process for forming a sheet from an ingot.

The mechanical properties of TSG1 α-β Ti alloy were further enhanced by the manufacturing process and the two-step heat treatment process, as described below. As seen in FIG. 10, the first step 573 involved an ingot being heated to a predetermined temperature 470 and then radial forging it into a billet. In the second step 575, the billet was sliced into sections. In the third step 577, the sections were then press forged to achieve a plate with a desirable plate thickness. In a fourth step 579, a sheet was formed by heating the plate to a temperature of approximately 900° C. and cross rolling it until a desired sheet thickness was achieved. The sheet then underwent further manufacturing steps (detailed below) to form the desired shape of the faceplate.

FIG. 11 shows the process for forming a faceplate from the sheet. In the first step 673, a laser cut roughly the shape of a faceplate out of the sheet, creating a cutout. In some embodiments, CNC machining was used to machine multiple notches or tabs in the cutout. In other embodiments, the cutout were left without notches. The second step 675 involved raw stamping the cutout at a specified temperature to form the faceplate. The third step 677 involved CNC machining the front and side walls of the faceplate to include details such as grooves and milling or other texture. In the fourth step 679, the faceplate was sandblasted and finished by laser etching. The faceplate was then secured to the club head by means of plasma welding, thereby creating a club head assembly.

The chemical makeup of the TSG1 α-β Ti alloy allowed the club head assembly to undergo the two-step heat treatment. The first step of the heat treatment was a solution annealing heat treatment. This step greatly increased the strength of the material. The club head assembly was heated to a temperature of 900° C. for 1 hour. Heating the material to the aforementioned temperature, just below the solvus temperature, transitions the material into the β phase, allowing the α-β microstructure of the material to begin to transition into a β microstructure. The club head assembly was then immediately quenched in a pressurized inert gas environment, wherein the inert gas was nitrogen, and the pressure of the environment was 1 Bar. Cooling the material as quickly as possible captures the most microstructures in the in-between phase of martensite. The microstructures of the material when in martensite are more compact, ensuring the grain sizes remain as small as possible, greatly increasing the strength.

After the club head assembly underwent the first heat treatment step, as described above, it underwent a second heat treatment step involving a form of aging. In this step, the club head assembly was heated to a temperature of 620° C. for 4 hours. The club head assembly was then allowed to air cool to room temperature. Heating the club assembly at this lower temperature for a longer period of time softens the material making it more workable again.

The mechanical properties of the material can be attributed to the chemical composition of the TSG1 α-β Ti alloy, the mechanical process, and the two-step heat treatments. TSG1 α-β Ti alloy had a density of 4.416 g/cm$^2$, a yield strength between 150 ksi and 170 ksi, a tensile strength between 157 ksi and 170 ksi, a minimum elongation between 4.5% and 8.0%, and a young's modulus between 15.4 Mpsi and 16.9 Mpsi.

The faceplate comprising TSG1 had a minimum thickness and maximum thickness that was 0.007 inch thinner than the faceplate comprising Ti-9S. Each faceplate had the same construction and were made to fit the same club head body.

II. Example 2: A Golf Club Head Having a TSG3 Faceplate

Further, described herein is an exemplary embodiment of a club head assembly comprising a club head and a faceplate, wherein the faceplate further comprises TSG3, a BE α-β Ti alloy. The mechanical properties of the TSG3 were determined by the chemical makeup, the manufacturing processes the material underwent, as well as the heat treatment the material underwent.

The total weight percent of α-stabilizer aluminum in TSG3 α-β Ti alloy was 6.30 wt %. The total weight percent of α-stabilizer oxygen in TSG3 α-β Ti alloy was less than 0.15 wt %. The total weight percent of β-stabilizer molybdenum in TSG3 α-β Ti alloy was 1.50 wt %. The total weight percent of β-stabilizer vanadium in TSG3 α-β Ti alloy was 4.00 wt % The total weight percent of β-stabilizer silicon in TSG3 α-β Ti alloy was 0.15 wt %. The total weight percent of β-stabilizer iron in TSG3 α-β Ti alloy was 0.40 wt %. Other elements included are carbon, nitrogen, and hydrogen. The total weight percent of carbon in TSG3 α-β Ti alloy was less than 0.10 wt %. The total weight percent of nitrogen in TSG3 α-β Ti alloy was less than 0.05 wt %. The total weight percent of hydrogen in TSG3 α-β Ti alloy was less than 0.015 wt %. Titanium made up the remaining weight percentage of TSG3 α-β Ti alloy. This chemical makeup allowed the material to have a high strength and ductility while still having a desirable density. The density of the TSG3 α-β Ti alloy, as described above, was 4.416 g/cm$^3$.

The mechanical properties of TSG3 α-β Ti alloy were further enhanced by undergoing the manufacturing process and two-step heat treatment process, as described below. As seen in FIG. 10, the first step involved an ingot being heated to a predetermined temperature 470 and radial forging it into a billet. In the second step 575, the billet was sliced into sections. In the third step, the sections were then press forged to achieve a plate with a desirable plate thickness. In a fourth step 579, a sheet was formed by heating the plate to a temperature of approximately 900° C. and cross rolling it until a desired sheet thickness was achieved. The sheet then underwent further manufacturing steps (detailed below) to ultimately form the desired final shape.

FIG. 11 shows the process for forming a faceplate from the sheet. In the first step, a laser cut roughly the shape of a faceplate out of the sheet, creating a cutout. In some embodiments, CNC machining was then used to machine multiple notches or tabs in the cutout. In other embodiments, the cutout was left without notches. The second step involved raw stamping the cutout at a specified temperature to form the faceplate. The third step involved CNC machining the front and side walls of the faceplate to include details such as grooves and milling or other texture. In the fourth step, the faceplate was sandblasted and finished by laser etching. The faceplate was then secured to the club head by means of plasma welding, thereby creating a club head assembly.

The chemical makeup of the TSG3 α-β Ti alloy allowed the club head assembly to undergo a two-step heat treatment to further enhance the mechanical properties. The first step of the heat treatment was a solution annealing heat treatment. This step greatly increased the strength of the material. The club head assembly was heated to a temperature of 900° C. for 1 hour. Heating the material to the aforementioned temperature, just below the solvus temperature, transitions the material into the β phase, allowing the α-β microstructure of the material to begin to transition into a β microstructure. The club head assembly was then immediately quenched in a pressurized inert gas environment, wherein the inert gas was nitrogen, and the pressure of the environment was 1 Bar. Cooling the material as quickly as possible captures the most microstructures in the in-between phase of martensite. The microstructures of the material when in martensite are more compact, ensuring the grain sizes remain as small as possible, greatly increasing the strength.

After the club head assembly underwent the first heat treatment step, as described above, it underwent a second heat treatment step involving a form of aging. In this step the club head assembly was heated to a temperature of 620° C. for 4 hours. The club head assembly was then allowed to air cool to room temperature. Heating the club assembly at this lower temperature for a longer period of time softened the material making it more workable again.

The mechanical properties of the material can be attributed to the chemical composition of the TSG3 α-β Ti alloy, the mechanical process, and the heat treatments the material undergoes. TSG3 α-β Ti alloy had a density of 4.416 g/cm$^2$, a yield strength between 150 ksi and 170 ksi, a tensile strength between 157 ksi and 170 ksi, a minimum elongation between 4.5% and 8.0%, and a young's modulus between 15.4 Mpsi and 16.9 Mpsi.

III. Example 3: Mechanical Properties of TSG2 and Significance of Cross-Rolling Temperature Further, described herein is an exemplary embodiment of a club head assembly comprising a club head and a faceplate, wherein the faceplate further comprises TSG2, a BE α-β Ti alloy. The mechanical properties of the TSG2 were determined by the chemical makeup, the manufacturing processes the material underwent, as well as the heat treatment the material underwent.

The total weight percent of α-stabilizer aluminum in TSG2 α-β Ti alloy was 8.0 wt %. The total weight percent of α-stabilizer oxygen in TSG2 α-β Ti alloy was less than or equal to 0.15 wt %. The total weight percent of β-stabilizer molybdenum in TSG2 α-β Ti alloy was 2.50 wt %. The total weight percent of β-stabilizer vanadium in TSG2 α-β Ti alloy was 5.5 wt % The total weight percent of β-stabilizer silicon in TSG2 α-β Ti alloy was 0.20 wt %. The total weight percent of β-stabilizer iron in TSG2 α-β Ti alloy was 1.0 wt %. Other elements included are carbon, nitrogen, and hydrogen. The total weight percent of carbon in TSG2 α-β Ti alloy was less than or equal to 0.10 wt %. The total weight percent of nitrogen in TSG2 α-β Ti alloy was less than or equal to 0.05 wt %. The total weight percent of hydrogen in TSG2 α-β Ti alloy was less than or equal to 0.015 wt %. Titanium made up the remaining weight percentage of TSG2 α-β Ti alloy. The density of the TSG2 α-β Ti alloy as described above was 4.423 g/cm$^3$.

Unlike TSG1, as described above, and TSG3, as described below, the mechanical properties of TSG2 reacted unexpectedly when it underwent the manufacturing process, as described above, in summary it became extremely brittle due the increased levels of β-stabilizers and α-stabilizer.

In the fourth step of the manufacturing process, as described above, the material undergoes a cross-rolling step that is simar to that underwent by TSG1 and TSG3, as described above and below. However, due to the chemical make-up of TSG2 specifically due to the increase in the β-stabilizers (V, Mo, Fe, Si) and possibly due α-stabilizer (A) by a least 0.5 wt % to 1 wt % of the aforementioned elements, TSG2 lost its yield strength over the TSG1 and TSG3 samples. Specifically, the yield strength for TSG2 is much lower than TSG1 and TSG3 (approximately 80 ksi lower than TSG1 and approximately 133 ksi lower than TSG3) and caused brittleness of TSG2. TSG2 also exhibited lower tensile strength (approximately 44 ksi lower than TSG1 and approximately 56 ksi lower than TSG3). Both of these key mechanical differences were due to the difference in chemistry described above and further is believed this is due the increased grain size caused by the increased levels of β-stabilizers (V, Mo, Fe, Si) and possibly due α-stabilizer, as previously mentioned.

TABLE 4

Chart Showing a Comparison of Yield and Tensile Strength of TSG1, TSG2, an TSG3

| | Tensile Strength (ksi) | Yield Strength (ksi) |
|---|---|---|
| TSG1 | 146.6 | 141 |
| TSG2 | 102.3 | 21.2 |
| TSG3 | 158.6 | 153.33 |

IV. Example 4: Mechanical Properties of TSG3 Compared to Traditional Ti Alloy (Ti-9S)

Further described herein is a comparison between TSG3, as described above in Example 2, and a more traditional Ti alloy (herein referred to as "Ti-9S"). Ti-9S is an α-β titanium (α-β Ti) alloy. Ti-9S may contain α stabilizers, β-stabilizers, as well as neutral alloying elements. The main differences between in the aforementioned materials include the following: the chemical makeup of the material itself, the mechanical process the material underwent to arrive at the desired shape and thickness, and the heat treatment process the material underwent. These differences directly affected the mechanical properties of the materials.

As stated above Ti-9S may contain α stabilizers, β-stabilizers, as well as neutral alloying elements. Ti-9S may contain neutral alloying elements such as tin, α stabilizers such as aluminum and oxygen, and β-stabilizers such as molybdenum, silicon, iron, and vanadium. Ti-9S may contain trace amounts of other elements such as, copper, and zirconium. As shown below in Table 1, Ti-9S has a much higher wt % of α stabilizers, specifically aluminum. This high wt % of α stabilizers restricts what mechanical processes and heat treatments could be applied to the material to arrive at the desired mechanical proletaries.

TABLE 5

Chart Showing the Compositions of TSG3 and Ti-9S.

| | V (wt %) | Mo (wt %) | Si (wt %) | Fe (wt %) | Al (wt %) | O (wt %) | C (wt %) | N (wt %) | H (wt %) |
|---|---|---|---|---|---|---|---|---|---|
| TSG3 | 3.0-5.0 | 1.0-2.0 | 0.1-0.2 | 0.2-0.8 | 6.0-7.0 | 0.15 MAX | 0.10 MAX | 0.05 MAX | 0.015 MAX |
| T1-9S | 1.0-2.0 | trace | 0.2 MAX | 0.3 MAX | 6.5-8.5 | 0.20 MAX | 0.08 MAX | trace | trace |

Due to the chemical make-up of Ti-9S, specifically the wt % of α stabilizers, Ti-9S underwent a slightly different mechanical process to achieve the desired shape and thickness. Unlike TSG3, Ti-9S underwent a more traditional forging process. As stated above, in the first step TSG3 underwent a radial forging step to ensure the grain structures remains as uniform as possible. Ti-9S on the other hand underwent a more traditional bar rolling form of forging wherein pressure was applied to the top and bottom of the ingot to form a billet. This caused the grain structure to elongate in a specific direction. As stated above, grain boundaries disrupt the deformation a material undergoes when an external force is applied. The more grain boundaries the external force contacts the less the material deforms, therefore the more grain boundaries the stronger the material. When the grain structure was elongated during this step it strengthened the material in one direction but weakened the material in the other direction. Due to the way the faceplate was made and oriented on the golf club head, the force created by hitting a golf ball travel through the material in the direction the gains have been elongated. Therefore, the grain structure in the billet created by the radial forging step, as opposed to the more traditional bar rolling step, are more symmetrical and therefore, more desirable for this application.

This step was then followed by the remaining mechanical process, similar to those described above and are as follows: in the second step the billet was sliced into sections. The sections were then press forged to achieve a plate with a desirable plate thickness. A sheet was formed by heating the plate to a temperature of approximately 900° C. and cross rolling it until a desired sheet thickness was achieved. The sheet then underwent further manufacturing steps to form the desired shape of the faceplate. In the first step, a laser cut roughly the shape of a faceplate out of the sheet, creating a cutout. In the second step CNC machining was used to machine multiple notches or tabs in the cutout. In some embodiments, the second step was be skipped. The third step involved raw stamping the cutout at a specified temperature to form the faceplate. The fourth step involved CNC machining the front and side walls of the faceplate to include details such as grooves and milling or other texture. In the fifth step, the faceplate was sandblasted. Finally, the sixth step involved finishing the faceplate by laser etching. The faceplate was then secured to the club head by means of plasma welding creating a club head assembly.

The heat treatment applied to Ti-9S is very different from the heat treatment applied to TSG3. Due to the chemical make-up of Ti-9S, specifically the higher wt % of α stabilizers, the strength of Ti-9S cannot be increased by means of any type of heat treatment. If Ti-9S were to undergo certain heat treatments, such as the two-step heat treatment process as described above, and particularly the quenching step, the wt % of aluminum in the material would cause the material to become much to brittle to be workable/useable.

A faceplate made of Ti-9S was heated to a temperature above the solvus temperature, after the faceplate is welded to the club head. The club head assembly featuring the faceplate made of Ti-9S was heated to a temperature above the solvus temperature for at least 1.5 hours and up to 6 hours. This was done to relieve the stresses in the faceplate and the stress between the weld and the metal matrix of the club head. This process further was done to improve the toughness or durability of the faceplate, wherein the improved toughness permits the faceplate to be made thinner without sacrificing durability, thereby reducing club head weight. This step did not increase the strength of the Ti-9S faceplate it relived the stress created by welding the faceplate to the club head.

Due to the balance of α stabilizers and β-stabilizers in TSG3 the strength of the material may be manipulated by heat treatment. In the first step of the two-step heat treatment process the strength of the material was greatly increased by freezing the microstructures in the in-between state of martensite. The second step softened the material, making it more workable and increasing the minimum elongation and ductility. The combination of α, β stabilizers, as discussed above, along with the two-step heat treatment, as discussed below, allowed the TSG3 to obtain the desirable balance of strength, fracture toughness, and ductility. This two-step heat treatment process along with the mechanical process and chemical make-up, as discussed above, allowed the TSG3 to be a much more versatile material, in such a way that the material could be easily manipulated to achieve the desired mechanical properties. As shown below, in Table 2 the BE α-β titanium (TSG1, TSG2, and TSG3) comprise similar or increased levels of strength to a more traditional alpha enhanced α-β titanium (TI-9S) while providing a thinner minimum faceplate thickness.

The faceplate comprising TSG3 had a minimum thickness and maximum thickness that was 0.007 inch thinner than the faceplate comprising Ti-9S. Each faceplate had the same construction and were made to fit the same club head body.

TABLE 5

Chart Showing the Mechanical Properties of Various α-β Ti alloys.

| | Tensile Strength (ksi) | Yield Strength (ksi) | Density (g/cm^2) | Minimum Elongation (%) | Young's Modulus (Mpsi) | Minimum Faceplate Thickness (inch) |
|---|---|---|---|---|---|---|
| TSG1 | 157-170 | 150-160 | 4.413 | 4.5-8.0 | 15.4-16.9 | 0.065 |
| TSG2 | 163-175 | 155-170 | 4.423 | 4.5-7.0 | 15.5-17.0 | 0.065 |
| TSG3 | 157-170 | 150-160 | 4.416 | 4.5-8.0 | 15.4-16.9 | 0.065 |
| Ti-9S | 145-155 | 135-145 | 4.318 | 7.0-12.0 | 15.2-16.8 | 0.85 |

Example 4: Durability Studies of TSG1 Compared to Traditional Ti Alloy (Ti-9S)

Further described herein is a comparative analysis between a golf club head comprising a faceplate composed of the TSG1 alloy, as described above in Example 1, and a more traditional Ti alloy (herein referred to as "Ti-9S"). Ti-9S is an α-β titanium (α-β Ti) alloy. Ti-9S may contain α stabilizers, β-stabilizers, as well as neutral alloying elements. The main differences between in the aforementioned materials include the following: the chemical makeup of the material itself, the mechanical process the material undergoes to arrive at the desired shape and thickness, and the heat treatment process the material undergoes. These differences can directly affect the mechanical properties of the materials.

An analysis is performed to compare the durability of faceplate when composed of either the TSG1 alloy or the Ti-9S alloy. The analysis provides the expected number of strikes from an air cannon until failure of the faceplate. One club head assembly comprises the Ti-9S alloy as the faceplate material. A second club head assembly comprises the same club head with the TSG1 alloy as the faceplate material.

The club head assembly with the TSG1 alloy faceplate shows increased durability over assemblies with Ti-9S alloy faceplates. In a first analysis, the thickness profile between each faceplate is identical. When the thickness profile is identical for each faceplate, the TSG1 faceplate club head requires between 300 and 600 more strikes from the air cannon than the Ti-9S faceplate club head before failure.

In a second analysis, the thickness profile of the TSG1 faceplate is between 10% and 25% thinner, or 0.003" to 0.007" thinner, than that of the Ti-9S faceplate. In this analysis, the thinner TSG1 faceplate club head requires between 100 and 400 more strikes from the air cannon than the Ti-9S faceplate club head before failure. Additionally, the thinner TSG1 faceplate club head results in an expected increase in ball speed between 0.5 mph and 1.0 mph.

V. Example 5: Durability Studies of TSG3 Compared to Traditional Ti Alloy (Ti-9S)

Further described herein is a comparative analysis between a golf club head comprising a faceplate composed of the TSG3 alloy, as described above in Example 2, and a more traditional Ti alloy (herein referred to as "Ti-9S"). Ti-9S is an α-β titanium (α-β Ti) alloy. Ti-9S may contain α stabilizers, β-stabilizers, as well as neutral alloying elements. The main differences between in the aforementioned materials include the following: the chemical makeup of the material itself, the mechanical process the material undergoes to arrive at the desired shape and thickness, and the heat treatment process the material undergoes. These differences can directly affect the mechanical properties of the materials.

An analysis is performed to compare the durability of faceplate when composed of either the TSG3 alloy or the Ti-9S alloy. The analysis provides the expected number of strikes from an air cannon until failure of the faceplate. One club head assembly comprises the Ti-9S alloy as the faceplate material. A second club head assembly comprises the same club head with the TSG3 alloy as the faceplate material.

The club head assembly with the TSG3 alloy faceplate shows increased durability over assemblies with Ti-9S alloy faceplates. In a first analysis, the thickness profile between each faceplate is identical. When the thickness profile is identical for each faceplate, the TSG3 faceplate club head requires between 300 and 600 more strikes from the air cannon than the Ti-9S faceplate club head before failure.

In a second analysis, the thickness profile of the TSG3 faceplate is between 10% and 25% thinner, or 0.003" to 0.007" thinner, than that of the Ti-9S faceplate. In this analysis, the thinner TSG3 faceplate club head requires between 100 and 400 more strikes from the air cannon than the Ti-9S faceplate club head before failure. Additionally, the thinner TSG3 faceplate club head results in an expected increase in ball speed between 0.5 mph and 1.0 mph.

CLAUSES

Method Clauses

Clause 1: A method of forming a golf club head assembly, the method comprising:

(a) providing an ingot formed from an α-β titanium alloy, the α-β titanium alloy comprising between 5.0 wt % and 8.0 wt % aluminum (Al), between 1.0 wt % and 5.5 wt % Vanadium (V), and between 0.75 wt % and 2.5 wt % molybdenum (Mo).

(b) radial forging the ingot to form a billet;

(c) slicing the billet to form a section;

(d) press forging the section to form a plate;

(e) cross rolling the plate to form a sheet;

wherein the plate is heated to a temperature between 850° C. and 950° C. prior to cross rolling;

(f) laser-cutting the sheet to form a desired shape of a faceplate;

(f) aligning the faceplate with a recess of a club head;

(g) welding the faceplate to the club head;

(h) heating the club head and the faceplate to a temperature lower than a solvus temperature of the faceplate for a predetermined amount of time;

(i) allowing the club head and the faceplate to cool by an inert gas;

(j) heating the club head and the faceplate to a temperature between 500° C. and 700° C. for a predetermined amount of time; and (k) allowing the club head and faceplate to cool by an inert gas and by air.

Clause 2: The method of claim 1, wherein the α-β titanium alloy comprises between 6.0 wt % and 8.0 wt % aluminum (Al).

Clause 3: The method of clause 1, wherein the α-β titanium alloy comprises between 5.0 wt % to 7.0 wt % aluminum (Al).

Clause 4: The method of clause 1, wherein the α-β titanium alloy comprises between 6.0 wt % to 7.0 wt % aluminum (Al).

Clause 5: The method of clause 1, wherein the α-β titanium alloy further comprises between 0.0.2 wt % to 1.0 wt % iron (Fe), between 0.0 wt % to 0.2 wt % Silicon (Si) and 0.15 wt % or less oxygen (O).

Clause 6: The method of clause 1, wherein the welding of step (g) includes a pulse plasma welding process.

Clause 7: The method of clause 1, wherein the welding of step (g) includes a laser welding process.

Clause 8: The method of clause 1, wherein the inert gas of step (i) is selected from the group consisting of nitrogen (N), argon (Ar), helium (He), neon (Ne), krypton (Kr), and xenon (Xe), a compound gas thereof.

Clause 9: The method of clause 1, wherein the inert gas of step (i) is Nitrogen.

Clause 10: The method of clause 1, wherein the faceplate of step (e) has a minimum thickness of 0.065 inches.

Clause 11: The method of clause 1, wherein the faceplate of step (e) has a thickness between 0.065 inches and 0.100 inches.

Clause 12: The method of clause 1, wherein step (h) includes heating the club head and the faceplate between 800° C. and 950° C. for between 1 hour and 2 hours.

Clause 13: The method of clause 1, wherein step (h) includes heating the club head and the faceplate between 800° C. and 900° C. for between 1 hour and 2 hours.

Clause 14: The method of clause 1, wherein step (h) includes heating the club head and the faceplate at or below 950° C. for between 1 hour and 2 hours.

Clause 15: The method of clause 1, wherein step (j) includes heating the club head and the faceplate between 590° C. and 620° C. for between 1 hour and 2 hours.

Clause 16: The method of clause 1, wherein step (j) includes heating the club head and the faceplate at or below 620° C. for between 4 hours and 8 hours.

Clause 17: The method of clause 1, wherein step (a) the plurality of di rotate about a central axis of the ingot.

Clause 18: A method of forming a golf club head assembly, the method comprising: radial forging an ingot to form a billet; slicing the billet to form a plate; press forging the billet to form a plate; cross rolling the plate to form a sheet; laser-cutting the sheet to form a desired shape of a faceplate; providing a faceplate formed from an α-β titanium alloy, the α-β titanium alloy comprising between 5.0 wt % to 8.0 wt % aluminum (Al), less than or equal to 0.25 wt % oxygen (O), between 0.2 wt % to 1.0 wt % iron (Fe), between 0.0 wt % to 0.2 wt % Silicon (Si) to between 1.0 wt % to 5.5 wt % Vanadium (V), and between 0.75 wt % to 2.5 wt % molybdenum (Mo); aligning the faceplate with a recess of a club head; welding the faceplate to the club head; after welding the faceplate, heating the club head and the faceplate to a temperature that is less than a solvus temperature of the faceplate for a predetermined amount of time; allowing the club head and the faceplate to be quenched by an inert gas; heating the club head and the faceplate to a temperature between 500° C. and 700° C. for a predetermined amount of time; and allowing the club head and faceplate to cool by an inert gas and by air.

Clause 19: The method of clause 18, wherein the α-β titanium alloy comprises between 6.0 wt % to 8.0 wt % aluminum (Al).

Clause 20: The method of clause 18, wherein the α-β titanium alloy comprises between 5.0 wt % to 7.0 wt % aluminum (Al).

Clause 21: The method of clause 18, wherein the α-β titanium alloy comprises between 6.0 wt % to 7.0 wt % aluminum (Al).

Clause 22: The method of clause 18, wherein the α-β titanium alloy further comprises between 0.0.2 wt % to 1.0 wt % iron (Fe), between 0.0 wt % to 0.2 wt % Silicon (Si) and 0.15 wt % or less oxygen (O).

Clause 23: The method of clause 18, wherein the welding of step (g) includes a pulse plasma welding process.

Clause 24: The method of clause 18, wherein the welding of step (g) includes a laser welding process.

Clause 25: The method of clause 18, wherein the inert gas of step (i) is selected from the group consisting of nitrogen (N), argon (Ar), helium (He), neon (Ne), krypton (Kr), and xenon (Xe), a compound gas thereof.

Clause 26: The method of clause 18, wherein the inert gas of step (i) is Nitrogen.

Clause 27: The method of clause 18, wherein the faceplate has a minimum thickness of 0.065 inches.

Clause 28: The method of clause 18, wherein the faceplate has a thickness between 0.065 inches and 0.100 inches.

Clause 29: The method of clause 18, wherein step (h) includes heating the club head and the faceplate between 800° C. and 950° C. for between 1 hour and 2 hours.

Clause 30: The method of clause 18, wherein step (h) includes heating the club head and the faceplate between 800° C. and 900° C. for between 1 hour and 2 hours.

Clause 31: The method of clause 18, wherein the club head and the faceplate at or below 950° C. for between 1 hour and 2 hours.

Clause 32: The method of clause 18, wherein the club head and the faceplate are heated between 590° C. and 620° C. for between 1 hour and 2 hours.

Clause 33: The method of clause 1, wherein the club head and the faceplate at or below 620° C. for between 4 hours and 8 hours.

Composition Clauses

Clause 1: A titanium alloy comprising: a α-β titanium alloy; wherein the α-β titanium alloy comprises between 5.0 wt % and 8.0 wt % aluminum (Al), between 1.0 wt % and 5.5 wt % Vanadium (V), and between 0.75 wt % and 2.5 wt % molybdenum (Mo) a density; wherein the density is between 4.35 g/cc and 4.50 g/cc.

Clause 2: The titanium alloy of clause 1, wherein the α-β titanium alloy comprises between 0.2 wt % and 1.0 wt % iron (Fe), between 0.1 wt % and 0.2 wt % Silicon (Si) and 0.25 wt % or less oxygen (O).

Clause 3: The titanium alloy of clause 1, wherein the α-β titanium alloy comprises between 6.0 wt % and 8.0 wt % aluminum (Al).

Clause 4: The titanium alloy of clause 1, wherein the α-β titanium alloy comprises between 5.0 wt % to 7.0 wt % aluminum (Al).

Clause 5: The titanium alloy of clause 1, wherein the α-β titanium alloy comprises between 6.0 wt % to 7.0 wt % aluminum (Al).

Clause 6: The titanium alloy of clause 1, wherein the α-β titanium alloy comprises 0.25 wt % or less oxygen (O).

Clause 7: The titanium alloy of clause 1, wherein the α-β titanium alloy comprises 0.20 wt % or less oxygen (O).

Clause 8: The titanium alloy of clause 1, wherein the α-β titanium alloy comprises 0.15 wt % or less oxygen (O).

Clause 9: The titanium alloy of clause 1, wherein the α-β titanium alloy comprises between 1.5 wt % and 3.5 wt % vanadium (V).

Clause 10: The titanium alloy of clause 1, wherein the α-β titanium alloy comprises between 3.0 wt % and 5.0 wt % vanadium (V).

Clause 11: The titanium alloy of clause 1, wherein the α-β titanium alloy comprises between 3.5 wt % and 5.5 wt % vanadium (V).

Clause 12: The titanium alloy of clause 1, wherein the α-β titanium alloy comprises between 0.75 wt % and 1.75 wt % molybdenum (Mo).

The titanium alloy of claim 1, wherein the α-β titanium alloy comprises between 1.0 wt % and 2.0 wt % molybdenum (Mo).

Clause 13: The titanium alloy of clause 1, wherein the α-β titanium alloy comprises between 1.5 wt % and 2.5 wt % molybdenum (Mo).

Clause 14: The titanium alloy of clause 1, wherein the α-β titanium alloy comprises between 0.2 wt % and 0.3 wt % iron (Fe).

Clause 15: The titanium alloy of clause 1, wherein the α-β titanium alloy comprises between 0.2 wt % and 0.8 wt % iron (Fe).

Clause 16: The titanium alloy of clause 1, wherein the α-β titanium alloy comprises between 0.5 wt % and 1.0 wt % iron (Fe).

Clause 17: The titanium alloy of clause 1, wherein the α-β titanium alloy comprises a solvus temperature between 800 and 1000.

Clause 18: The titanium alloy of clause 1, wherein the α-β titanium alloy comprises a solvus temperature less than 930.

Clause 19: The titanium alloy of clause 1, wherein the α-β titanium alloy comprises a minimum yield strength between 150 ksi and 160 ksi.

Clause 20: The titanium alloy of clause 1, wherein the α-β titanium alloy comprises a minimum tensile strength between 157 ksi and 170 ksi.

Clause 21: The titanium alloy of clause 1, wherein the α-β titanium alloy comprises a minimum elongation between 4.5% and 8.0%.

Clause 22: The titanium alloy of clause 1, wherein the α-β titanium alloy comprises a minimum elongation less than 8.0%.

Clause 23: The titanium alloy of clause 1, wherein the α-β titanium alloy wherein the density is between 4.410 g/cc and 4.425 g/cc.

Clause 24: The titanium alloy of clause 1, wherein the α-β titanium alloy comprises a young's modulus between 15.4 Mpsi and 16.9 Mpsi.

Golf Club Head Clauses

Clause 1: A golf club head comprising: a crown; a sole opposite the crown; a toe end; a heel end opposite the toe end; a recess bounded by the crown, sole, toe end, and heel end; a faceplate configured to aligned, fit within, and be welded to the recess; wherein the faceplate comprises an α-β titanium alloy comprising between 5 wt % to 8 wt % aluminum (Al), 0.75 wt % to 2.5 wt % molybdenum, approximately 0.2 wt % to 1.0 wt % iron, and approximately 1.5 wt % to 5.5 wt % vanadium, approximately 0.1 wt % to 0.2 wt % silicon, less than 0.15 wt % oxygen, and the remaining weight percent is titanium (Ti); wherein the golf club head is heated to a temperature less than a solvus temperature of the faceplate for a predetermined amount of time and cooled in an inert gas; wherein the faceplate comprises a minimum thickness between 0.065-0.100 inches.

Clause 2: The titanium alloy of clause 1, wherein the α-β titanium alloy wherein the density is between 4.410 g/cc and 4.425 g/cc.

Clause 3: The titanium alloy of clause 1, wherein the α-β titanium alloy comprises a young's modulus between 15.4 Mpsi and 16.9 Mpsi.

Clause 4: The golf club head of clause 1, wherein the α-β titanium alloy comprises between 0.75 wt % and 1.75 wt % molybdenum (Mo).

Clause 5: The golf club head of clause 4, wherein the α-β titanium alloy comprises between 0.2 wt % and 0.3 wt % iron (Fe), between 0.1 wt % and 0.2 wt % Silicon (Si), between 1.5 wt % and 3.5 wt % Vanadium (V), and between 5.0 wt % and 7.0 wt % aluminum (Al).

Clause 6: The golf club head of clause 4, wherein the α-β titanium alloy comprises less than 0.08 wt % of carbon, less than 0.05 wt % of nitrogen, and less than 0.015 wt % or hydrogen.

Clause 7: The golf club head of clause 4, wherein the α-β titanium alloy comprises a solvus temperature between 800° C. and 1000° C.

Clause 8: The golf club head of clause 7, wherein the α-β titanium alloy comprises a solvus temperature less than 930° C.

Clause 9: The golf club head of clause 4, wherein the α-β titanium alloy comprises a minimum yield strength between 150 ksi and 160 ksi.

Clause 10: The golf club head of clause 4, wherein the α-β titanium alloy comprises a minimum tensile strength between 157 ksi and 170 ksi.

Clause 11: The golf club head of clause 4, wherein the α-β titanium alloy comprises a minimum elongation between 4.5% and 8.0%.

Clause 12: The golf club head of clause 4, wherein the α-β titanium alloy wherein a density is between 4.410 g/cc and 4.425 g/cc.

Clause 13: The golf club head of clause 12, wherein the density is 4.413 g/cc.

Clause 14: The golf club head of clause 4, wherein the α-β titanium alloy comprises a young's modulus between 15.4 Mpsi and 16.9 Mpsi.

Clause 15: The golf club head of clause 1, wherein the α-β titanium alloy comprises between 1.50 wt % and 2.5 wt % molybdenum (Mo).

Clause 16: The golf club head of clause 15, wherein the α-β titanium alloy comprises between 0.5 wt % and 1.0 wt % iron (Fe), between 0.1 wt % and 0.2 wt % Silicon (Si), between 3.5 wt % and 5.5 wt % Vanadium (V), and between 5.0 wt % and 7.0 wt % aluminum (Al).

Clause 17: The golf club head of clause 15, wherein the α-β titanium alloy comprises less than 0.10 wt % of carbon, less than 0.05 wt % of nitrogen, and less than 0.015 wt % or hydrogen.

Clause 18: The golf club head of clause 15, wherein the α-β titanium alloy comprises a solvus temperature between 800° C. and 1000° C.

Clause 19: The golf club head of clause 18, wherein the α-β titanium alloy comprises a solvus temperature less than 930° C.

Clause 20: The golf club head of clause 15, wherein the α-β titanium alloy comprises a minimum yield strength between 155 ksi and 170 ksi.

Clause 21: The golf club head of clause 15, wherein the α-β titanium alloy comprises a minimum tensile strength between 163 ksi and 175 ksi.

Clause 22: The golf club head of clause 15, wherein the α-β titanium alloy comprises a minimum elongation between 4.5% and 7.0%.

Clause 23: The golf club head of clause 15, wherein the α-β titanium alloy wherein a density is between 4.410 g/cc and 4.425 g/cc.

Clause 24: The golf club head of clause 23, wherein the density is 4.423 g/cc.

Clause 25: The golf club head of clause 17, wherein the α-β titanium alloy comprises a young's modulus between 15.5 Mpsi and 17.0 Mpsi.

Clause 26: The golf club head of clause 1, wherein the α-β titanium alloy comprises between 1.0 wt % and 2.0 wt % molybdenum (Mo).

Clause 27: The golf club head of clause 26, wherein the α-β titanium alloy comprises between 0.2 wt % and 0.8 wt % iron (Fe), between 0.0 wt % and 0.2 wt % Silicon (Si), between 3.0 wt % and 5.0 wt % Vanadium (V), and between 6.0 wt % and 7.0 wt % aluminum (Al).

Clause 28: The golf club head of clause 26, wherein the α-β titanium alloy comprises less than 0.10 wt % of carbon, less than 0.05 wt % of nitrogen, and less than 0.015 wt % or hydrogen.

Clause 29: The golf club head of clause 26, wherein the α-β titanium alloy comprises a solvus temperature between 800° C. and 1000° C.

Clause 30: The golf club head of clause 29, wherein the α-β titanium alloy comprises a solvus temperature less than 930° C.

Clause 31: The golf club head of clause 29, wherein the α-β titanium alloy comprises a minimum yield strength between 150 ksi and 160 ksi.

Clause 32: The golf club head of clause 29, wherein the α-β titanium alloy comprises a minimum tensile strength between 157 ksi and 170 ksi.

Clause 33: The golf club head of clause 29, wherein the α-β titanium alloy comprises a minimum elongation between 4.5% and 8.0%.

Clause 34: The golf club head of clause 29, wherein the α-β titanium alloy wherein a density is between 4.410 g/cc and 4.425 g/cc.

Clause 35: The golf club head of clause 34, wherein the density is 4.413 g/cc.

Clause 36: The golf club head of clause 29, wherein the α-β titanium alloy comprises a young's modulus between 14 Mpsi and 20 Mpsi.

The invention claimed is:

1. A method of forming a golf club head assembly, the method comprising:

(a) providing an ingot formed from an α-β titanium alloy, the α-β titanium alloy comprising between 5.0 wt % and 7.0 wt % aluminum (Al), between 1.0 wt % and 5.5 wt % Vanadium (V), between 0.75 wt % and 2.5 wt % molybdenum (Mo), and a Ti balance, (b) radial forging the ingot to form a billet;

(c) slicing the billet to form a section;

(d) press forging the section to form a plate;

(e) cross rolling the plate to form a sheet;

wherein the plate is heated to a temperature between 850° C. and 950° C. prior to cross rolling;

(f) laser-cutting the sheet to form a desired shape of a faceplate of the golf club head assembly;

(g) aligning the faceplate with a recess of a club head of the golf club head assembly;

(h) welding the faceplate to the club head;

(i) heating the club head and an entirety of the faceplate to a temperature lower than a solvus temperature of the faceplate for a predetermined amount of time;

wherein the solvus temperature is between 800° C. and 1000° C.:

(j) cooling the club head and the faceplate by an inert gas;

(k) heating the club head and the faceplate to a temperature between 500° C. and 700° C. for a predetermined amount of time; and (l) cooling the club head and faceplate by an inert gas and by air.

2. The method of claim 1, wherein the α-β titanium alloy comprises between 5.0 wt % to 7.0 wt % aluminum (Al).

3. The method of claim 1, wherein the α-β titanium alloy further comprises between 0.2 wt % to 1.0 wt % iron (Fe), between 0.0 wt % to 0.2 wt % Silicon (Si) and 0.15 wt % or less Oxygen (O).

4. The method of claim 1, wherein the welding of step (h) includes a pulse plasma welding process.

5. The method of claim 1, wherein the inert gas of step (j) is selected from the group consisting of nitrogen (N), argon (Ar), helium (He), neon (Ne), krypton (Kr), and xenon (Xe), a compound gas thereof.

6. The method of claim 1, wherein the inert gas of step ( ) is Nitrogen.

7. The method of claim 1, wherein the faceplate of step (f) has a minimum thickness of 0.065 inches.

8. The method of claim 1, wherein the faceplate of step (f) has a thickness between 0.065 inches and 0.100 inches.

9. The method of claim 1, wherein step (i) includes heating the club head and the faceplate at or below 950° C. for between 1 hour and 2 hours.

10. The method of claim 1, wherein step (k) includes heating the club head and the faceplate at or below 620° C. for between 4 hours and 8 hours.

11. The method of claim 1, wherein step (b) a plurality of di rotate about a central axis of the ingot.

* * * * *